US010888207B2

(12) United States Patent
Tomasiak

(10) Patent No.: US 10,888,207 B2
(45) Date of Patent: Jan. 12, 2021

(54) VACUUM APPARATUSES WITH IMPROVED STABILITY AND METHODS THEREOF

(71) Applicant: Emerson Electric Co., St. Louis, MO (US)

(72) Inventor: Mark Tomasiak, St. Peters, MO (US)

(73) Assignee: Emerson Electric Co., St. Louis, MO (US)

( * ) Notice: Subject to any disclaimer, the term of this patent is extended or adjusted under 35 U.S.C. 154(b) by 747 days.

(21) Appl. No.: 15/013,078

(22) Filed: Feb. 2, 2016

(65) Prior Publication Data

US 2016/0235266 A1 Aug. 18, 2016

Related U.S. Application Data

(60) Provisional application No. 62/110,667, filed on Feb. 2, 2015.

(51) Int. Cl.
*A47L 9/22* (2006.01)
*A47L 5/36* (2006.01)

(52) U.S. Cl.
CPC ..... *A47L 9/22* (2013.01); *A47L 5/365* (2013.01)

(58) Field of Classification Search
CPC .... A47L 5/365; A47L 9/0027; A47L 11/4019; A47L 9/22
See application file for complete search history.

(56) References Cited

U.S. PATENT DOCUMENTS 1,890,283 A * 12/1932 Eriksson-Jons ..... A47L 5/365 55/319
2,027,158 A * 1/1936 Forsberg ..... A47L 5/365 415/148
2,314,858 A * 3/1943 Forsberg ..... A47L 9/1666 55/336
2,741,329 A * 4/1956 Cherry ..... A47L 5/365 96/382
2,863,524 A * 12/1958 Buda ..... A47L 7/0028 96/406
2,962,117 A * 11/1960 Sisemore ..... A47L 5/365 96/416
2,983,432 A * 5/1961 Tupper ..... A47L 5/365 417/423.2
4,367,565 A * 1/1983 Parise ..... A47L 7/0009 15/321
5,301,386 A 4/1994 Thomas et al.
(Continued)

*Primary Examiner* — Bryan R Muller
(74) *Attorney, Agent, or Firm* — Armstrong Teasdale LLP

(57) ABSTRACT

Applicant has created vacuum apparatuses with improved stability and methods for improving the stability of a wet/dry vacuum. In one embodiment, the apparatus includes a motor, a removable drum adapted to store debris collected by the apparatus, and a base that can be adapted to receive the removable drum. The motor can be adapted to be interposed between the removable drum and the base. The methods can include the step of providing a base, the step of providing a removable drum adapted to be coupled to the base, and the step of coupling a vacuum motor to the base such that the vacuum motor is adapted to be disposed beneath the removable drum when the drum is coupled to the base. By relocating the motor of vacuum apparatus beneath the drum, the vacuum's center of gravity can be lowered significantly and, thus, its propensity to tip over is minimized.

21 Claims, 47 Drawing Sheets

(56) References Cited

U.S. PATENT DOCUMENTS

| | | | | |
|---|---|---|---|---|
| 6,009,596 | A * | 1/2000 | Buss | A47L 7/0028 15/352 |
| 6,070,288 | A * | 6/2000 | Luyckx | A47L 9/0009 15/323 |
| 6,341,404 | B1 * | 1/2002 | Salo | A47L 5/28 15/350 |
| 2004/0055105 | A1 * | 3/2004 | Park | A47L 5/365 15/353 |
| 2010/0236016 | A1 * | 9/2010 | Tran | A47L 9/1472 15/347 |

* cited by examiner

VACUUM APPARATUSES WITH IMPROVED STABILITY AND METHODS THEREOF

CROSS REFERENCE TO RELATED APPLICATIONS

This application is a non-provisional, and claims priority, of provisional application Ser. No. 62/110,667, filed Feb. 2, 2015, entitled "VACUUM APPARATUSES WITH IMPROVED STABILITY AND METHODS THEREOF", the entirety of which is incorporated herein by specific reference.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to improving the stability of a vacuum apparatus. More specifically, the inventions described relate to configuring a vacuum apparatus, such as a wet/dry vacuum, whereby the vacuum motor is disposed above or within the vacuum's base but beneath its drum. With this configuration, the vacuum's center of gravity can be lowered significantly to prevent it from accidentally tipping over.

Description of the Related Art

The inventions disclosed and taught herein are directed to improving the overall stability of a vacuum apparatus. Although these inventions can be used in numerous applications, the inventions will be disclosed in only a few of many applications for illustrative purposes.

Vacuum cleaners, more particularly, wet/dry vacuum cleaners, are available in various sizes and different configurations. One configuration, for example, includes a canister-type wet/dry vacuum cleaner that can include a plurality of wheels, such as casters, that provide a means for rolling the vacuum's canister to and from a particular area. Although the wheel bases of wet/dry vacuum cleaners are often designed to provide some stability of the vacuum (e.g., by increasing the number of wheels, widening the base, and/or increasing the distance between each of the wheels), wet/dry vacuum are inherently top heavy and, thus, prone to tipping.

Most conventional wet/dry vacuums include a drum with a powerhead above it. The powerhead would include a motor, motor cover, lid, and collector. In these conventional wet/dry vacuums the vacuum motor is typically installed on the lid. Because the motor is disposed above the collector in many of these designs, conventional wet/dry vacuums have an inherently high center of gravity and, thus, are prone to accidental tipping.

What is required, therefore, is a solution that significantly reduces the vacuum's overall center of gravity in order to prevent the vacuum from accidentally tipping. Accordingly, the inventions disclosed and taught herein are directed to systems, methods, and apparatuses for improving the overall stability of a vacuum apparatus.

BRIEF SUMMARY OF THE INVENTION

The inventions disclosed and taught herein are directed to systems, methods, and apparatuses for improving the overall stability of a vacuum apparatus. The objects described above and other advantages and features of the invention are incorporated in the application as set forth herein, and the associated appendices and drawings.

Applicant has created vacuum apparatuses with improved stability and methods for improving the stability of a wet/dry vacuum. This positioning of the motor near the ground and inside the drum is inherently quieter than conventional designs. In one embodiment, the apparatus includes a motor, a removable drum adapted to store debris collected by the apparatus, and a base that can be adapted to receive the removable drum. The motor can be adapted to be interposed between the removable drum and the base. The methods can include the step of providing a base, the step of providing a removable drum adapted to be coupled to the base, and the step of coupling a vacuum motor to the base such that the vacuum motor is adapted to be disposed beneath the removable drum when the drum is coupled to the base. By relocating the motor of vacuum apparatus beneath the drum, the vacuum's center of gravity can be lowered significantly and, thus, its propensity to tip over is minimized.

In a first embodiment, the vacuum apparatus can include a vacuum motor, a removable drum that can be adapted to store debris collected by the vacuum apparatus, and a base that can be adapted to receive the removable drum. The vacuum motor can be adapted to be interposed between the removable drum and the base. The vacuum apparatus can further include at least two casters that are adapted to be coupled to a first edge of the base and two additional casters that can be adapted to be coupled to a second edge of the base. The second edge can be disposed on a side of the base opposite the first edge.

The vacuum apparatus can further include an accessory coupler that can be adapted to couple or more accessories to the drum and the coupler can be adapted to expand and contract to store the one or more accessories. Further, the vacuum apparatus can include a power switch disposed below the removable drum such that the power switch is adapted to be toggled between an on and off position by an operator's foot. Still further, the vacuum apparatus can include a biased actuator that can be adapted to facilitate the coupling and decoupling of the drum to the base and a lock mechanism that can be adapted to be received by a receiving plate in the base to secure the drum to the base.

Moreover, the vacuum apparatus can include a removable drum that can include a first maximum storage capacity. The removable drum can be adapted to be interchanged with a replacement removable drum having a second maximum storage capacity that is either less than or greater than the first maximum storage capacity. Finally, the removable drum can be adapted to attenuate the sound produced by the motor.

In a second embodiment, the vacuum apparatus can include a vacuum motor, a removable drum that can be adapted to store debris collected by the vacuum apparatus, and a base that can be adapted to receive the removable drum. The vacuum motor can be disposed beneath and coupled to the base and the removable drum can be adapted to be removed without decoupling the motor from the base.

Further, the motor can be disposed in a vertical orientation relative to the drum and the base and axially aligned with the drum's central axis.

The vacuum apparatus can further include an auto-shutoff switch that can be actuated when the removable drum is filled to at least a predetermined capacity and the removable drum can further include an inlet that can be adapted to pass air between an inside and outside portion of the removable drum.

The method can include the step of providing a base that can include two or more casters and the step of providing a removable drum that can be adapted to be coupled to the base. Further, the method can include the steps of coupling a vacuum motor to the base and providing a drum cover that can include an access cover for the removable drum. The vacuum motor can be adapted to be disposed beneath the removable drum when the drum is coupled to the base. Moreover, the drum cover and access cover can each be adapted to engage in an open and a closed position and the drum can be adapted to receive debris through the access cover when the access cover is in an open position and the drum cover is in a closed position.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1A:
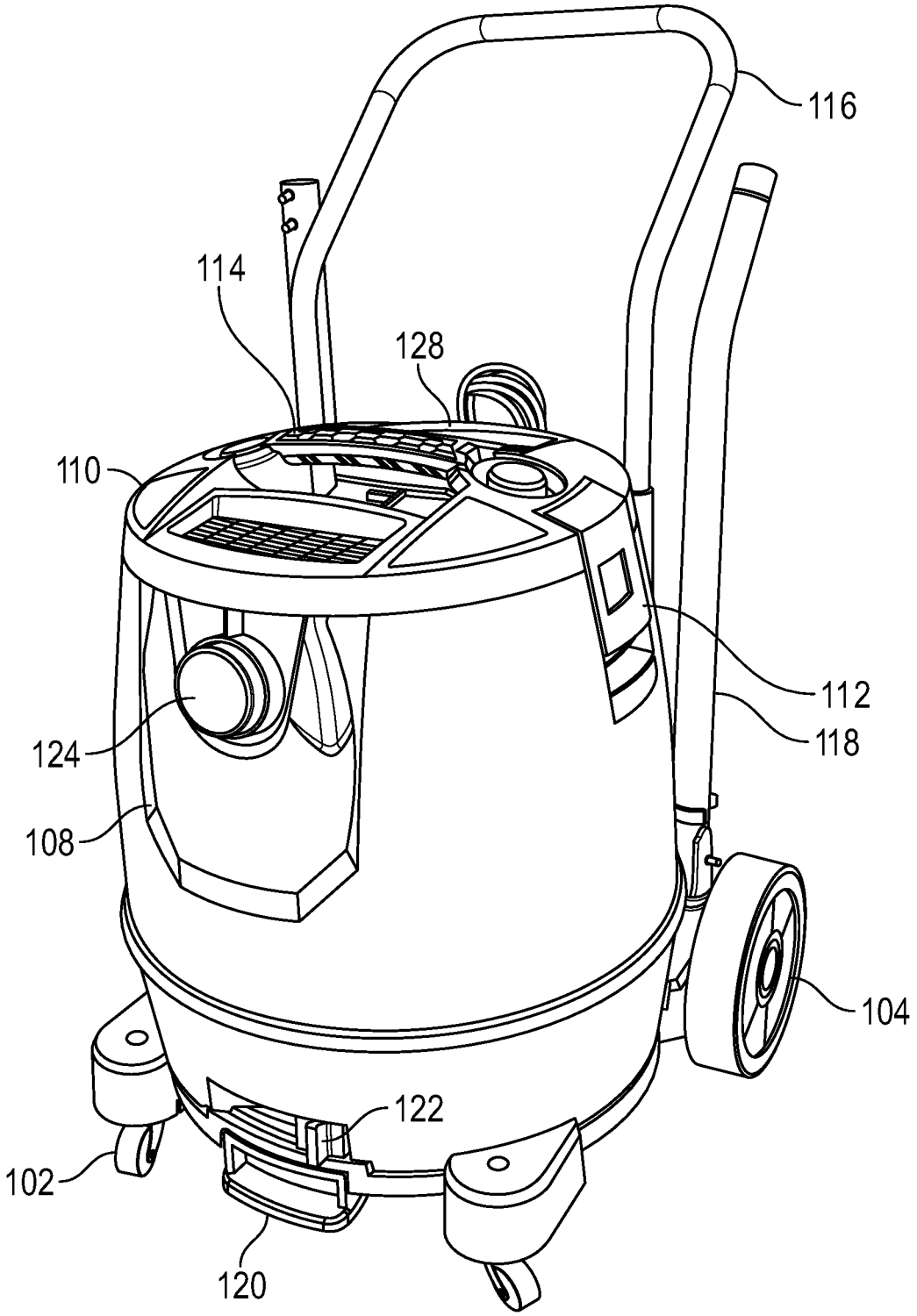
FIG. 1A illustrates a front isometric view of a first embodiment of a vacuum apparatus of the present disclosure.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION OF THE INVENTION

The figures described above and the written description of specific structures and functions below are not presented to limit the scope of what Applicant has invented or the scope of the appended claims. Rather, the figures and written description are provided to teach any person skilled in the art to make and use the invention for which patent protection is sought.

Those skilled in the art will appreciate that not all features of a commercial embodiment of the invention are described or shown for the sake of clarity and understanding. Persons of skill in this art will also appreciate that the development of an actual commercial embodiment incorporating aspects of the present invention will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location and from time to time. While a developer's efforts might be complex and time-consuming in an absolute sense, such efforts would be, nevertheless, a routine undertaking for those of skill in this art having benefit of this disclosure.

It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the figures and are not intended to limit the scope of the invention or the appended claims.

The terms "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and can further include without limitation integrally forming one functional member with another in a unity fashion. The coupling can occur in any direction, including rotationally.

Applicant has created vacuum apparatuses with improved stability and methods for improving the stability of a wet/dry vacuum. In one embodiment, the apparatus includes a motor, a removable drum adapted to store debris collected by the apparatus, and a base that can be adapted to receive the removable drum. The motor can be adapted to be interposed between the removable drum and the base. The methods can include the step of providing a base, the step of providing a removable drum adapted to be coupled to the base, and the step of coupling a vacuum motor to the base such that the vacuum motor is adapted to be disposed beneath the removable drum when the drum is coupled to the base. By relocating the motor of vacuum apparatus beneath the drum, the vacuum's center of gravity can be lowered significantly and, thus, its propensity to tip over is minimized.

Figure 1B:
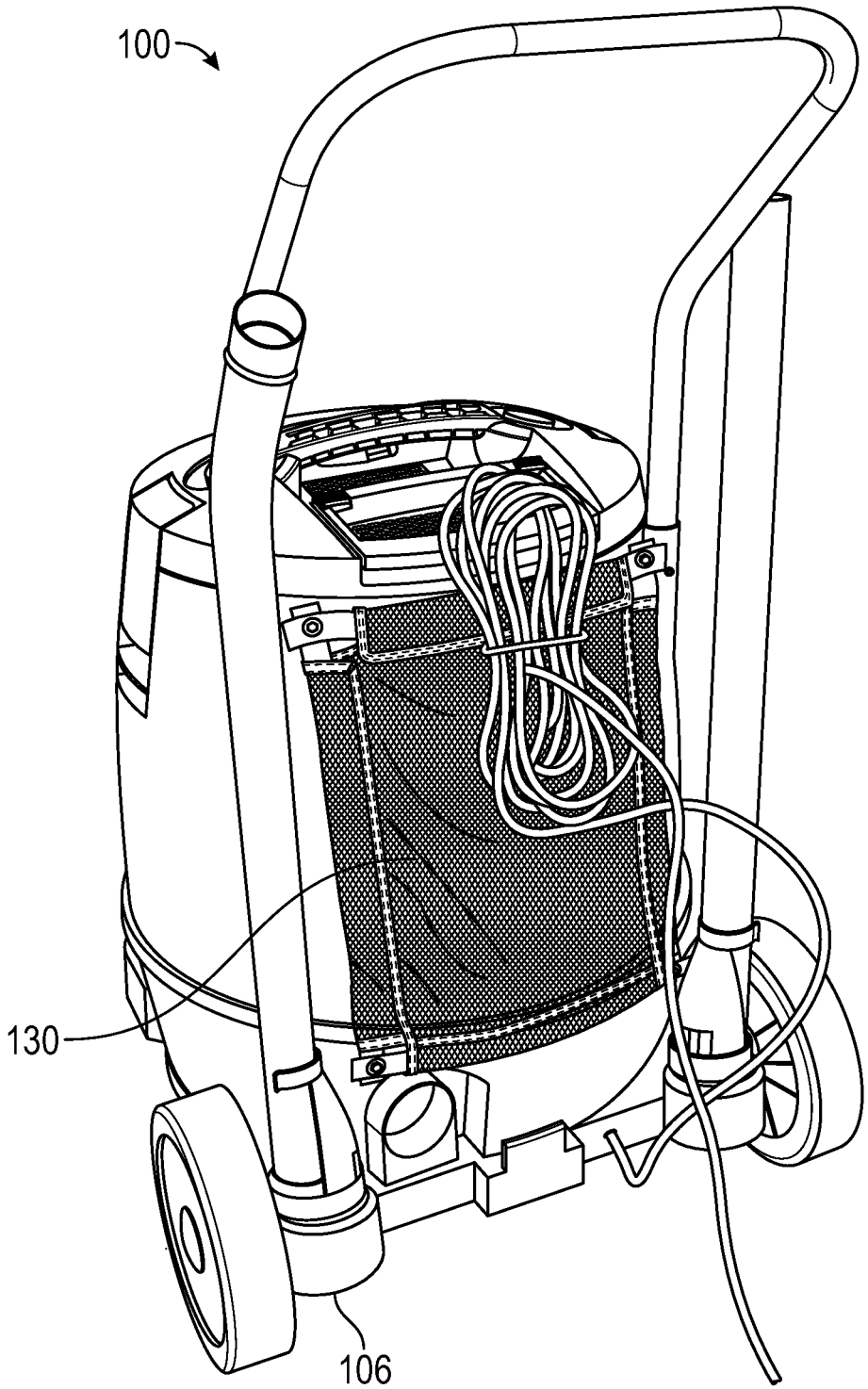
FIG. 1B illustrates a rear isometric view of the apparatus illustrated in FIG. 1A.
Figure 1C:
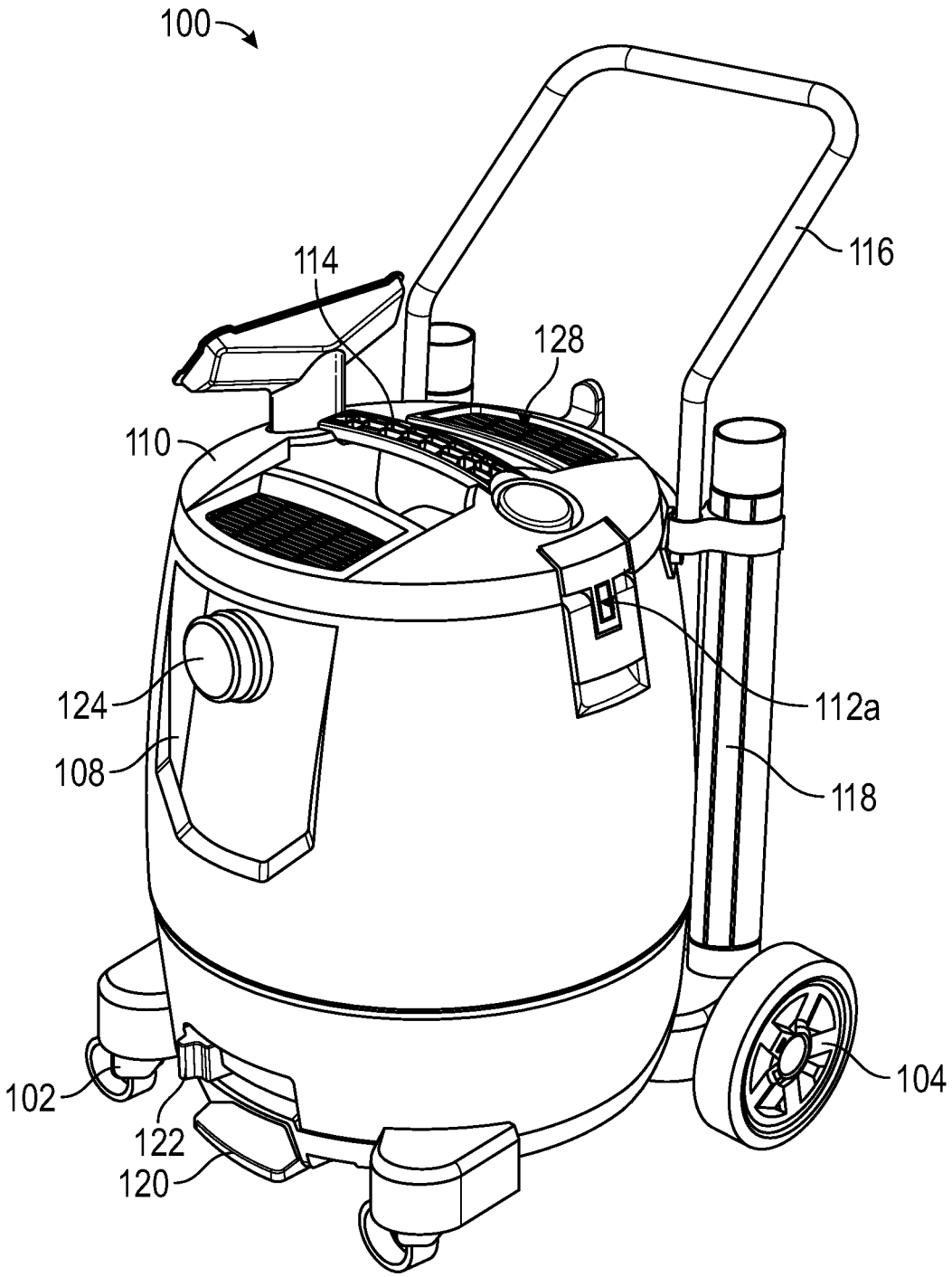
FIG. 1C illustrates a front isometric view of a second embodiment of a vacuum apparatus of the present disclosure.
Figure 1D:
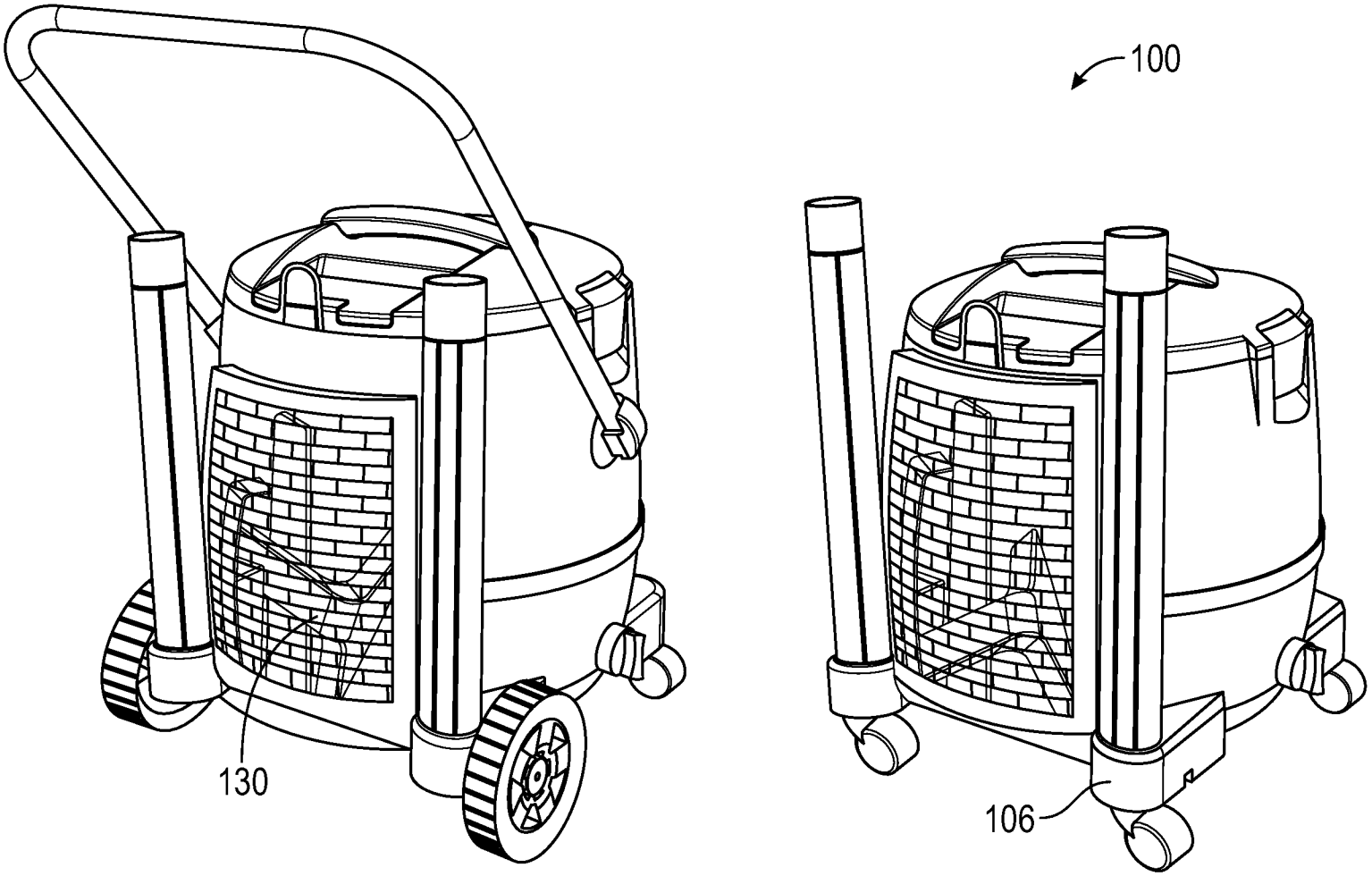
FIG. 1D illustrates a rear isometric view of the apparatus illustrated in FIG. 1C.
Figure 1E:
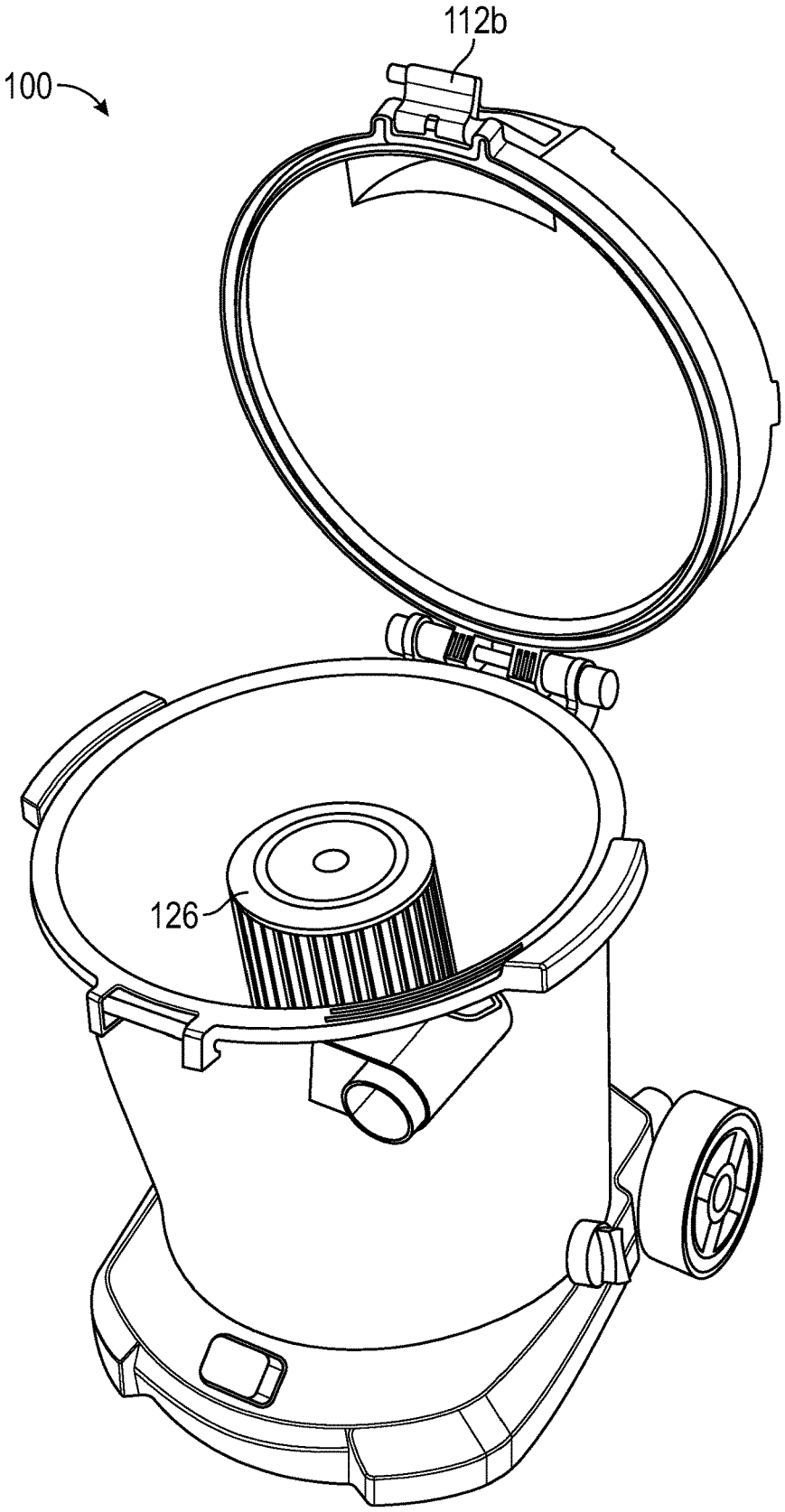
FIG. 1E illustrates a front isometric view of a third embodiment of a vacuum apparatus of the present disclosure with the drum cover in an open position.
Figure 1F:
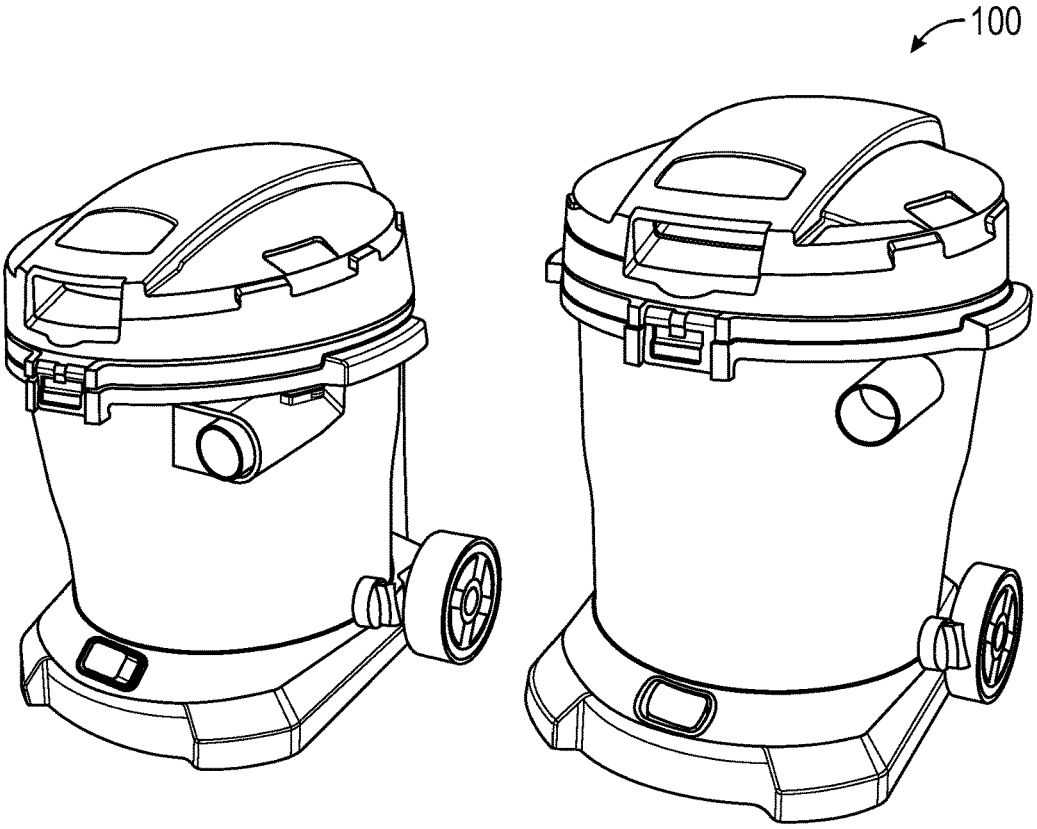
FIG. 1F illustrates a front isometric view of the vacuum apparatus illustrated in FIG. 1E with the drum cover in a closed position.
Figure 1G:
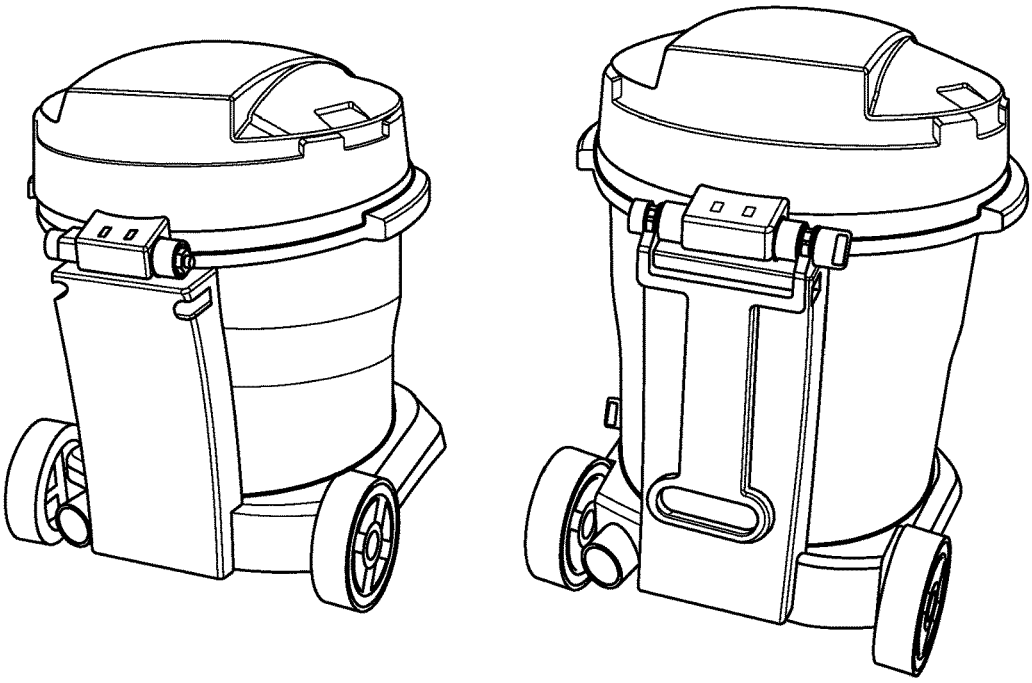
FIG. 1G illustrates a rear isometric view of the vacuum apparatus illustrated in FIG. 1E with the drum cover in a closed position.
Figure 1H:
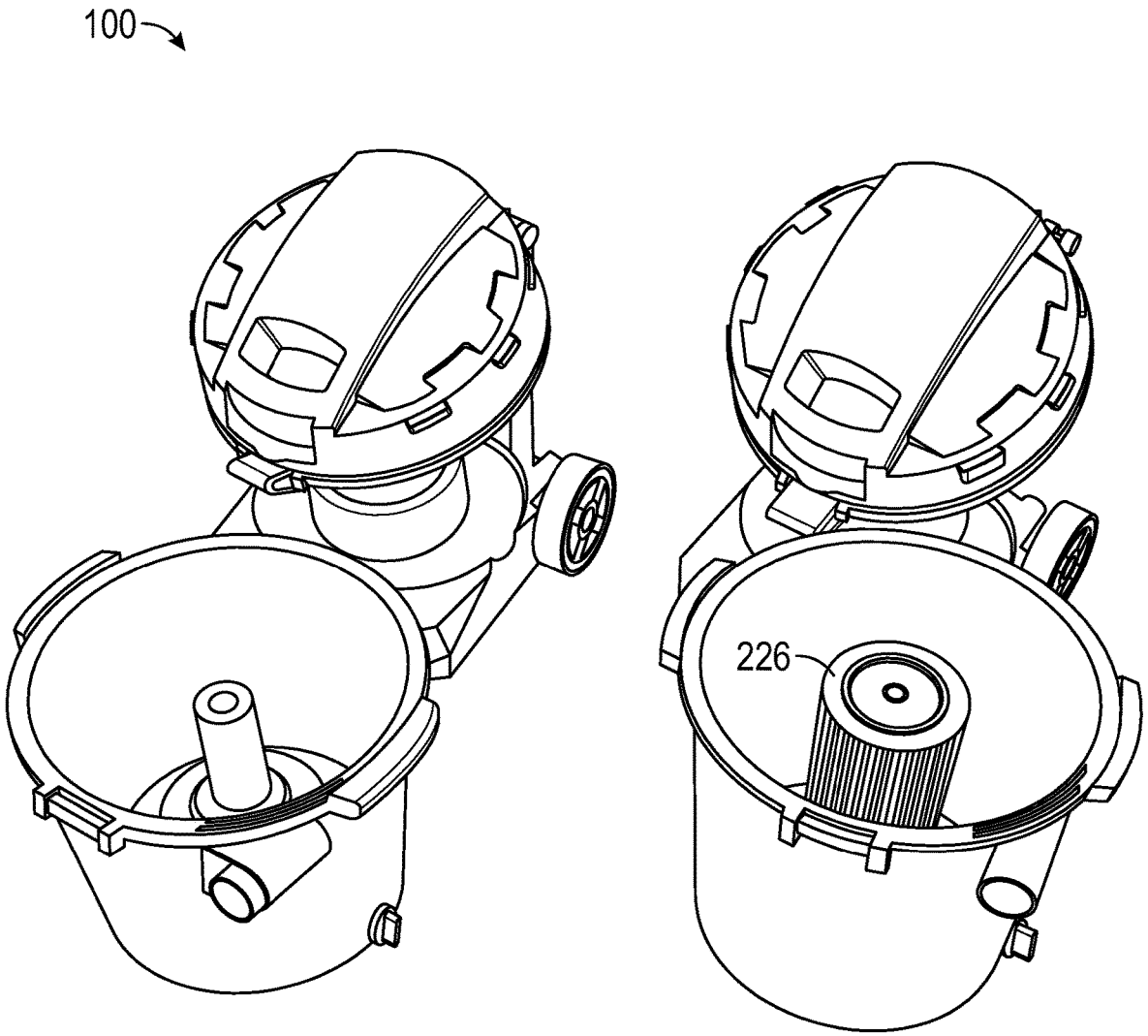
FIG. 1H illustrates the vacuum apparatus illustrated in FIG. 1E with the drum removed from its base, with and without a filter element.
Figure 1J:
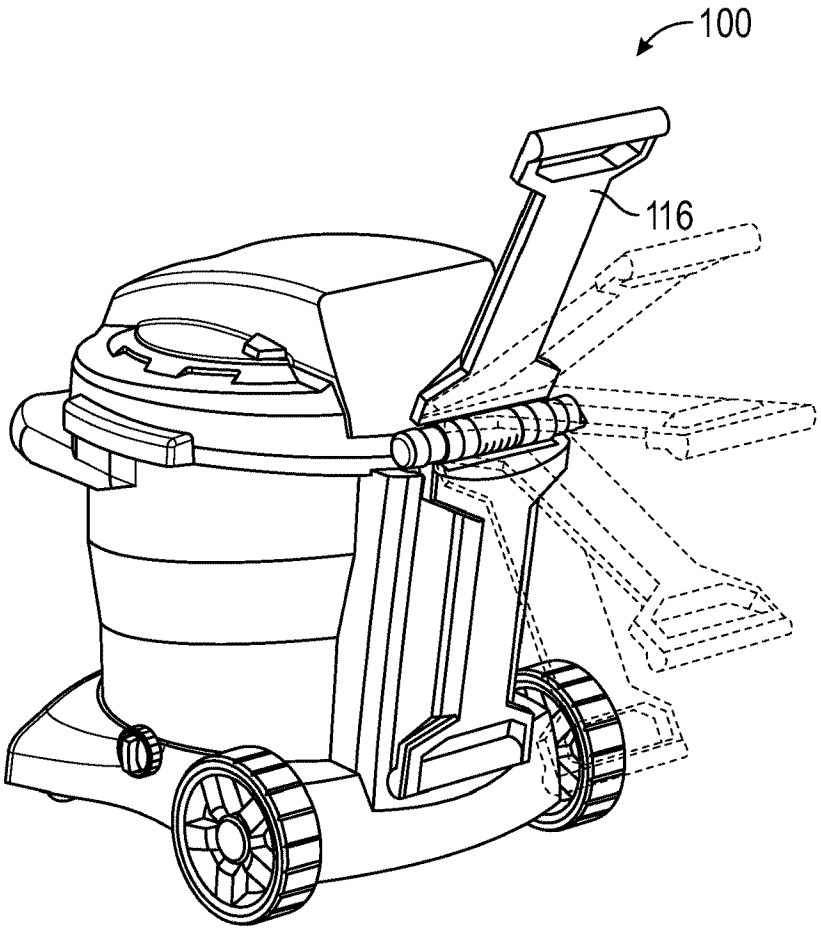
FIG. 1J illustrates the vacuum apparatus illustrated in FIG. 1E illustrating exemplary movement of the vacuum apparatus handle in accordance with certain aspects of the present disclosure.
Figure 1I:
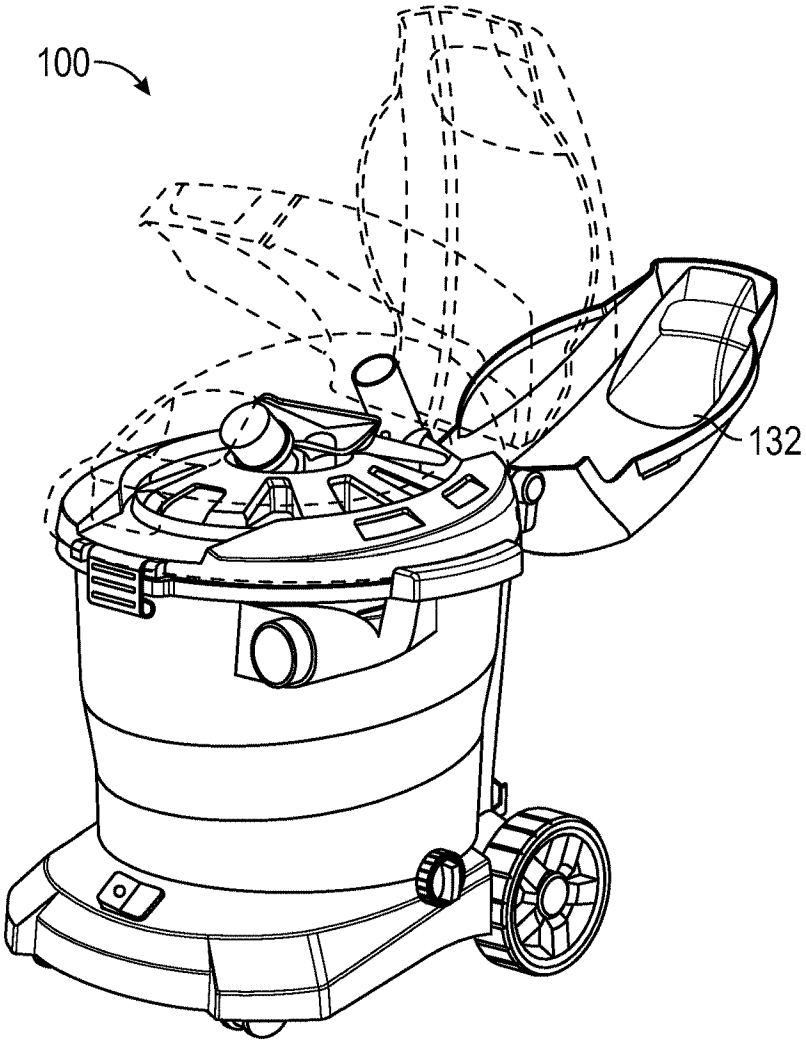
FIG. 1I illustrates the vacuum apparatus illustrated in FIG. 1E illustrating exemplary movement of the accessory cover in accordance with certain aspects of the present disclosure.
Figure 1K:
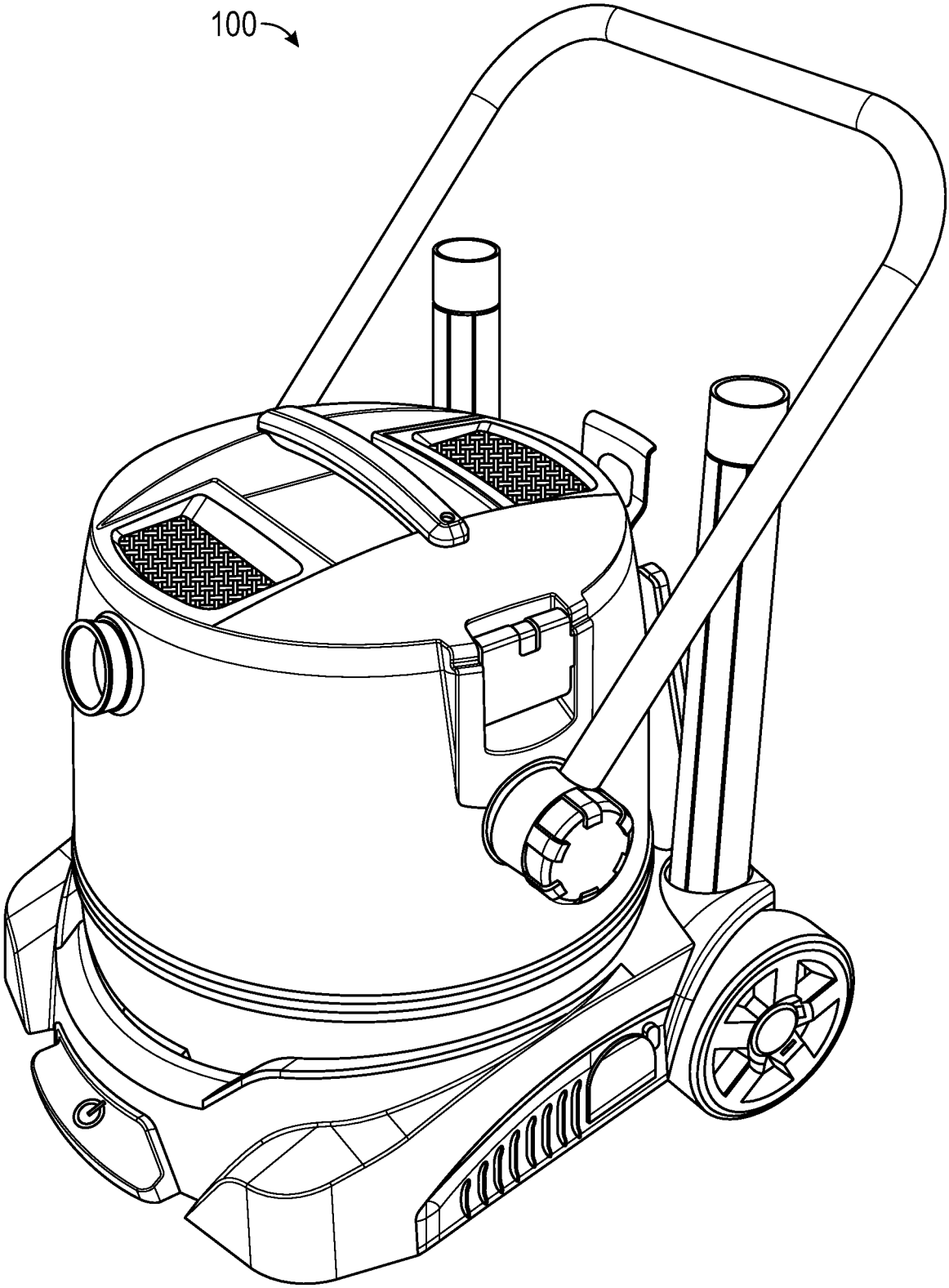
FIG. 1K illustrates a fourth embodiment of a vacuum apparatus of the present disclosure with the drum cover in a closed position.

Turning now to the figures, FIG. 1C illustrates a front isometric view of an embodiment of a vacuum apparatus of the present disclosure. FIG. 1D illustrates a rear isometric view of the apparatus illustrated in FIG. 1C, with and without a handle. FIG. 1E illustrates a front isometric view of another embodiment of a vacuum apparatus of the present disclosure with the drum cover in an open position. FIG. 1F illustrates a front isometric view of the vacuum apparatus illustrated in FIG. 1E with the drum cover in a closed position. FIG. 1G illustrates a rear isometric view of the vacuum apparatus illustrated in FIG. 1E with the drum cover in a closed position. FIG. 1H illustrates the vacuum apparatus illustrated in FIG. 1E with the drum removed from its base, with and without a filter element installed. FIG. 1I illustrates the vacuum apparatus illustrated in FIG. 1E illustrating exemplary movement of the accessory cover in accordance with certain aspects of the present disclosure. FIG. 1J illustrates the vacuum apparatus illustrated in FIG. 1E illustrating exemplary movement of the vacuum apparatus handle in accordance with certain aspects of the present disclosure. FIG. 1K illustrates another embodiment of a vacuum apparatus of the present disclosure with the drum cover in a closed position. These figures will be described in conjunction with one another.

Referring specifically to FIGS. 1C and 1D, vacuum apparatus 100 can include a removable drum 108 that can be adapted to store debris collected by the vacuum apparatus 100, and a base 106 that can be adapted to receive the removable drum 108.

The removable drum 108 (equivalently referred to herein as "collector" or "collection drum") can include a bottom, sides, and an open top. Further, the drum 108 can be coupled to and decoupled from base 106 such that at least a portion of the bottom of drum 108 is coupled to at least a portion of base 106. For example, the drum 108 can be decoupled from base 106 by lifting drum 108 vertically with respect to base 102. In another example, the removable drum 108 can be secured, fixed, or otherwise locked to the base 106 through drum lock 122 (as discussed in greater detail below in conjunction with drum lock 882 and receiving plate 886 of FIGS. 8D and 8E).

Drum 108 can be circular, cylindrical, or oval in shape, or in the alternative, may be of other suitable shapes as appropriate, such as square or rectangular, without limitation. In one embodiment, drum 108 can be single-piece molded drum (for example, as illustrated in FIG. 1E), or a two-piece molded drum (for example, as illustrated in FIG. 1K). Finally, drum 108 can include one or more handles (for example, as illustrated in FIG. 1E) for assisting an operator with the coupling to and decoupling the drum 108 from base 106.

Base 106 can include any frame, chassis, or other support feature for supporting drum 108 and other features of the vacuum apparatus 100. For example, base 106 can include a single monolithic structure (formed, for example, through a mold, such as a molded plastic) in a shape to facilitate receiving drum 108 (e.g., molded with a depression near the center of the base and a lip on the outer edge of the base to prevent the drum 106 for moving in a horizontal direction relative to the base 106). In this configuration, base 106 can be a solid shape surrounding the drum in a shape that is both aesthetically pleasing and functional.

Figure 2:
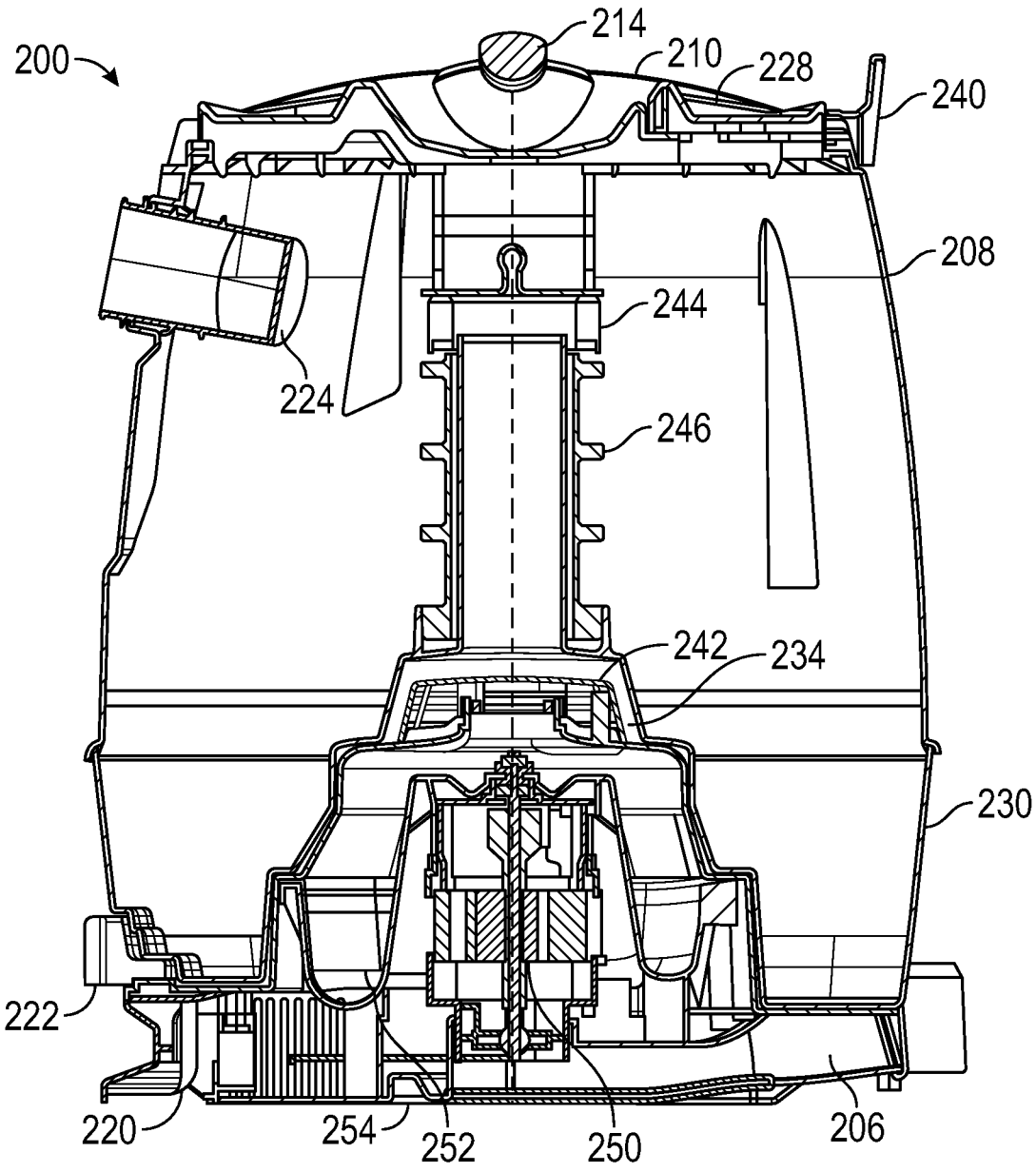
FIG. 2 illustrates a cross-sectional view of the first embodiment of the vacuum apparatus illustrated in FIG. 1C.

In another example, base 106 can be limited to include just the material required to form the base 106 to cover the motor 250 (as illustrated in FIG. 2), and to extend to where the casters 102 and/or wheels 104 are disposed. In still another example, base 102 can be assembled from two or more support features to form a structure that can support the remaining elements of the vacuum apparatus 100.

The vacuum apparatus can further include at least two casters 102 that are adapted to be coupled to a first edge of the base 106 and two additional casters (shown, for example, in FIG. 1D) that can be adapted to be coupled to a second edge of the base 106. The second edge can be disposed on a side of the base opposite the first edge. Casters 102 can include one or more wheels or other rolling structures adapted facilitate movement of the base 106 along a cleaning surface. Casters 102 can include wheel assemblies that can either be permanently coupled to base 106 or coupled in a manner such that an operator can easily decouple and recouple one or more of the casters 102 to the base 106.

In the embodiment illustrated in FIG. 1C, the two additional casters 102 are replaced by wheels 104. In one example, the wheels 104 can differ from the casters 102 in that the former can limit movement of base 102 to a single degree of freedom (e.g., only move forward and back but not side-to-side), whereas casters 102 can be adapted to permit two degrees of freedom (permitting the caster to pivot a full 360 degrees along the vacuum apparatus' vertical axis). In some examples, wheels 104 can be larger than the casters 102.

To assist with movement of the vacuum apparatus 100, a vacuum apparatus handle 116 can be coupled to the base 102 and/or other portions of vacuum apparatus 100. The vacuum apparatus handle 116 can be designed as a rigid structure (such as, for example, as shown in FIG. 1C), or it can be configured to pivot in multiple directions (for example, vertically, as shown in greater detail in FIG. 4C, as described in greater detail below).

The vacuum apparatus 100 can further include a drum cover 110 that can be coupled to and decoupled from drum 108 and cover 110 can include cover handle 114 to assist with coupling and decoupling of cover 110 to and from drum 108. In one example cover 110 can be secured to drum 108 with the aid of a hinge or the like so that when in a opened position, a portion of the cover 110 remains coupled to the drum 108 (i.e., the portion coupled to the hinge).

In another example, the hinge feature can be omitted and the cover 110 can be in an open position when entirely removed from drum 108 or in a closed position when the entire outer circumference of cover 110 is coupled to a top portion of drum 108. The opening and closing of cover 110 can be facilitated with the aid of cover handle 114 to permit an operator to grasp the handle 114 to coupled and decouple the cover 110 to and from drum 108. In one example, cover 110 can be purely ornamental, and it can further allow for quick drum 108 access for the removal and emptying of debris. Finally, because cover 110 can be designed for aesthetic purposes only (by virtue of positioning motor 250

(as illustrated in FIG. 2) below drum 108), cover 110 can be created as a lighter weight, and a much more manageably-sized cover.

Cover 110 can be further secured to drum 108 with the aid of latch assembly 112. Latch assembly 112 can be formed as part of cover 110 or can be separately coupled to cover 110. In one example (e.g., FIG. 1C) latch assembly 112*a* can couple to a portion of the side of drum 108. In another example (e.g., FIG. 1E), latch assembly 112*b* can be coupled to a front portion of the drum 108, such as a lip or other protrusion. In both of these examples, latch assembly 112 can be lifted and/or pulled away from drum 108 in order permit an operator to open and/or close the cover 110. Finally cover 110 can include an access cover 128. The access cover 128 is described in greater detail below in conjunction with FIGS. 7A and 7B.

Drum 108 can further include inlet 124 that can be adapted to pass air between an inside and outside portion of the removable drum 108. For example, as vacuum motor 250 (as illustrated in FIG. 2) is activated, air from an outside portion of inlet 124 can be pulled through inlet 124 to an inside portion of drum 108 that can include filter 126 (described in greater detail below in conjunction with FIG. 2). Although inlet 124 is illustrated a being disposed on a front portion of drum 108 in FIG. 1A, other configurations are contemplated as well. For example, inlet 124 can be disposed on the side or rear portion of drum 108, near a middle top portion, as a tangent inlet near the top, a bottom portion of the drum 108, or on a portion of drum cover 110.

In other examples, inlet 124 can be located relative to drum 108 such that it is located tangentially to the inside or outside of drum 108, centered on its axis, or placed off center of axis of drum 108. Finally, inlet 124 can be designed to engage one or more accessories 118 in a friction-fit and/or lock-fit manner such that air, debris, and other liquids and/or solid media pass through the accessory 118, though inlet 124, and into drum 108.

Vacuum apparatus 100 can further include an accessory coupler 130 that can be adapted to couple or more accessories 118 to the drum 108. Accessories 118 can include any brush, crevice tools, squeegee, wand, or the like that can be used in conjunction the vacuum apparatus 100, either through a friction-fit, or lock-fit configuration to be quickly interchanged throughout operation of the vacuum apparatus 100.

Figure 6A:
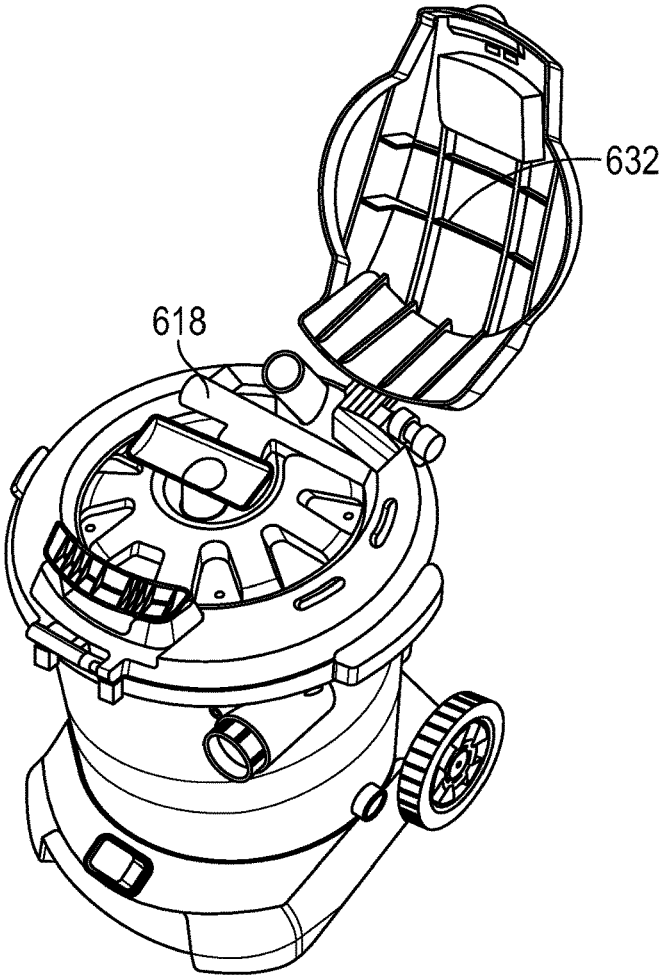
FIG. 6A illustrates an exemplary storage area for accessories under the accessory cover of the vacuum apparatus as illustrated in FIG. 1E.
Figure 6B:
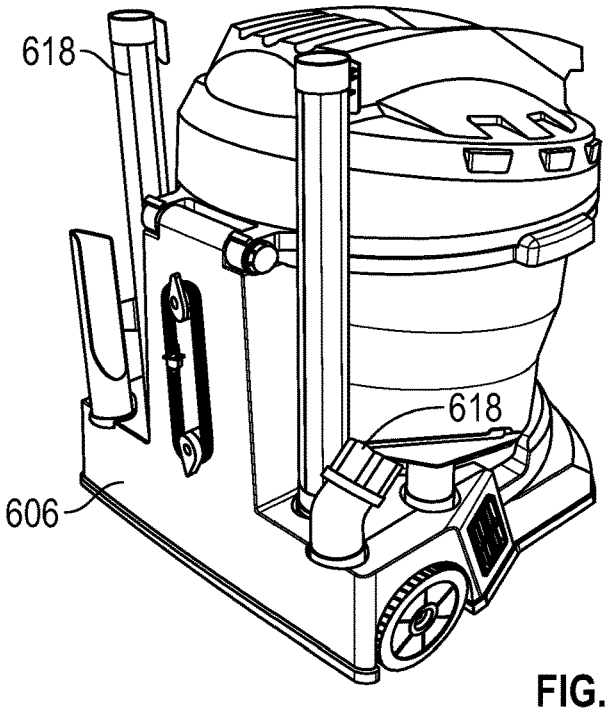
FIG. 6B illustrates an exemplary storage area of accessories coupled to the base of the vacuum apparatus as illustrated in FIG. 1E.
Figure 6D:
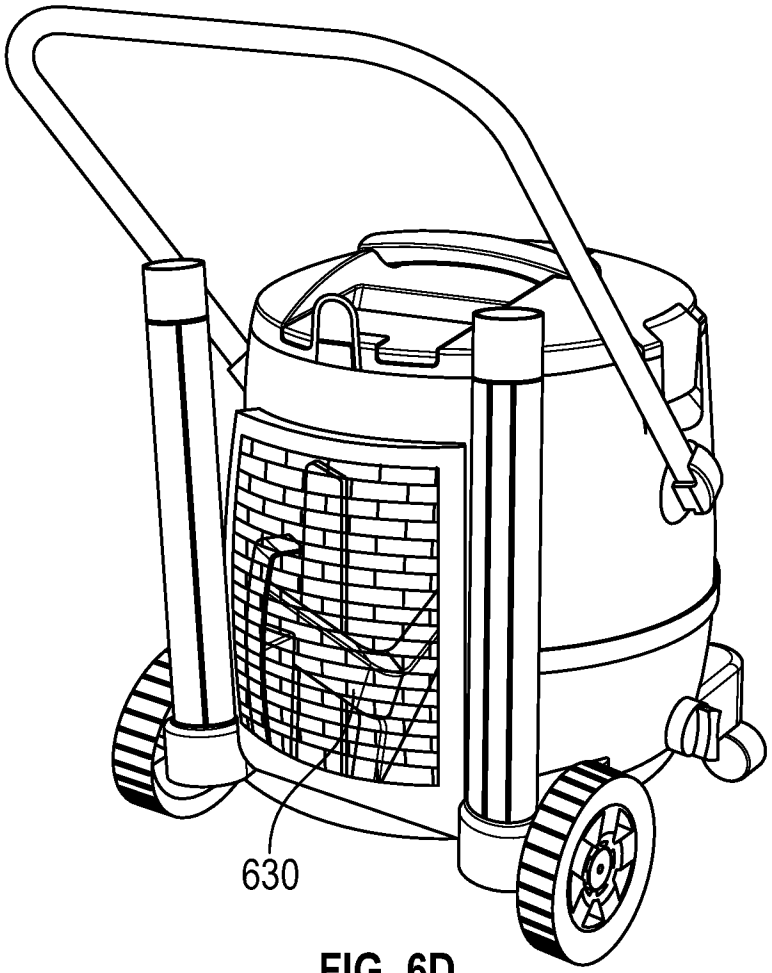
FIG. 6D illustrates an exemplary accessory coupler of the vacuum apparatus as illustrated in FIG. 1D.
Figure 6C:
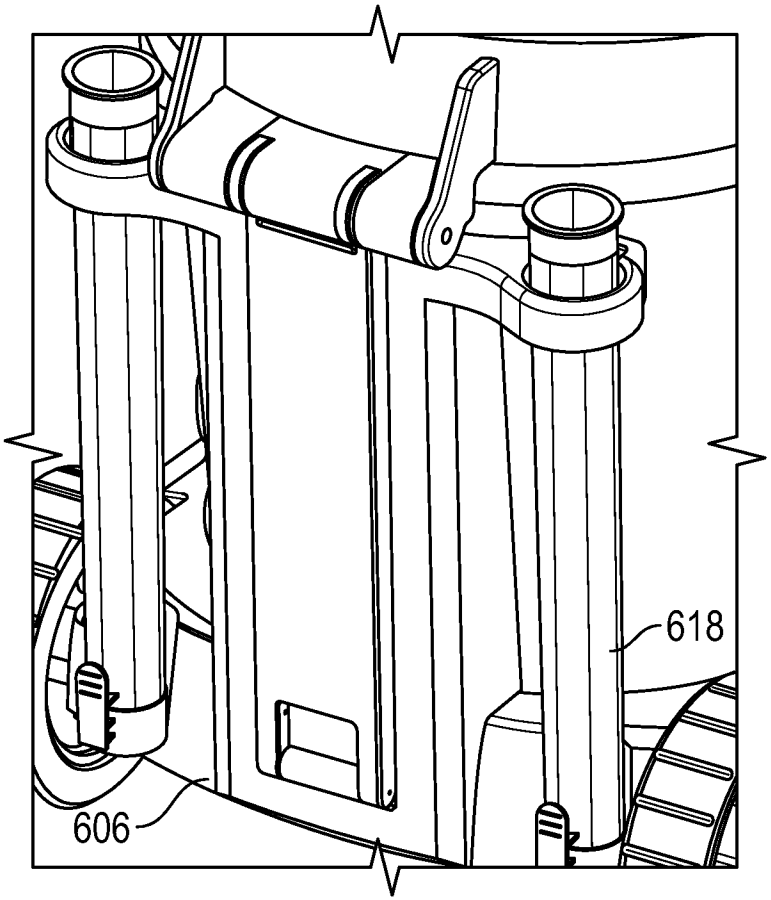
FIG. 6C illustrates additional storage areas for accessories in accordance with various aspects of the present disclosure.

Although various configurations of mounting accessories 118 to base 108 are illustrated in FIGS. 6A-6C and described in greater detail below, the embodiment illustrated in FIG. 1D illustrates an example of accessory coupler 130 that utilizes an accessory securing mechanism other than friction-fit or lock-fit coupling. For example, accessory coupler 130 can be coupled to a portion of drum 108 (such as, for example, a rear portion). And coupler 130 can be designed in a flexible-type configuration (such as an open-weave storage system) that expands and contracts to store the accessories tight to drum. In this example, the coupler 130 can be made of a resilient, elastic-type material that can flex when expanded (such as when an operator stores the accessories 118 between coupler 130 and drum 108) and contract to its original shape when the accessories 118 are removed.

Additionally, vacuum apparatus 100 can include an accessory cover 132. Accessory cover 132 can be coupled to a portion of drum 108 or cover 110 in a manner similar to the coupling of cover 110 to drum 108 as described above. When in an open position, accessory cover 132 can permit accessories 118 to be stored within and/or atop a portion of cover 110 as illustrated in greater detail in FIG. 1I.

Finally, the vacuum apparatus 100 can further include a power switch 120 disposed below the removable drum 108 such that the power switch 120 can be adapted to be toggled between an on and off position by an operator's foot. In other examples, power switch be disposed at a different location about base 106, such as, for example, at a rear portion, or, in the alternative, power switch 120 can be replaced with a standard hand-operated power supply switch.

For FIGS. 2-12, many, but not all, of the illustrated features of the described inventions share features with the embodiments described in FIGS. 1A-1K, above, and in many instances, merely provide additional detail for features already described in conjunction with FIGS. 1A-1K. For example, referring specifically to FIG. 1C, the exemplary vacuum apparatus 100 illustrated includes drum 108, among other features. FIG. 2 illustrates a detailed cross-sectional view of drum 108 (labeled drum 208). Accordingly, the elements in FIGS. 2-12 with labels that correspond with the labels of elements in FIGS. 1A-1I are intended to describe the corresponding elements of FIGS. 2-12. For example, drum 208 of FIG. 2 further illustrates drum 102 of FIG. 1A, base 206 of FIG. 2 further illustrates base 106 of FIG. 1C, motor 250 of FIG. 2 further illustrates motor 350 of FIG. 3B, and so on.

FIGS. 1A and 1B show an alternative metal wand holder in conjunction with the embodiment show in FIGS. 1C and 1D. Features from any of these, and other embodiments may be mixed and matched with features of other embodiments. For example, the handle shown in FIG. 1D may be interchanged with that shown in FIG. 1B.

Moving to FIG. 2, this figure illustrates a cross-sectional view of the first embodiment of the vacuum apparatus illustrated in FIG. 1C. Vacuum apparatus 100 can include a vacuum motor 250. The motor 250 can be disposed beneath and coupled to the base 206 and the removable drum 208 can be adapted to be removed without decoupling the motor 250 from the base 206. In another example, motor 250 can be interposed between the removable drum 208 and base 206. Further, the motor 250 can be disposed in a vertical orientation relative to the drum and the base and axially aligned with the drum's central axis, for example, as illustrated in FIG. 2.

Because motor 250 is vertically aligned, it is permitted to draw air through the central portion of drum 208 such that the air flow caused by the motor (either pulling air to create a vacuum or pushing it as a blower) flows along a natural path (i.e., without requiring it to turn, twist, or contort beyond its natural flow). This natural air flow can increase the overall performance of the vacuum apparatus 200 and increase the overall airflow and efficiency of the apparatus 200. Put another way, by placing the motor 250 along the same axis as the drum 208, the air flow enjoys an unobstructed flow path around outside periphery of the drum 208. This unique airflow path is significant because the debris collected by collector 208 will remain in a cyclonic flow path around collector 208 which reduces the likelihood it will interact with obstructions and/or other projections within collector 208 that could otherwise increase the turbulence with collector 208. In other embodiment, motor 250 can be mounted at a location other than the vertical axis (such mounted on the sides of base 206).

As discussed in conjunction with FIGS. 1A-1K above, power supply 120 (220 in FIG. 2) can be toggled between an on and off position by an operator's foot. When in the on position, vacuum motor 250 is energized. Once energized, blower wheel (not shown) rotates to create an air flow. Motor 250 can include any motor, pump, or other device capable of converting electrical energy into mechanical energy in order to create an air flow either through the pushing (i.e., blowing) or pulling (i.e., suction) of a fluid. Conversely, when power switch is in the off position, motor 250 is turned off and deenergized, thus powering down motor 250. The internal wiring of the vacuum apparatus' 200 power supply (not shown) can be secured to the base 206 and scroll apparatus 252, and routed to power switch 220.

In addition to motor 250, vacuum apparatus 200 can further include filter 226, cage 246, and float 244. Float 244 is described in greater detail below in conjunction with FIGS. 14A-14J. Specifically, in at least one preferred embodiment, the float 244 and shield intake 242 used in conjunction with the other features of FIG. 2, are as shown and described in FIGS. 14I and 14J.

Cage 246 can be formed in several different shapes and sizes, for example cylindrical or tubular, and may be configured to support a filter 226 such as receiving a filter there around. Cage 246 can include one or more openings therein, or in the alternative, it may have an "open" or "slotted" configuration, that may include support members such as ribs disposed in horizontal and/or vertical directions with respect to the cage 246. Filter can include one or filters for vacuums, such as wet/dry vacuums (e.g., High-Efficiency Particulate Air (HEPA) filters or the like).

In addition to the other features of vacuum apparatus 200 as described specifically in conjunction with FIGS. 1A-1K, vacuum apparatus 200 can include cord wrap 242 (additionally, a cord reel may be incorporated into apparatus 200 as well), intake shield 242 (as described in greater detail below in conjunction with FIGS. 15A-15G), scroll apparatus 252 (described in greater detail below in conjunction with FIGS. 9-12 and exhaust port 252 which, as illustrated in FIG. 2, can be disposed on a bottom portion of base 206. In other examples, exhaust port 252 can be disposed along other portions of base 206, such as the front, side, or rear portions.

In addition to the features and advantages of vacuum apparatus 200 as described above, the apparatuses described herein provide a system that permits an operator to quickly and easily remove drum 208 from base 206 and empty it without having to contact filter 226 which, after use, if often full of dust and debris. By mounting the motor 250 within the base 206, there is no longer a need to remove filter 226 from the top portion of the apparatus 200 (such as a powerhead of a traditional wet/dry vacuum), In other words, drum 208 can be easily removed for emptying, in part, because it can retain the debris as well as the filter 226. With this configuration, there is no longer a need to remove filter 226 from the powerhead because filter 226 can be coupled to drum 208 for simpler and improved emptying and disposal of the contents of collector 208.

Finally, by positioning motor 250 below drum 208, the sound created by motor 250 can be greatly attenuated because the motor 250 is insulated from the operator through multiple layers of plastic or other materials for manufacturing the drum 208 and/or base 206. The vacuum becomes even quieter as the drum fills with debris or liquid, as the debris or liquid is collected such that they acts as additional sound insulation.

Figure 3A:
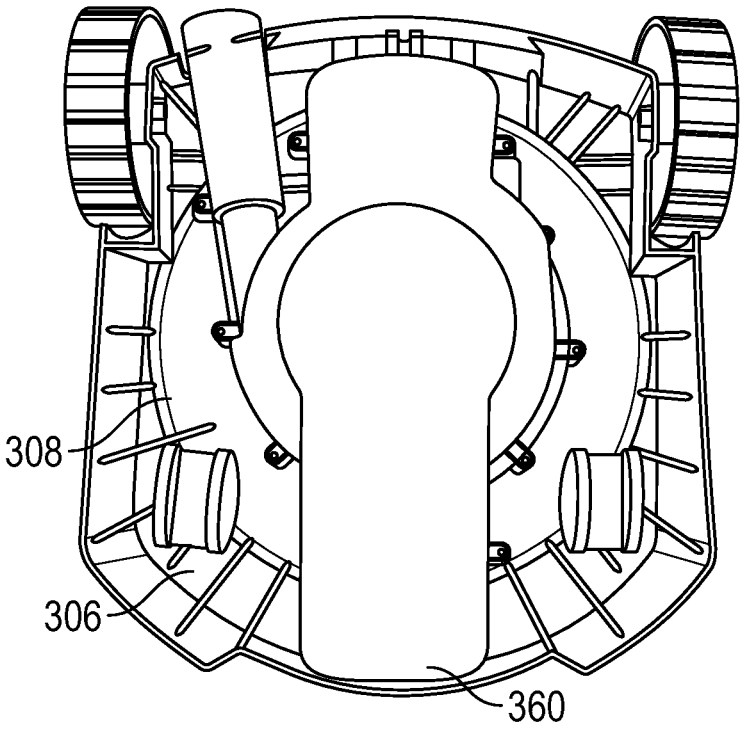
FIG. 3A illustrates a bottom view of the second embodiment of the vacuum apparatus illustrated in FIG. 1E with the skid plate coupled to the base.
Figure 3B:
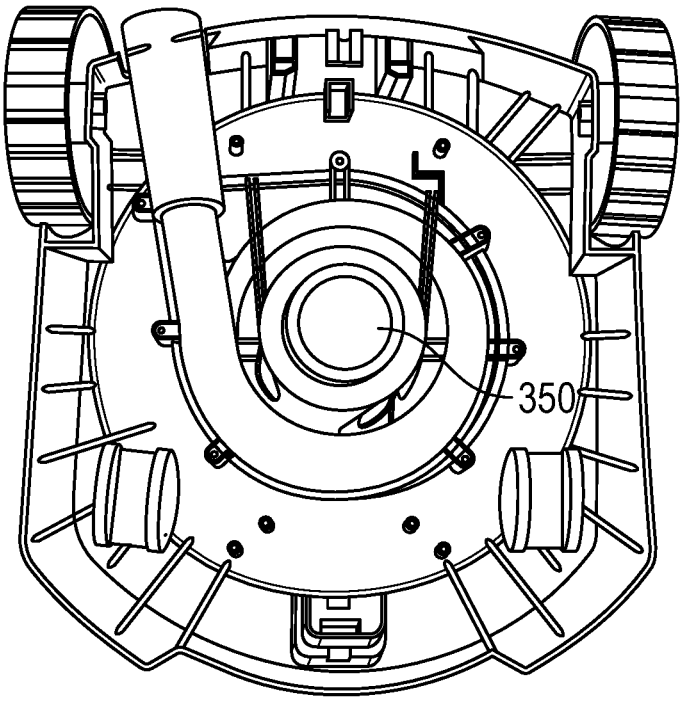
FIG. 3B illustrates a bottom view of the second embodiment of the vacuum apparatus illustrated in FIG. 1E with the skid plate removed from the base.

FIG. 3A illustrates a bottom view of the second embodiment of the vacuum apparatus illustrated in FIG. 1E with the skid plate coupled to the base. FIG. 3B illustrates a bottom view of the second embodiment of the vacuum apparatus illustrated in FIG. 1E with the skid plate removed from the base. These figures will be described in conjunction with one another. In this example (referring specifically to FIG. 3B), motor 350 is illustrated as being centrally-aligned with respect to base 306. Skid plate 360 can be coupled to collector 308 to protect motor 350 and other elements of apparatus 306 from either being damaged and/or contacting dirty or debris. Moreover, skid plate 360 can coupled with screws or other fasteners and act as a vent cover to direct cooling air to motor 350.

Figure 4A:
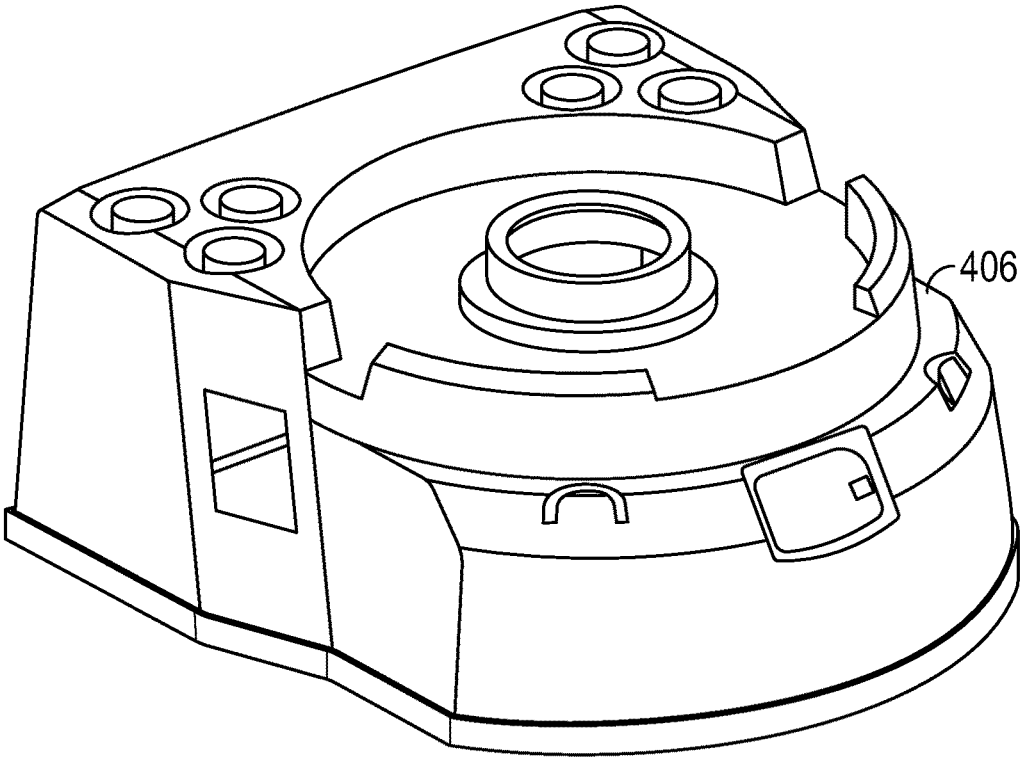
FIG. 4A illustrates an embodiment of a vacuum apparatus base in accordance with certain aspects of the present disclosure.
Figure 4B:
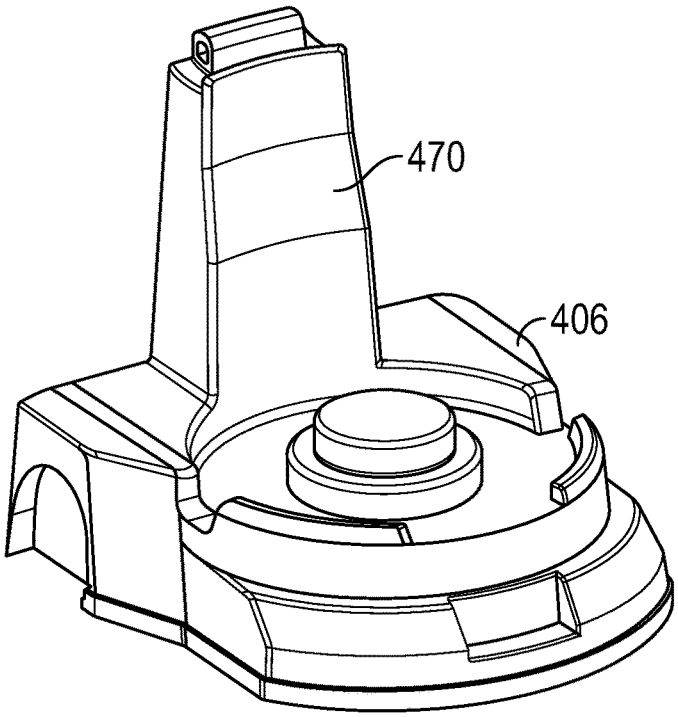
FIG. 4B illustrates another embodiment of a vacuum apparatus base in accordance with certain aspects of the present disclosure.
Figure 4C:
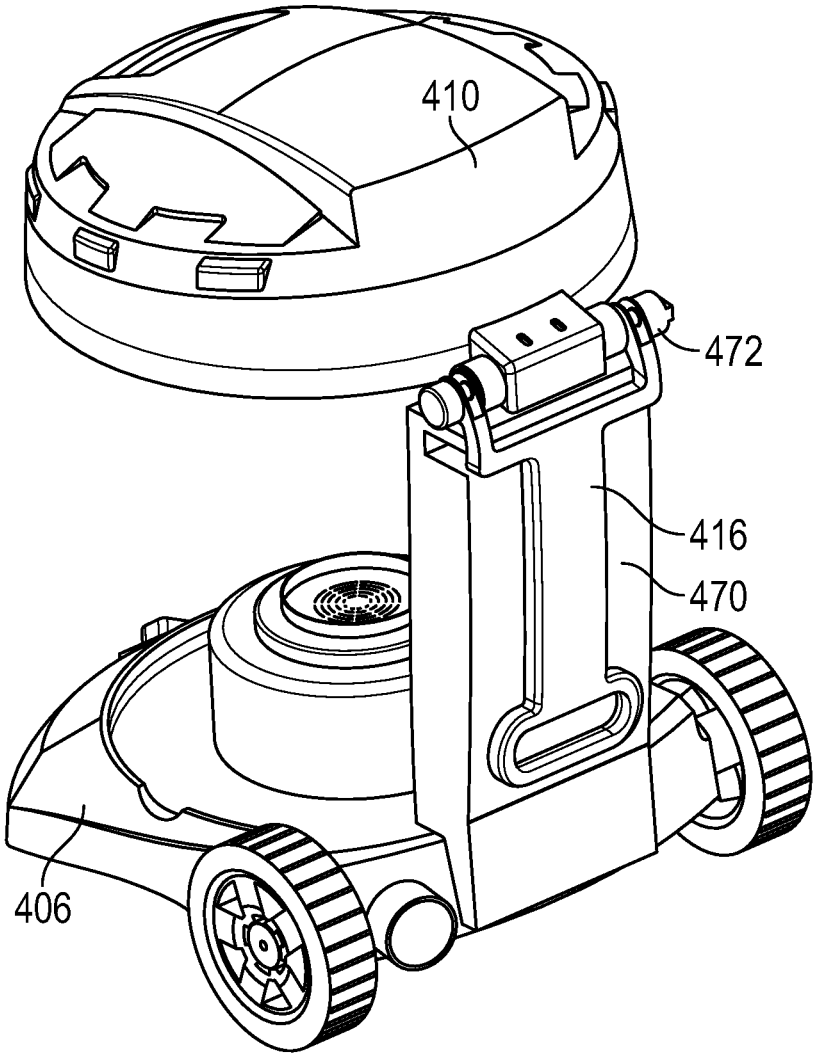
FIG. 4C illustrates a rear isometric view of exemplary elements of the second embodiment of the vacuum apparatus illustrated in FIG. 1E.

FIG. 4A illustrates a first embodiment of a vacuum apparatus base in accordance with certain aspects of the present disclosure. FIG. 4B illustrates a second embodiment of a vacuum apparatus base in accordance with certain aspects of the present disclosure. FIG. 4C illustrates a rear isometric view of exemplary elements of the second embodiment of the vacuum apparatus illustrated in FIG. 1E. These figures will be described in conjunction with one another.

Base 406 can include a spine 470 which permits drum cover 410 to remain coupled to base 406. This configuration offers a more simplistic manner to open cover 410 to gain access to collector 408. Additionally, spine 470 can include a vacuum apparatus handle 416 that permits the vertical (or other) movement of the handle with respect to base 406 through pivot point 472. This handle may be designed as a fixed position handle, or extending or pivotable handle, for improved mobility. Finally, although not depicted in these figures, spine 470 can include a cord wrap as similarly illustrated, for example in FIG. 2).

Figure 5:
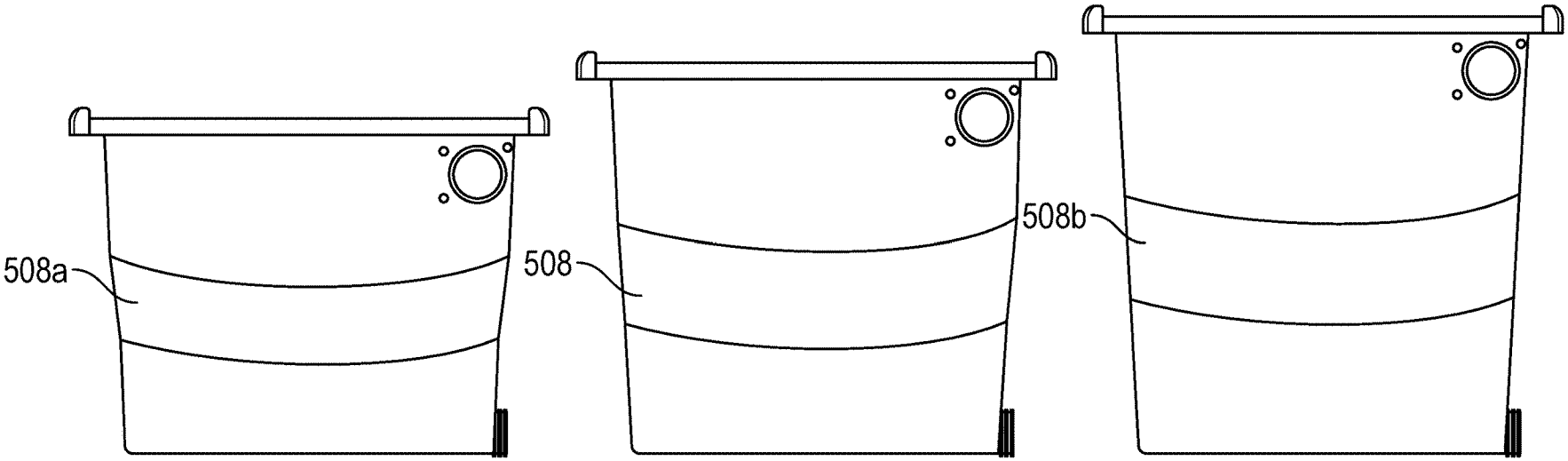
FIG. 5 illustrates various removable and replacement removable drums in accordance with various aspects of the present disclosure.

FIG. 5 illustrates various removable and replacement removable drums in accordance with various aspects of the present disclosure. The vacuum apparatus 500 can further include a removable drum 508 that can include a first maximum storage capacity. In the example, illustrated in FIG. 5 (middle drawing) illustrates the first maximum storage capacity as 14 gallons (although other first maximum capacities are contemplated as well). The removable drum 508 can be adapted to be interchanged with a replacement removable drum (e.g., 508*a*, 508*b*, etc.) having a second maximum storage capacity that is either less than or greater than the first maximum storage capacity. In the examples illustrated in FIG. 5, replacement removable drum 508*a* has a maximum storage capacity of 12 gallons and replacement removable drum 508*b* has a maximum storage capacity of 16 gallons, although other maximum capacities are contemplated as well that can exceed 16 gallons, be smaller than 12 gallons, or anywhere in between.

Base 106 (as illustrated, for example, in FIG. 1C), can provide for these multitude of different capacity drums, for example, by maintaining a constant lower diameter at of each drum (508, 508*a*, 508*b*). Additionally, a common drum cover 110 (as illustrated in FIG. 1C, for example) may be used as well for the different capacity drums 508 as long as upper diameter is the same for all drums 508. In order to accomplish this, the drum 508, 508*a*, and 508*b* can be designed such that the side wall taper/draft of each drum is not constant, and thus the capacity can be varied by increasing and decreasing the height of drum 508. Alternatively, the shapes of drum 508, 508*a*, and 508*b* can be varied such that the bottom diameters, top diameters, and heights are constant among drum 508 and replacement drums 508*a* and 508*b*. Other shapes and sizes of drum 508 (including varying upper and lower diameters) are contemplated as well. This could also be accomplished by utilizing 2 piece drums. The top and bottom diameters could remain the same, and only change the height and mating drum diameter. This would allow for utilizing common drum covers and bases.

FIG. 6A illustrates an exemplary storage area for accessories under the accessory cover of the vacuum apparatus as illustrated in FIG. 1E. FIG. 6B illustrates an exemplary storage area of accessories coupled to the base of the vacuum apparatus as illustrated in FIG. 1E. FIG. 6C illustrates additional storage areas for accessories in accordance with various aspects of the present disclosure. FIG. 6D illustrates an exemplary accessory coupler of the vacuum apparatus as illustrated in FIG. 1C. These figures will be described in conjunction with one another.

FIG. 6A, for example, illustrates another view of accessory cover 632 as illustrated in FIG. 1I. The accessory cover 632, when in the open position (as illustrated in FIG. 6A) allows accessories to be stored within vacuum apparatus 600 and concealed from view (and thus more aesthetically pleasing) when accessory cover 632 is in a closed position (as illustrated, for example, in FIG. 1J). FIGS. 6B and 6C illustrate various other manners in which various accessories 618 can be coupled to base 606 through friction-fit and/or locking fit manners. Finally, FIG. 6D illustrates a more detailed view of accessory coupler 630 (as illustrated in greater detail in FIG. 1D) and as described in greater detail above in conjunction with that figure.

Figure 7B:
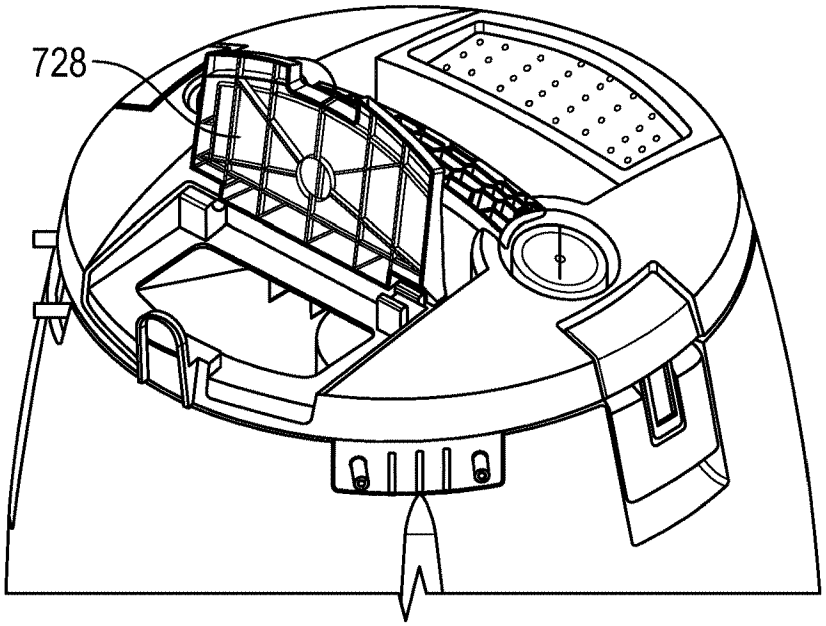
FIG. 7B illustrates the drum of a vacuum apparatus in accordance with the present disclosure with the access cover in an open position.
Figure 7A:
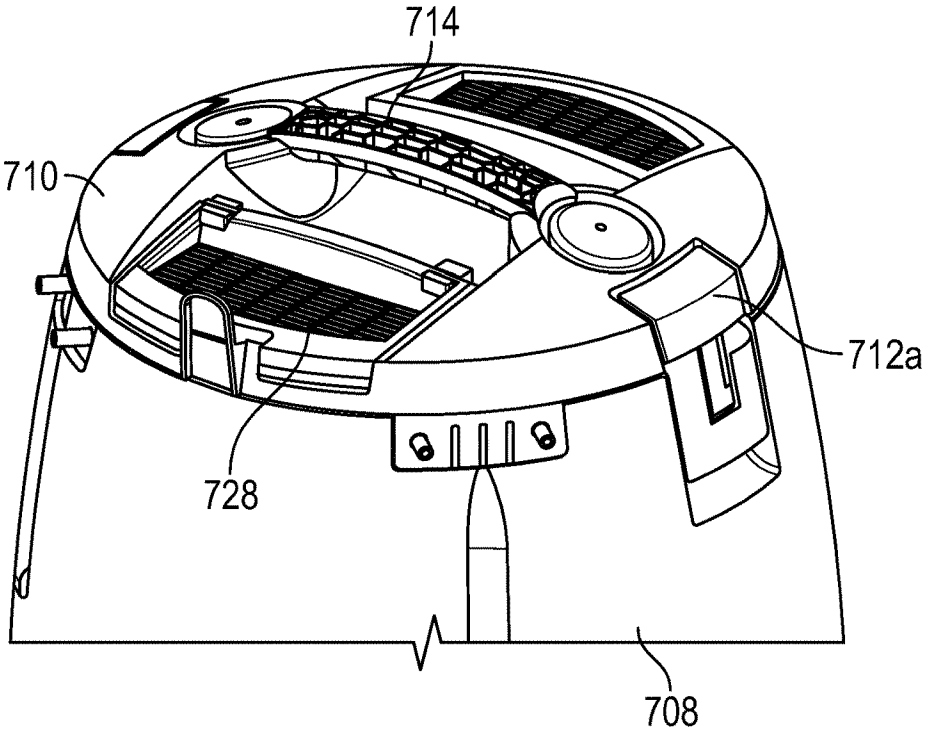
FIG. 7A illustrates the drum of a vacuum apparatus in accordance with the present disclosure with the access cover in a closed position.

FIG. 7A illustrates the drum of a vacuum apparatus in accordance with the present disclosure with the access cover in a closed position. FIG. 7B illustrates the drum of a vacuum apparatus in accordance with the present disclosure with the access cover in an open position. These figures will be described in conjunction with one another.

Drum cover 710 can include access cover 728 for receiving large debris to be stored in drum 708 that would not otherwise fit through an accessory, such as a hose. The drum cover 710 and access cover 728 can each be adapted to engage in an open and a closed position and the drum 708 can be adapted to receive debris through the access cover when the access cover 728 is in an open position and the drum cover 710 is in a closed position. Access cover 728 can coupled to drum cover 710, for example in a pivotable manner, or in the alternative, access cover 728 can be removed entirely and subsequently replaced once an operator has finished disposing of this larger-sized debris.

Figure 8A:
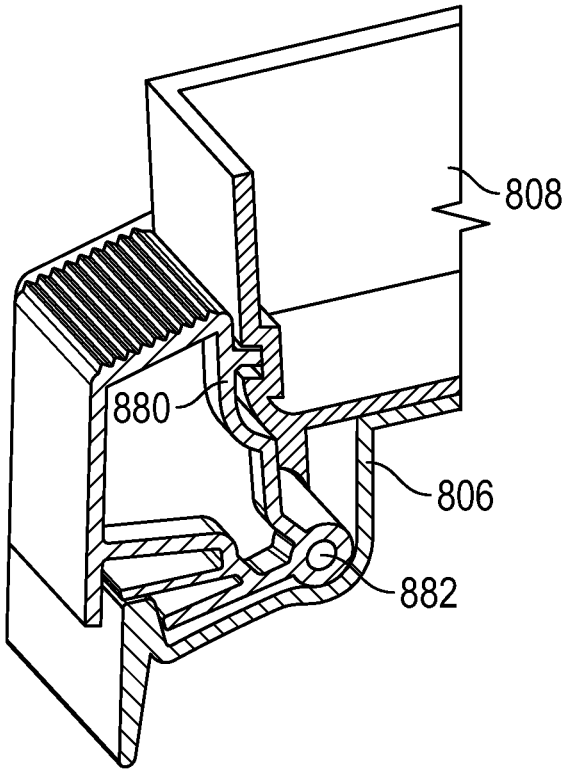
FIG. 8A illustrates the biased actuator in accordance with certain aspects of the present disclosure.
Figure 8B:
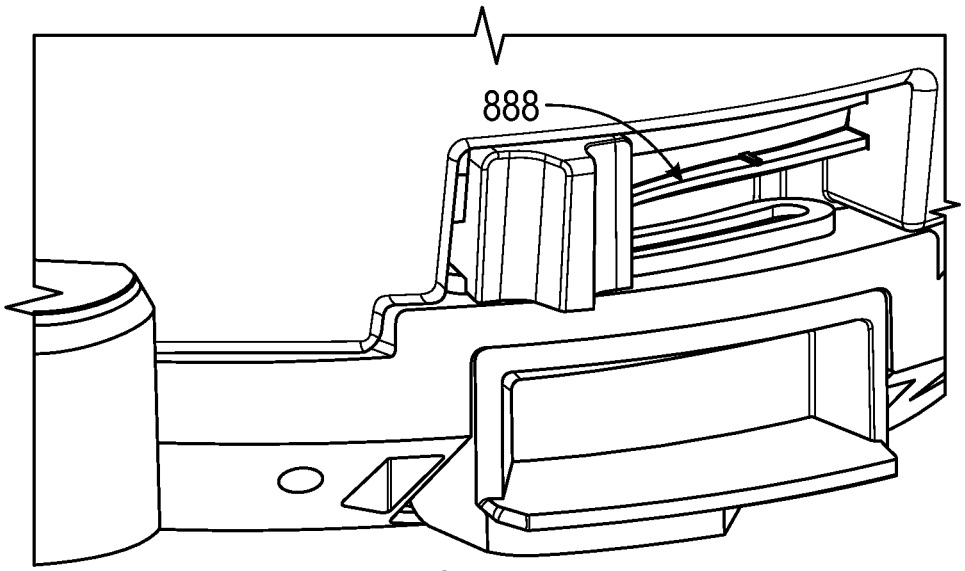
FIG. 8B illustrates a cross-sectional view of a lock mechanism and receiving plate in accordance with certain aspects of the present disclosure.
Figure 8C:
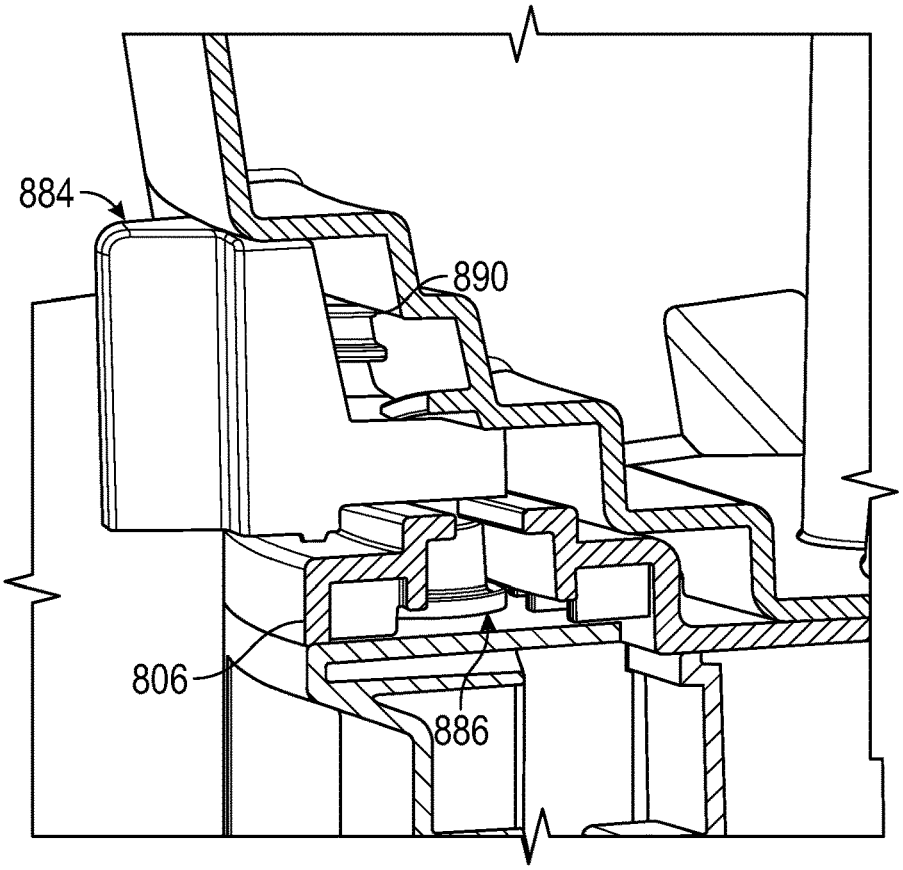
FIG. 8C illustrates a front isometric view of the lock mechanism and receiving plate as illustrated in FIG. 8B.
Figure 8D:
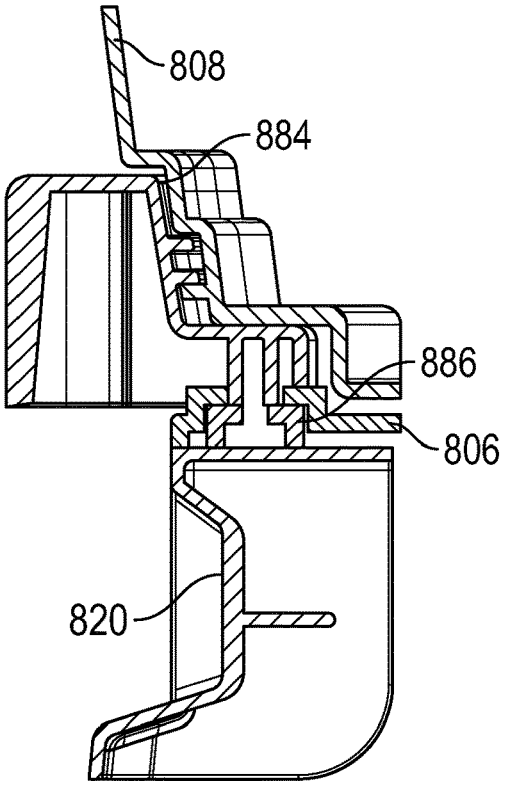
FIG. 8D illustrates a cross-sectional view of an alternate lock mechanism and switch lockout in accordance with certain aspects of the present disclosure.
Figure 8E:
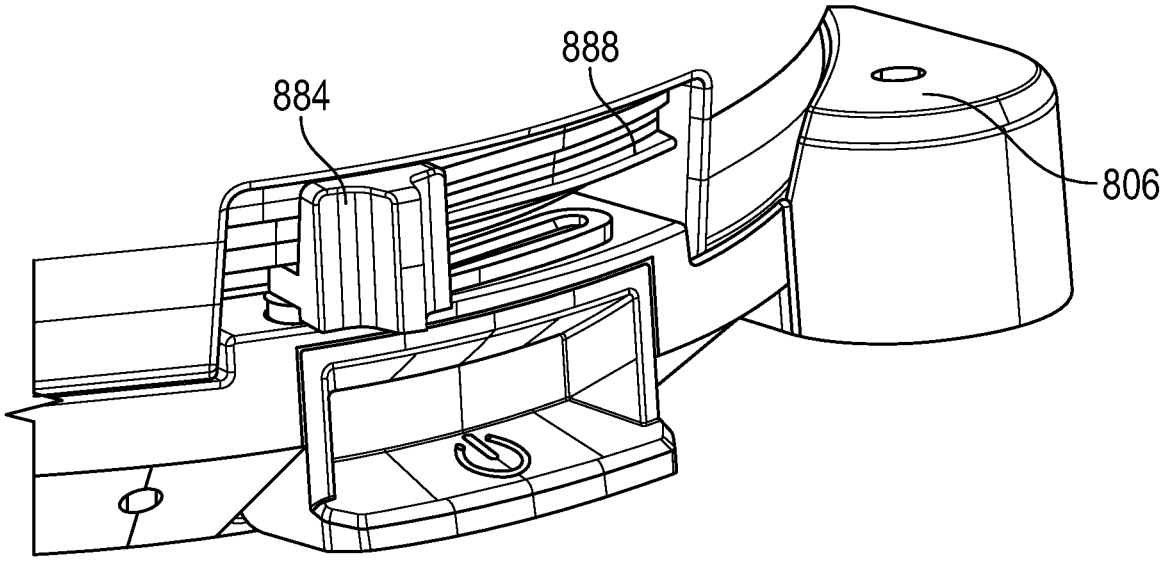
FIG. 8E illustrates a front isometric view of the lock mechanism and switch lockout as illustrated in FIG. 8D.

FIG. 8A illustrates the biased actuator in accordance with certain aspects of the present disclosure. FIG. 8B illustrates a cross-sectional view a lock mechanism and receiving plate in accordance with certain aspects of the present disclosure. FIG. 8C illustrates a front isometric view of the lock mechanism and receiving plate as illustrated in FIG. 8B. FIG. 8D illustrates a cross-sectional view another lock mechanism and receiving plate in accordance with certain aspects of the present disclosure. FIG. 8E illustrates a front isometric view of the lock mechanism and receiving plate as illustrated in FIG. 8D. These figures will be described in conjunction with one another.

Referring specifically to FIG. 8A, an actuator 880 can be used to secure drum 808 to base 806. For example, actuator can be biased with the aid of a biasing device (not shown), such as a spring or the like. As an operator pulls the actuator 880 away from drum 808, the biasing device is expanded and it pivots about actuator joint 882, thus decoupling portions of actuator 880 from drum 808 thereby releasing drum 808. Once released, an operator is free to decouple the drum 808 from base 806. As the actuator 880 is released, the biasing device contracts, pivots about actuator joint 882, and it returns to its original position thereby locking the drum 808 in place.

Referring to FIGS. 8B and 8C, drum lock 884 and receiving plate 886 secure to each other, being separated by a channel in the base. This allows for relative movement of the drum lock assembly to the base. The drum has an extended rib 888 that is ramped upward slightly. This upward traveling rib is used by the extending rib 890 on drum lock. As the drum lock is rotated to the right, the extended tab on drum lock comes in contact with ramped rib on drum and becomes tight. There is a locking bump on the drum ramping rib, which forms a locking detent position for the drum lock in "locked". When the drum lock is in the "unlock" position, there is no matching ramping rib on drum, so that no locking feature exists. Rather than rotating about a vertical axis, as shown, the lock may utilize rotation about a horizontal axis. The lock mechanism shown in FIGS. 8D and 8E are similar but differ as shown.

Other fastening mechanisms are contemplated as well in additional to the sliding mechanism. For example, drum lock 822 can include a switch, lever, or other actuating mechanism with first and second positions such that lock 822 is engaged with plate 886 in the first position and released when in the second position. For example, lock 822 can include a push button release for disengaging the lock 822 from plate 886 to release the drum.

Figure 8F:
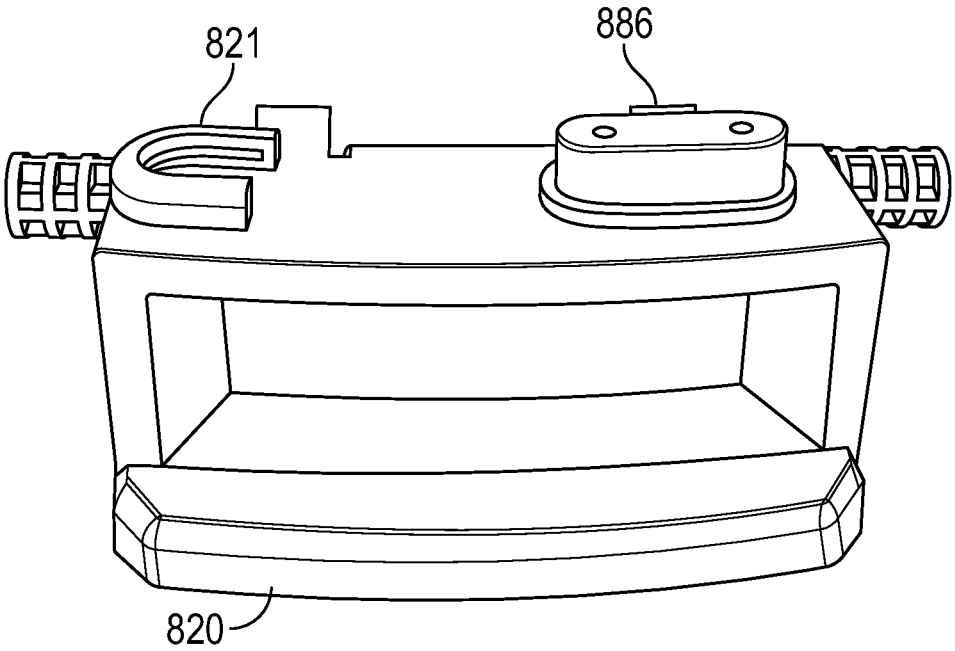
FIGS. 8F-8H illustrate a lock mechanism and switch lockout in various states of assembly, with the switch lockout disengaged.
Figure 8G:
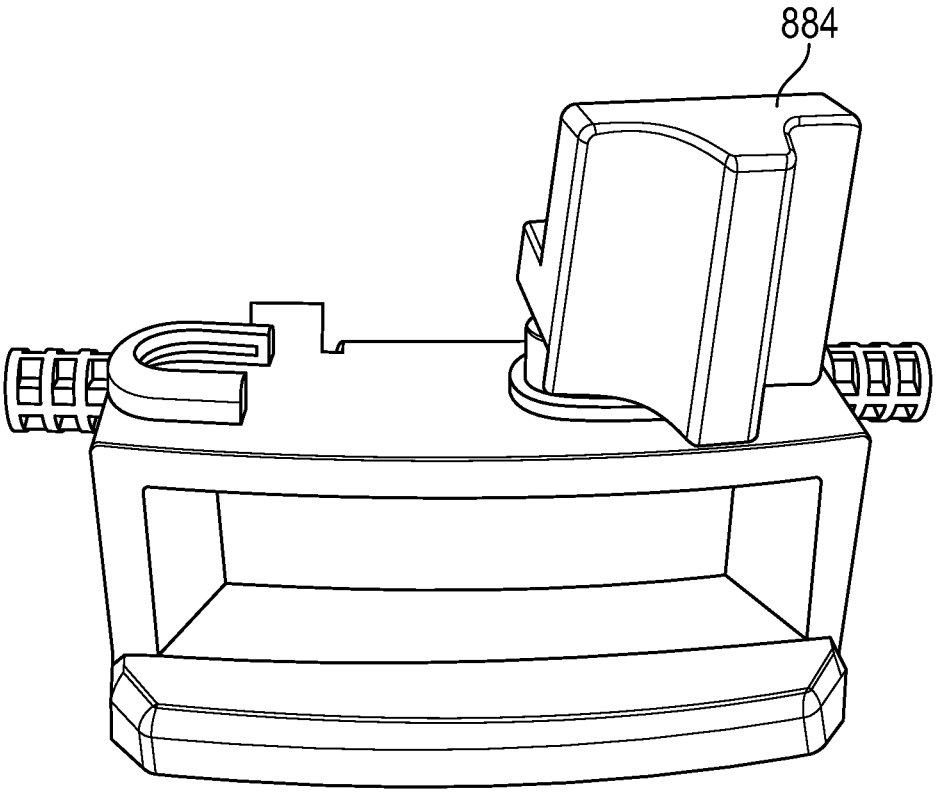
Figure 8H:
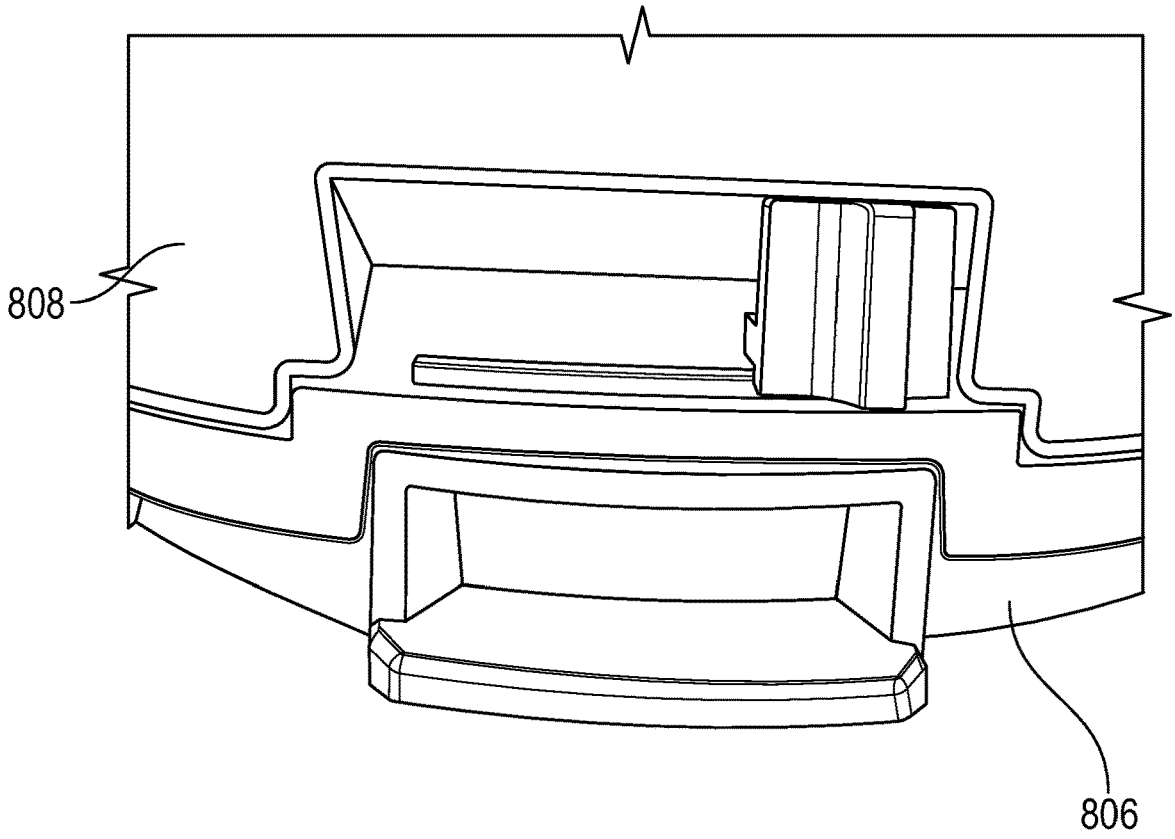
Figure 8I:
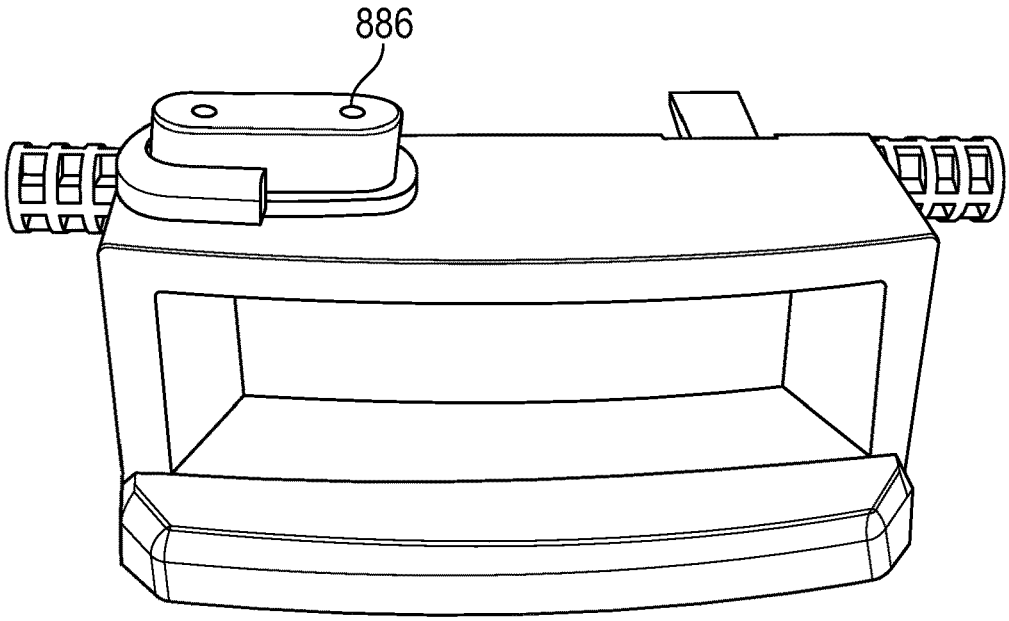
FIGS. 8I-8K illustrate a lock mechanism and switch lockout in various states of assembly, with the switch lockout engaged.
Figure 8J:
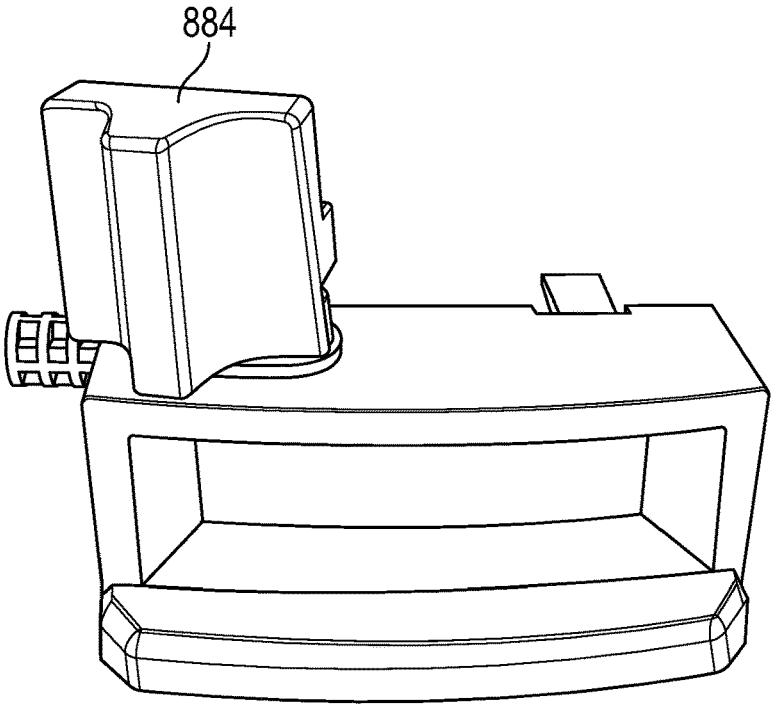
Figure 8K:
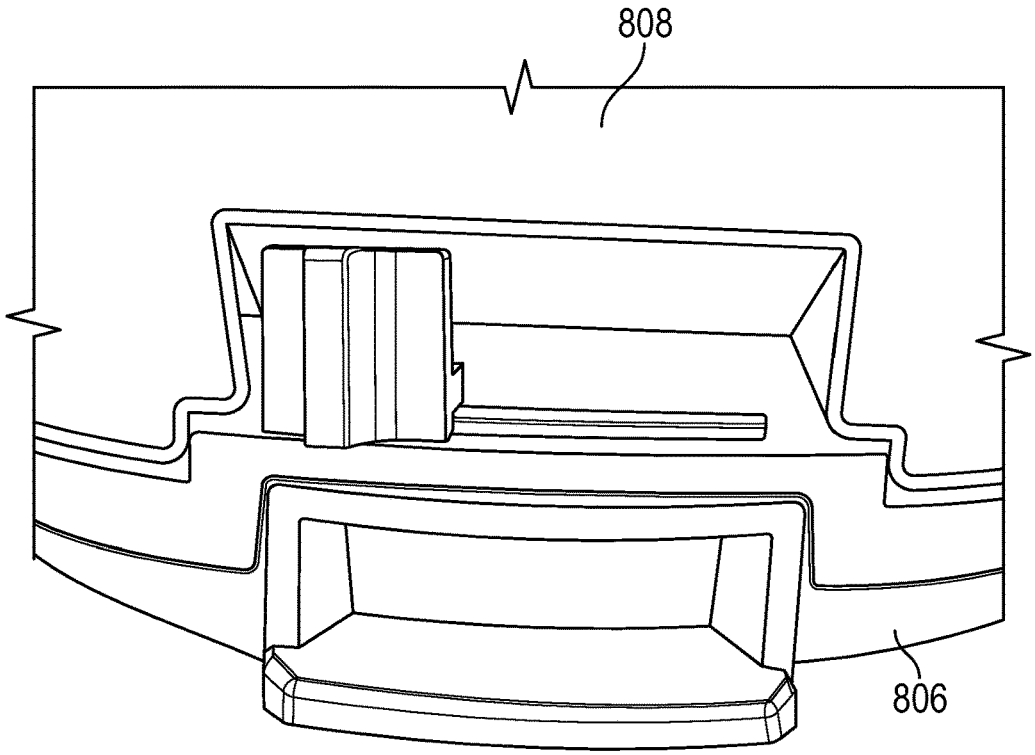
Figure 8L:
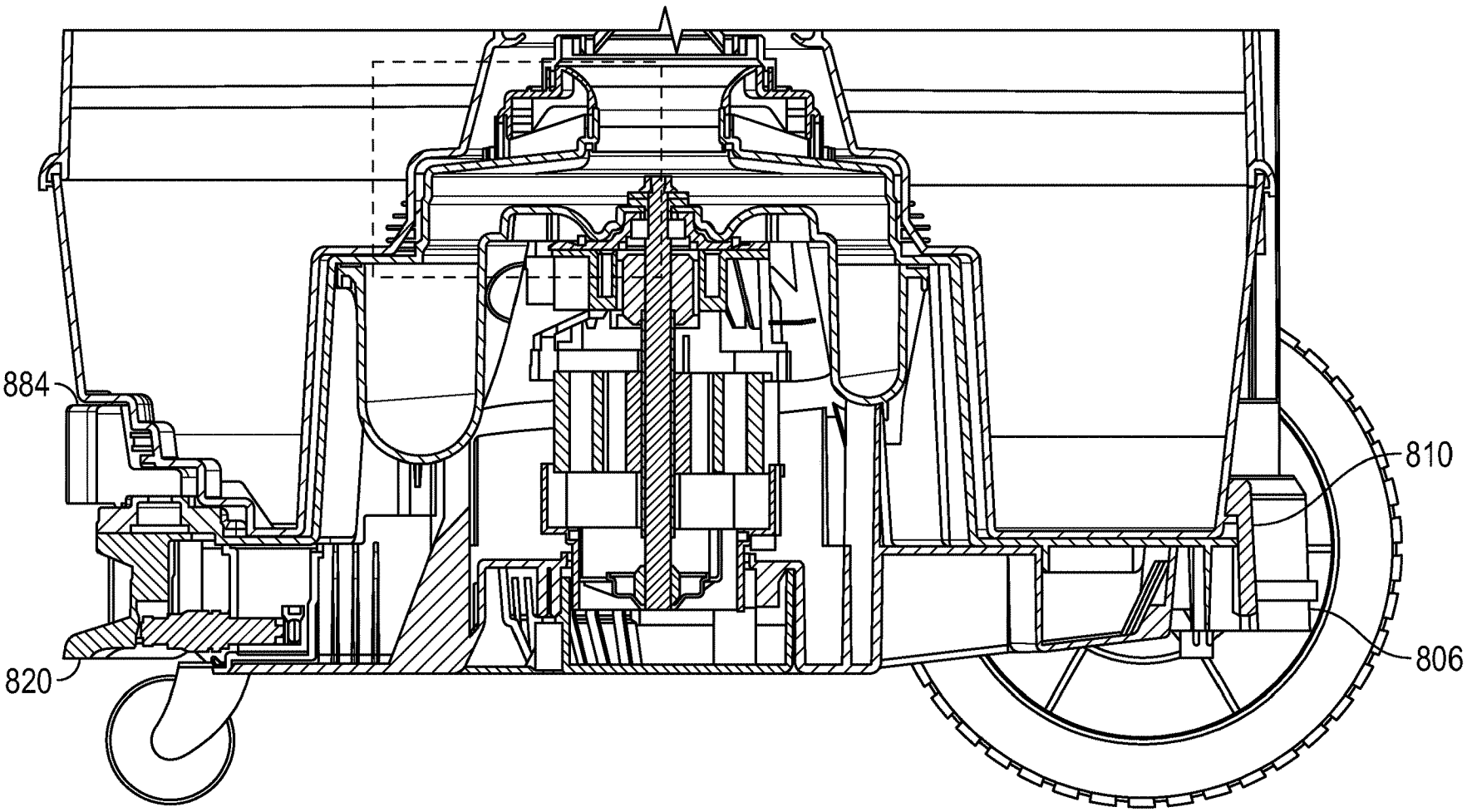
FIG. 8L illustrates a rear drum lock used in conjunction with a lock mechanism such as those shown in FIGS. 8A-8K.

For example, FIG. 8F shows the switch interlock 821 molded as part of the switch actuator 820, and the receiving plate 886 in drum lock position (base and drum not shown for clarity). FIG. 8G shows the drum lock 884 in the drum lock position (base and drum not shown for clarity). FIG. 8H shows the same as FIG. 8G, but base and drum are shown. FIG. 8I shows the receiving plate 886 encapsulated into the switch interlock 821 molded into the switch actuator 820 (base and drum not shown for clarity). FIG. 8J shows the drum lock 884 in the drum un-lock position (base and drum not shown for clarity). With the drum lock 884 in this position, the receiving plate keeps the switch actuator 820 from moving, as the drum lock 884 and receiving plate are connected to base 806. The switch actuator 820 cannot move. FIG. 8K shows the same as FIG. 8J, but the base and drum are shown. FIG. 8L shows a flexible rear drum lock 810 used in conjunction with a lock mechanism such as those shown in FIGS. 8A-8K.

Figure 9C:
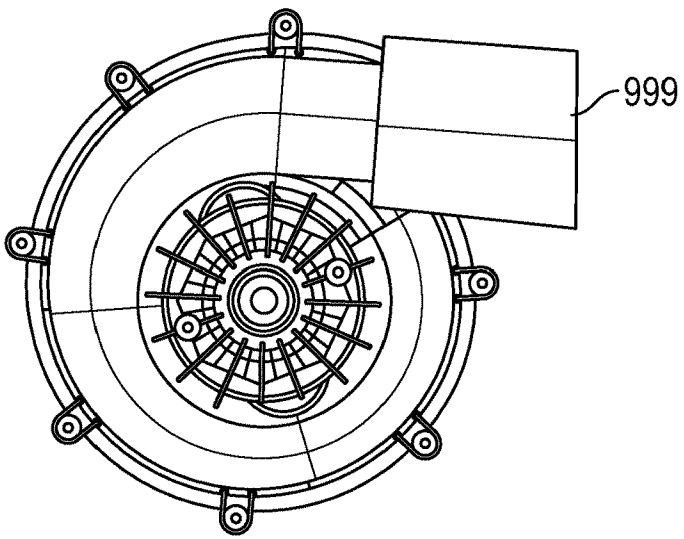
FIG. 9C illustrates a bottom view of the scroll apparatus illustrated in FIG. 9A.
Figure 9B:
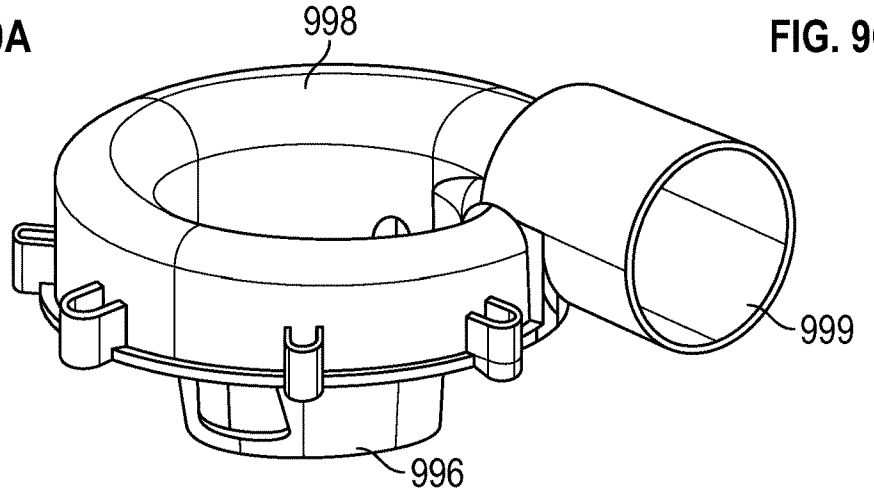
FIG. 9B illustrates an isometric front view of the scroll apparatus illustrated in FIG. 9A.
Figure 9A:
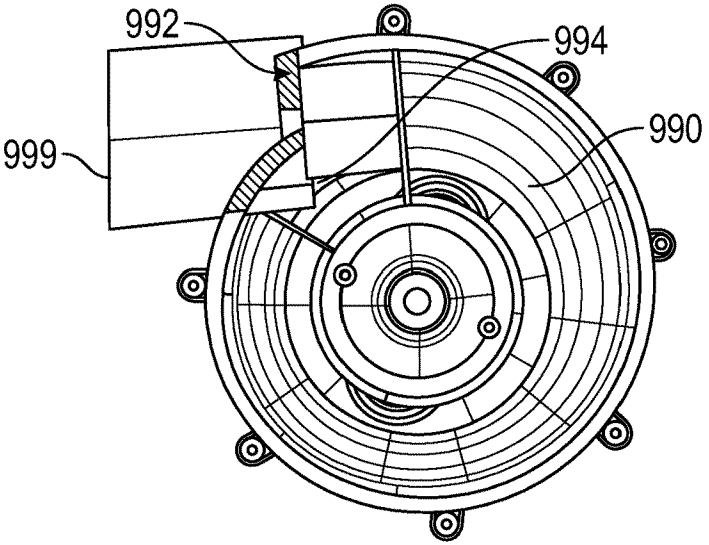
FIG. 9A illustrates a top view of a first embodiment of the scroll apparatus.
Figure 10C:
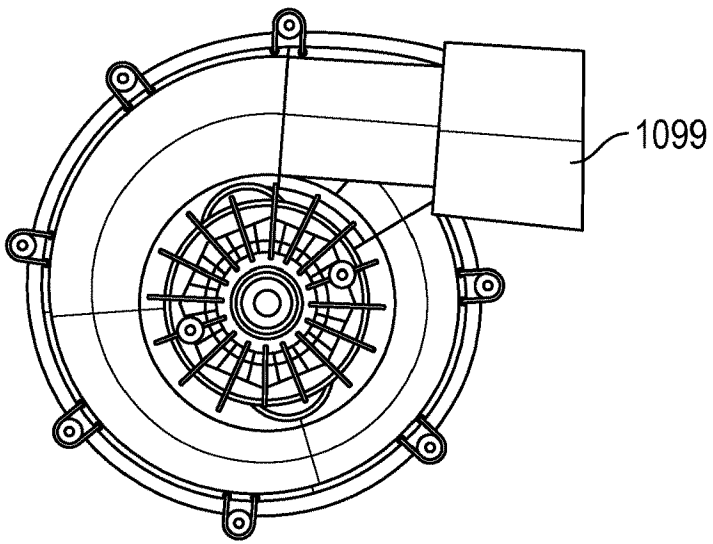
FIG. 10C illustrates a bottom view of the scroll apparatus illustrated in FIG. 10A.
Figure 10B:
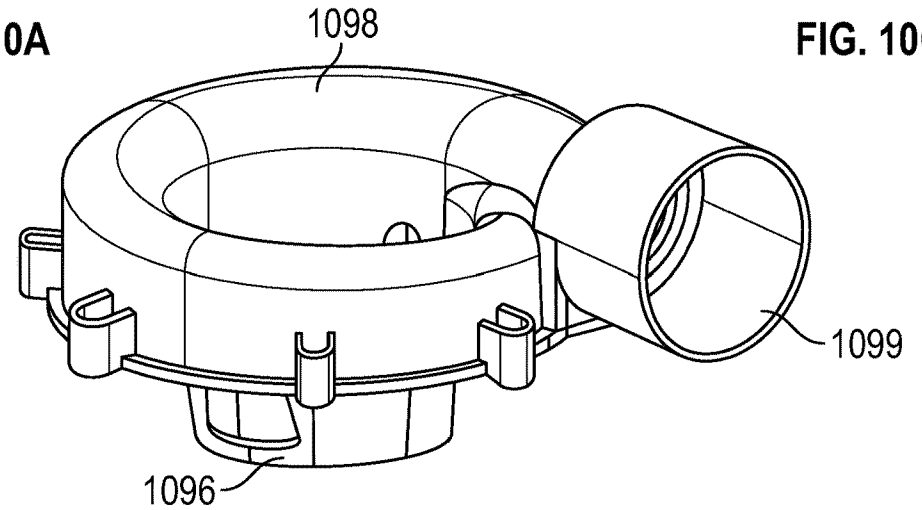
FIG. 10B illustrates an isometric front view of the scroll apparatus illustrated in FIG. 10A.
Figure 10A:
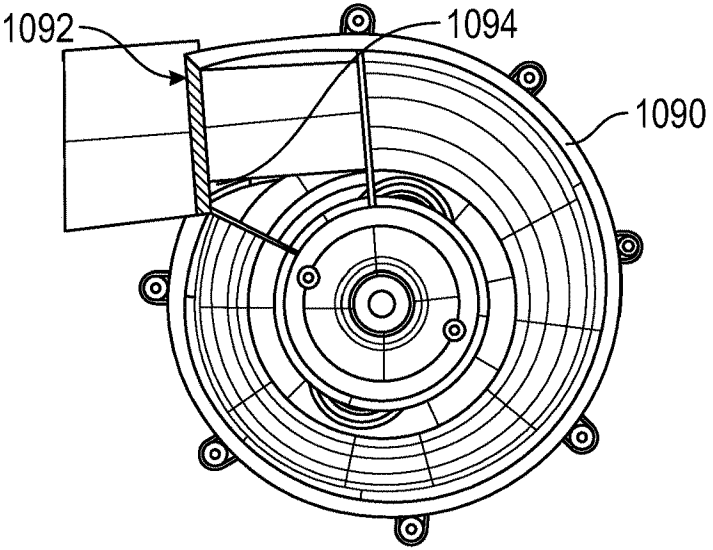
FIG. 10A illustrates a top view of a second embodiment of the scroll apparatus.

FIG. 9A illustrates a top view of a first embodiment of the scroll apparatus. FIG. 9B illustrates an isometric front view of the scroll apparatus illustrated in FIG. 9A. FIG. 9C illustrates a bottom view of the scroll apparatus illustrated in FIG. 9A. FIG. 1 OA illustrates a top view of a second embodiment of the scroll apparatus. FIG. 10B illustrates an isometric front view of the scroll apparatus illustrated in FIG. 10A. FIG. 10C illustrates a bottom view of the scroll apparatus illustrated in FIG. 10A. These figures will be described in conjunction with one another.

Referring specifically to FIGS. 9A-9C, scroll apparatus 990 can include a blower port 992, a pinch point 994, exhaust outlet 996, conduit 998, and blower outlet 999. Scroll apparatus 1090 as illustrated FIGS. 10A-10C can be similar embodied with a few difference as discussed in greater detail below.

Scroll apparatus 900 can be installed in base 206 (as illustrated in FIG. 2) such that exhaust outlet 996 is directed below base 206 and blower port 992 is disposed at an orthogonal angle relative to the exhaust outlet 996. Blower port 996 can be located within a portion of drum 208 (as illustrated in FIG. 2) to direct the flow of exhaust in perpendicular fashion relative to the air flowing from the blower port 999. This can be accomplished by configuring scroll apparatus 900 such that its conduit 998 curls around itself to define pinch point 994. Pinch point 994 can be used to control the final volume and direction of the air exiting blower outlet 999.

For example, pinch point 1094 (as illustrated, for example, in FIG. 10A) is moved to a position to minimize this point as compared with pinch point 994 as illustrated, for example, in FIG. 9A. Notably, scroll apparatus 1090 exhibited an 8% improvement in performance compared to scroll apparatus 990 by moving pinch point 1094 closer to the outer perimeter of conduit 1098.

Figure 11C:
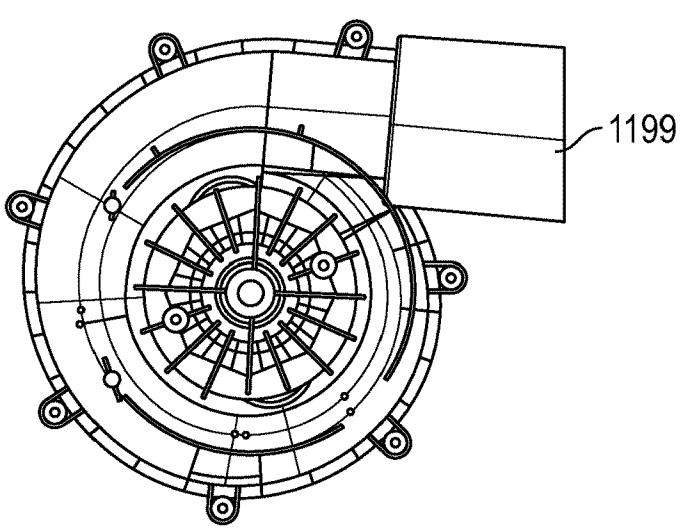
FIG. 11C illustrates a bottom view of the scroll apparatus illustrated in FIG. 11A.
Figure 11B:
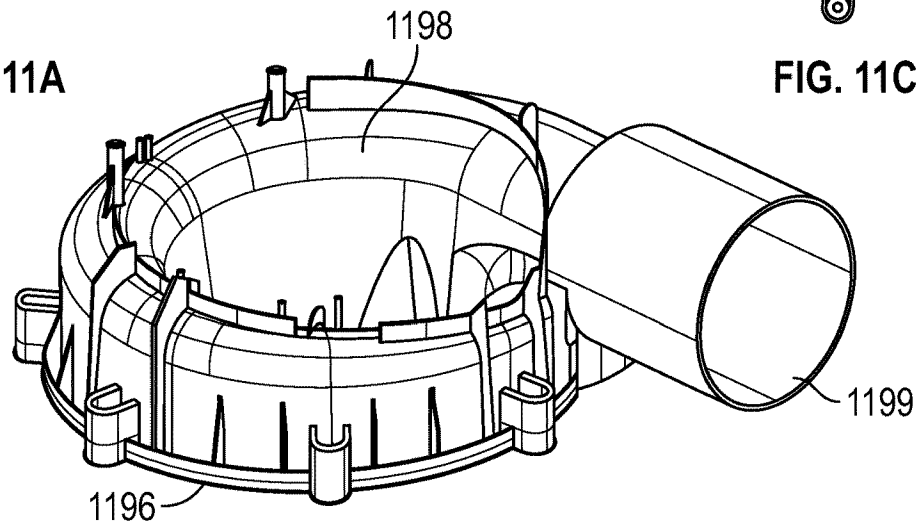
FIG. 11B illustrates an isometric front view of the scroll apparatus illustrated in FIG. 11A.
Figure 11A:
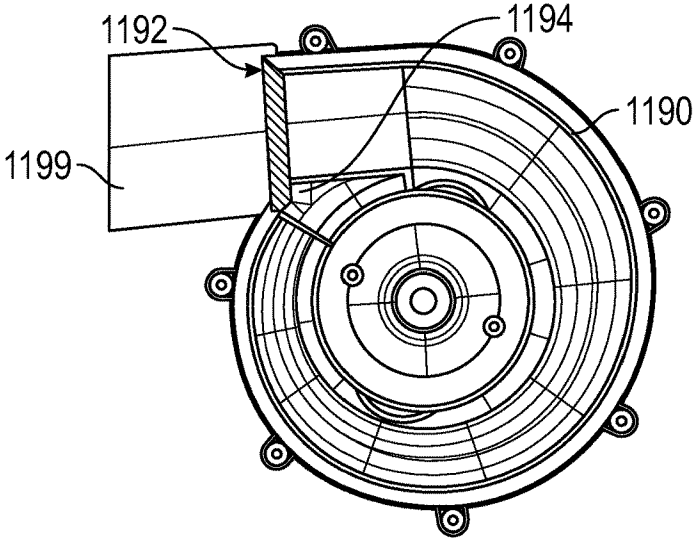
FIG. 11A illustrates a top view of a third embodiment of the scroll apparatus.
Figure 12C:
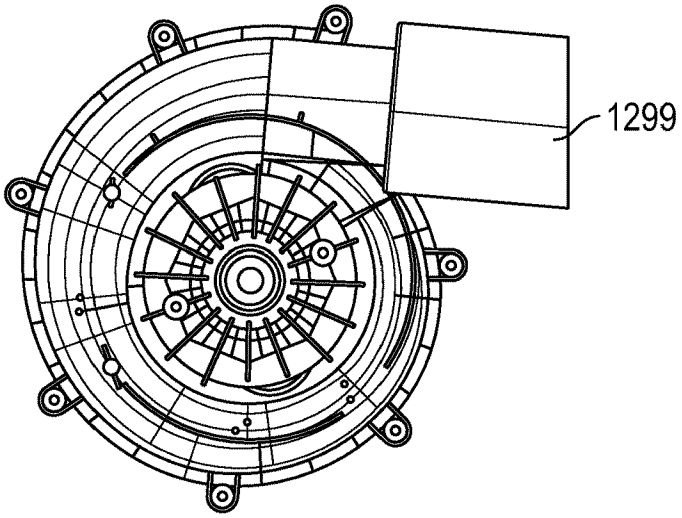
FIG. 12C illustrates a bottom view of the scroll apparatus illustrated in FIG. 12A.
Figure 12B:
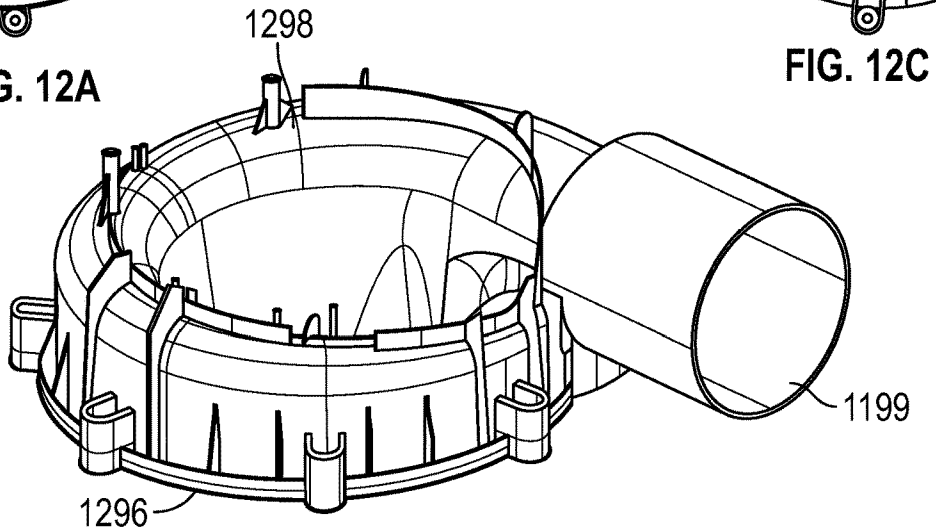
FIG. 12B illustrates an isometric front view of the scroll apparatus illustrated in FIG. 12A.
Figure 12A:
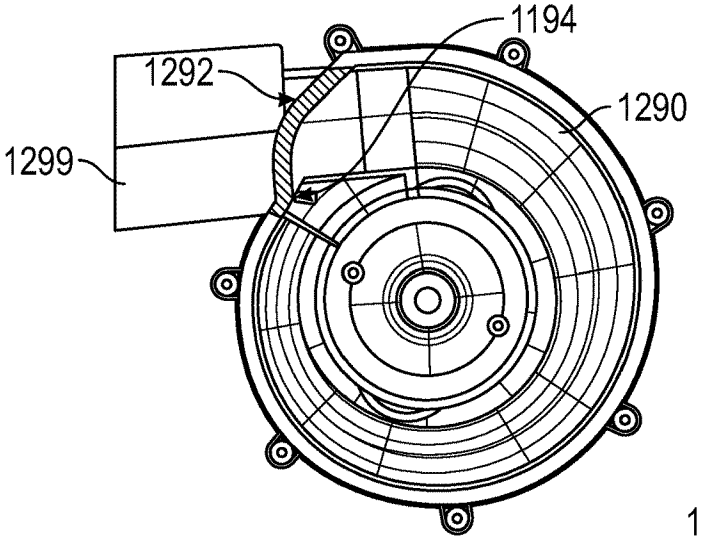
FIG. 12A illustrates a top view of a fourth embodiment of the scroll apparatus.

FIG. 11A illustrates a top view of a third embodiment of the scroll apparatus. FIG. 11B illustrates an isometric front view of the scroll apparatus illustrated in FIG. 11A. FIG. 11C illustrates a bottom view of the scroll apparatus illustrated in FIG. 11A. FIG. 12A illustrates a top view of a fourth embodiment of the scroll apparatus. FIG. 12B illustrates an isometric front view of the scroll apparatus illustrated in FIG. 12A. FIG. 12C illustrates a bottom view of the scroll apparatus illustrated in FIG. 12A. These figures will be described in conjunction with one another.

Referring specifically to FIGS. 11A-11C, scroll apparatus 1190 can include a blower port 1192, a pinch point 1194, exhaust outlet 1196, conduit 1198, and blower outlet 1199. Scroll apparatus 1290 as illustrated FIGS. 12A-12C can be similar embodied with a few difference as discussed in greater detail below.

Another example of pinch point 1194 positioning is illustrated in FIGS. 11A-11C. Still further, scroll apparatus 1290 can be modified to include a small pinch point 1294 and a modified blower outlet 1299 that is radiused or angled such that the terminal end of blower outlet 1299 is disposed at a non-orthogonal angle relative to the direction of the conduit 1298 beyond the pinch point 1294. For example, the outlet port from the scroll may be radiused, such that it has more face area to allow for exhaust to pass through the port, thereby increasing performance. By varying the position of these pinch points (e.g., 1194, 1294) relative to other portions of the scroll apparatuses (e.g., 1190, 1290), varying blowing capacities and efficiencies of motor (not shown) can be achieved.

Figure 13A:
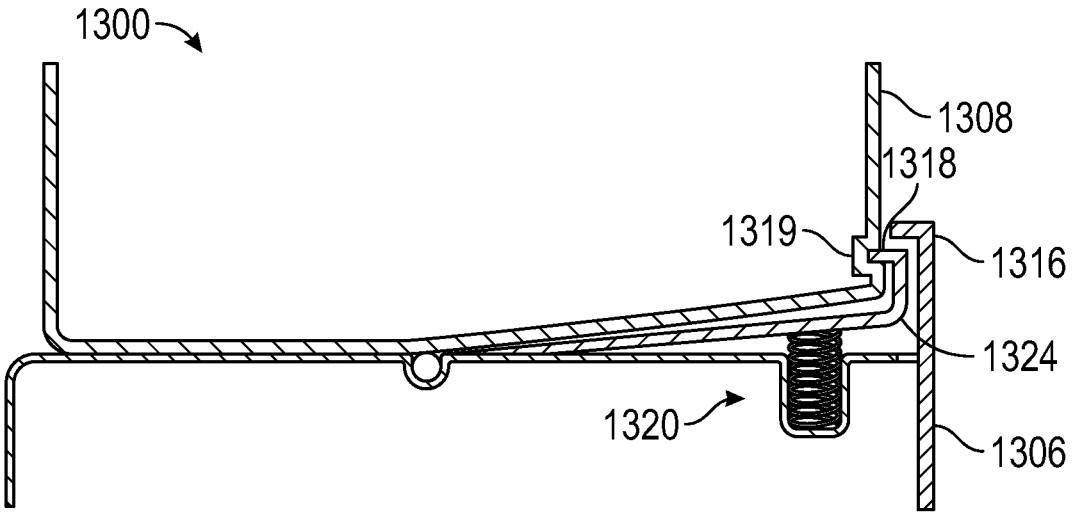
FIG. 13A illustrates a first embodiment of a system for regulating the power supply of a vacuum apparatus.
Figure 13B:
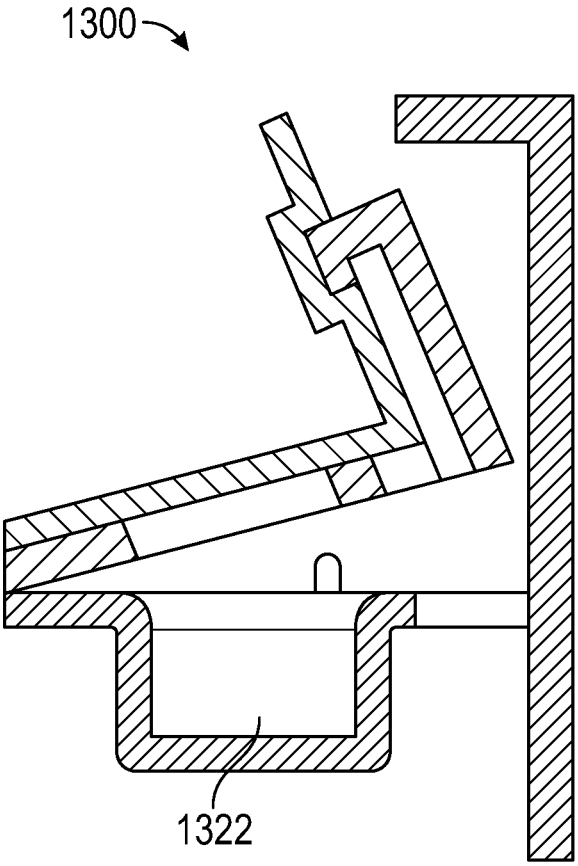
FIG. 13B illustrates a detailed view of the system illustrated in FIG. 13A with the micro switch in the on position.
Figure 13C:
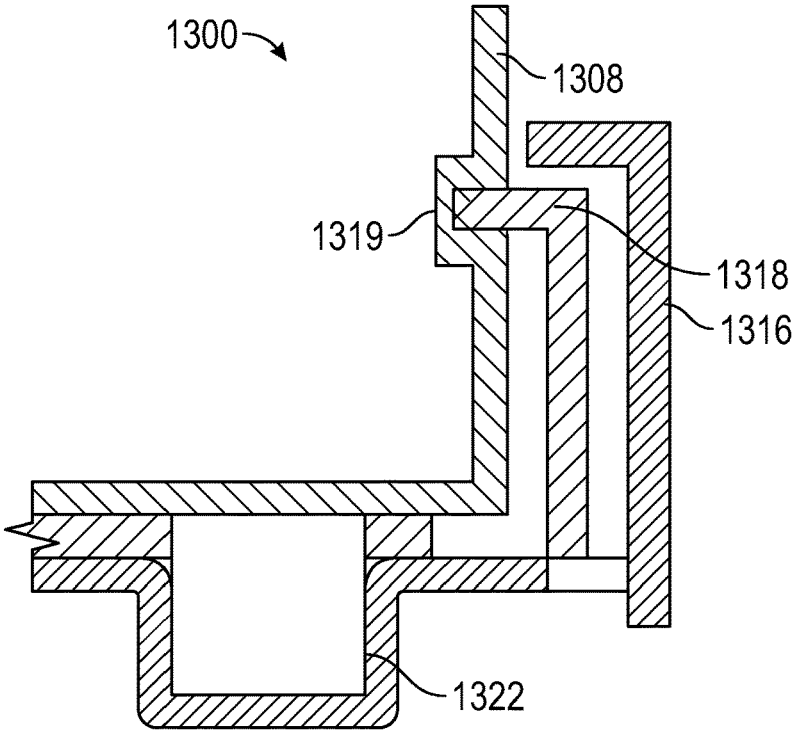
FIG. 13C illustrates a detailed view of the system illustrated in FIG. 13A with the micro switch in the off position.
Figure 13D:
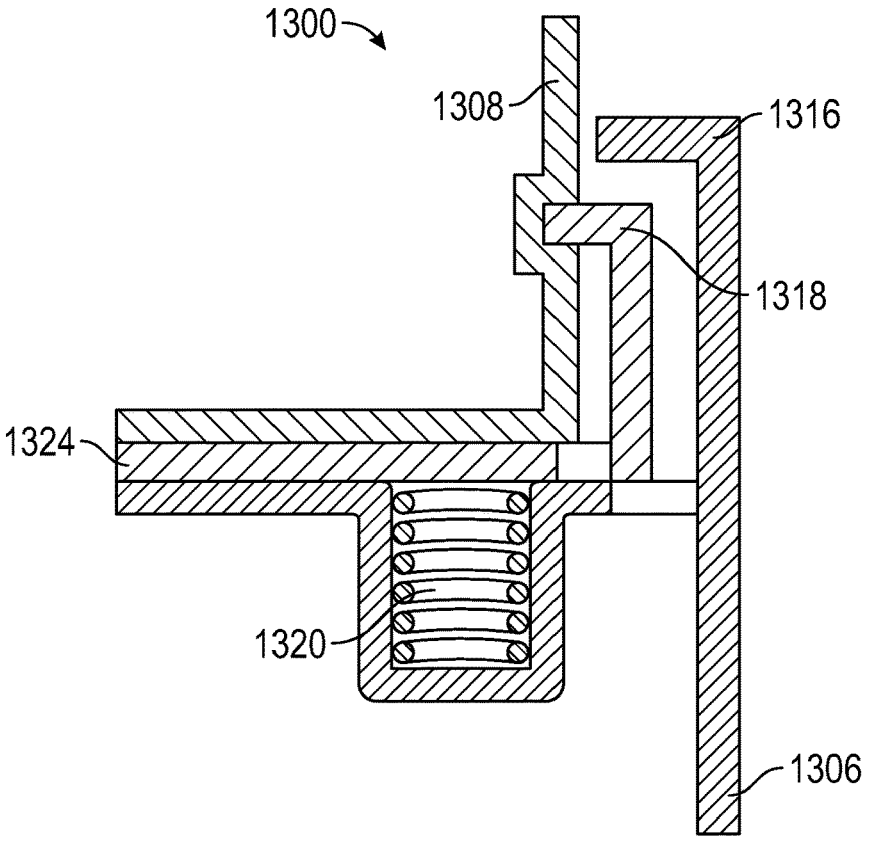
FIG. 13D illustrates optional elements of the system illustrated in FIG. 13A in accordance with certain aspects of the present disclosure.
Figure 13E:
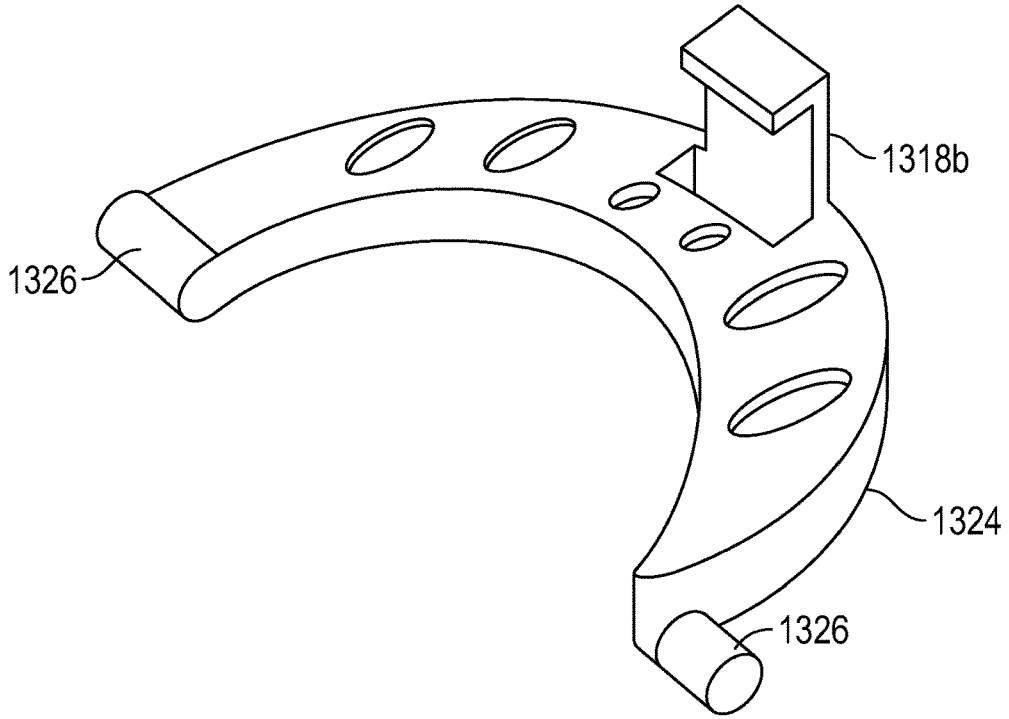
FIG. 13E is a detailed view of the pivot mechanism illustrated in FIG. 13D in accordance with certain aspects of the present disclosure.

FIG. 13A illustrates a first embodiment of a system for regulating the power supply of a vacuum apparatus. FIG. 13B illustrates a detailed view of the system illustrated in FIG. 13A with the micro switch in the on position. FIG. 13C illustrates a detailed view of the system illustrated in FIG. 13A with the micro switch in the off position. FIG. 13D illustrates optional elements of the system illustrated in FIG. 13A in accordance with certain aspects of the present disclosure. FIG. 13E is a detailed view of the pivot mechanism illustrated in FIG. 13D in accordance with certain aspects of the present disclosure. These figures will be described in conjunction with one another.

System 1300 can include a base 1306 and drum 1308 with a biasing device 1320 interposed between the two that can include a spring or the like for providing a resisting force to weight of the drum 1308 as applied against base 1306. Base 1306 and drum 1308 can include the examples and embodiments described in greater detail above in conjunction with FIGS. 1-12 (e.g., base 106 and drum 108, respectively) and, thus in the interest of clarity and brevity, will not be described in additional detail in conjunction with these figures. Base 1306 can include base lock mechanism 1316 for securing pivot mechanism 1324, both of which are described in greater detail below with specific reference to FIGS. 13D and 13E.

Referring specifically to FIG. 13A, drum 1308 can be coupled to base 1306 with the aid of drum lock mechanism 1318 that can include a tab, lip, or other protrusion that can be adapted to be received by recess 1319. For example, drum lock mechanism 1318 can include a locking tab that inserts into at least a portion of recess 1319, such as a channel or other cavity coupled to, or formed integrally with, drum 1308. In this example, as drum lock mechanism 1318 is inserted into or coupled with recess 1319, drum 1308 can be locked in place to minimize its horizontal movement relative to the base 1308. Additionally, when coupled in this manner, as drum 1308 moves vertically relative to base 1306, pivot mechanism 1324 moves toward micro switch 1322.

For example, referring specifically to FIG. 13B, as weight of drum 1308 increases (such as, for example, as it is filled with liquid, debris, or other media), the force drum 1308 as applied against biasing device 1320 increases. In an example of a spring, biasing device 1308 can including a spring constant k that is sufficient to resist the weight of the drum 1308 when it is empty so as to prevent drum 1308 from contacting micro switch 1322 (e.g., FIG. 13B). In other words, biasing device 1320 can designed to collapse or deform after a given amount force is applied to it.

In this manner, the weight of drum 1308 can be approximated as a function of a given volume of liquid or other debris stored in the drum 1308 at any given point in time such that the biasing device 1320 will collapse when a particular volume of drum 1308 is achieved. As described in greater detail below, once the resisting force of biasing device 1320 is overcome, a micro switch 1322 is triggered, thus disabling the vacuum apparatus 100 (e.g., FIG. 1A).

As the drum 1308 fills and the weight increases, the weight of the drum 1308 will begin to counter and eventually overcome the resisting force provided by biasing device 1320. Once the weight of drum 1308 fully overcomes the resisting force of biasing device 1320, drum 1308 will contact micro switch 1322 and toggle the micro switch into the off position as illustrated, for example, in FIG. 13C.

Finally, once the drum 1308 is emptied, the weight of drum 1308 will no longer be able to overcome the resisting force of biasing devices 1320 and thus, the micro switch 1322 will return to its on position as illustrated for example in FIG. 13B. In one example, micro switch 1322 can include a snap-action switch, so that an electrical circuit within micro switch 1322 can be disabled as the micro switch 1322 is triggered (thus deenergizing motor 250 (as illustrated, for example, in FIG. 2)) although other examples of electrical switches are contemplated as well.

Referring specifically to FIGS. 13D and 13E, pivot mechanism 1324 can include on or more pivot tabs 1326. Pivot mechanism 1324 can include any plate or other structure to assist with the foregoing triggering of micro switch 1322. For example, pivot mechanism 1324 can be disposed between drum 1308 and base 1306 and biasing device 1320 so that as drum 1308 is forced toward base 1306, the one or more pivot tabs 1326 allow pivot mechanism 1324 to pivot about them to assist with the movement of the drum 1308 relative to the base 1306. Additionally, pivot mechanism 1324 can include base lock mechanism 1318 (such as a tab, lip, protrusion, or the like) for further securing drum 1308 to pivot mechanism 1324 so that drum and pivot mechanism 1324 move as a single unit as drum 1308 is filled with liquid, debris, or other media.

Figure 14A:
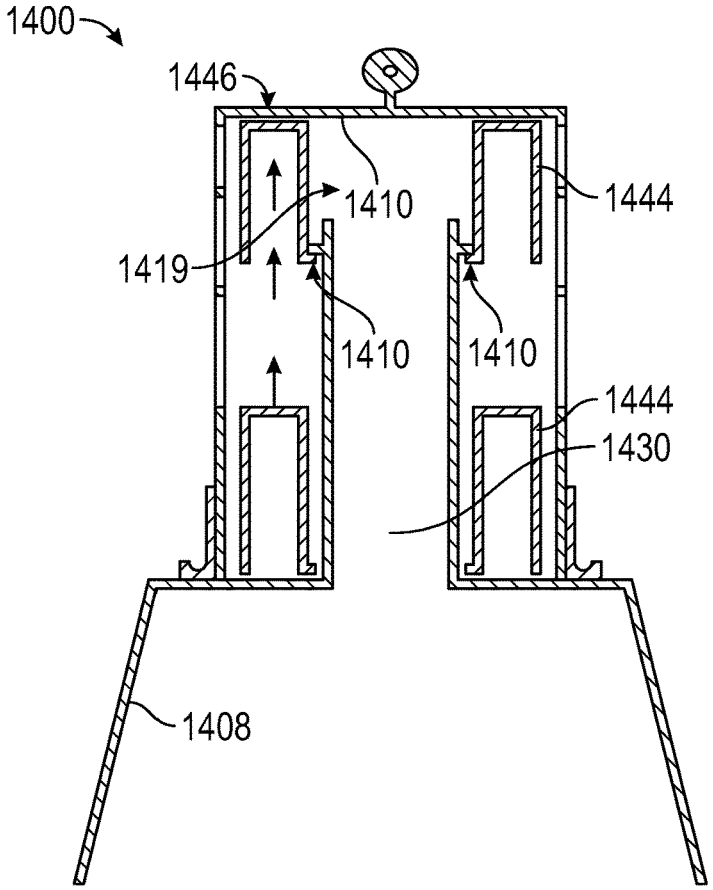
FIG. 14A illustrates a cross sectional view of a first embodiment of a system for restricting the airflow to air inlet conduit.

FIG. 14A illustrates a second embodiment of a system for restricting the vacuum airflow to the air inlet conduit. System 1400 can include a drum 1408, seal 1410, air inlet conduit 1430, and float 1444. Drum 1408 and cage 1446 can include the examples and embodiments described in greater detail above in conjunction with FIGS. 1-12 (e.g., drum 208 and cage 246, respectively) and, thus in the interest of clarity and brevity, will not be described in additional detail in conjunction with these figures.

In one example, float 1444 can include a wet/dry vacuum float mechanism disposed around a portion or the entire air inlet 1430. For example, float 1444 can be a donut- or annulus-shaped float that is disposed around the entire perimeter of air inlet conduit 1430, although additional shapes and sizes of float 1444 are contemplated as well. When the drum 1408 is empty, float 1444 will remain at the bottom portion of air inlet 1430. As the liquid level rises in drum 1408, float (being more buoyant than water), will rise with the water level until it reaches the top portion of air inlet conduit 1430.

The inner portion of air inlet conduit 1430 and inner portion of cage 1446 can include seal 1410, for example, a gasket, or other water and/or air tight sealing structure or the like. As float 1444 rises to the top portion of air inlet 1430, float 1444 rises over and fully covers the opening in air inlet 1419 and it engages with seal 1410 in an airtight, watertight fashion. Once sealed, the airflow through air inlet 1419 is closed, eliminating the airflow path to the blower wheel, thus eliminating suction inside the drum. Once drum 1408 is emptied, float 1444 will return to the lower position with respect to air inlet conduit 1430, thus opening air inlet 1419 and permitting vacuum inside the drum.

Figure 14B:
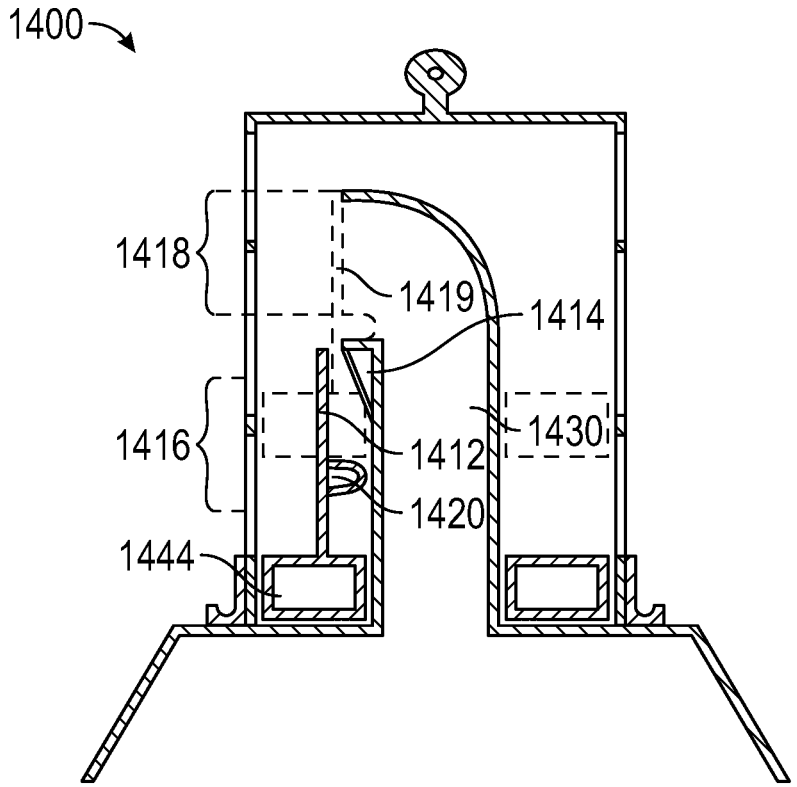
FIG. 14B illustrates a cross sectional view of a second embodiment of a system for restricting the airflow to air inlet conduit.
Figure 14C:
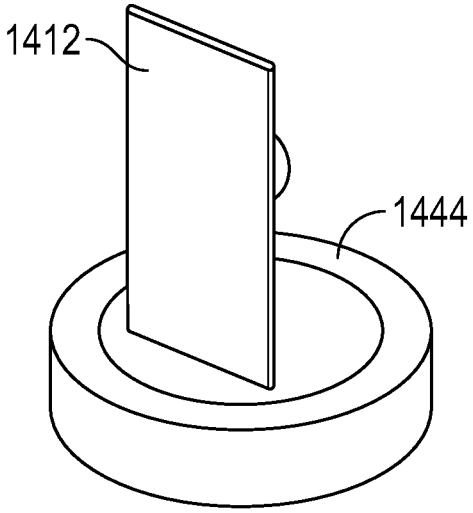
FIG. 14C illustrates a detailed view of selected elements of the system illustrated in FIG. 14B.
Figure 14D:
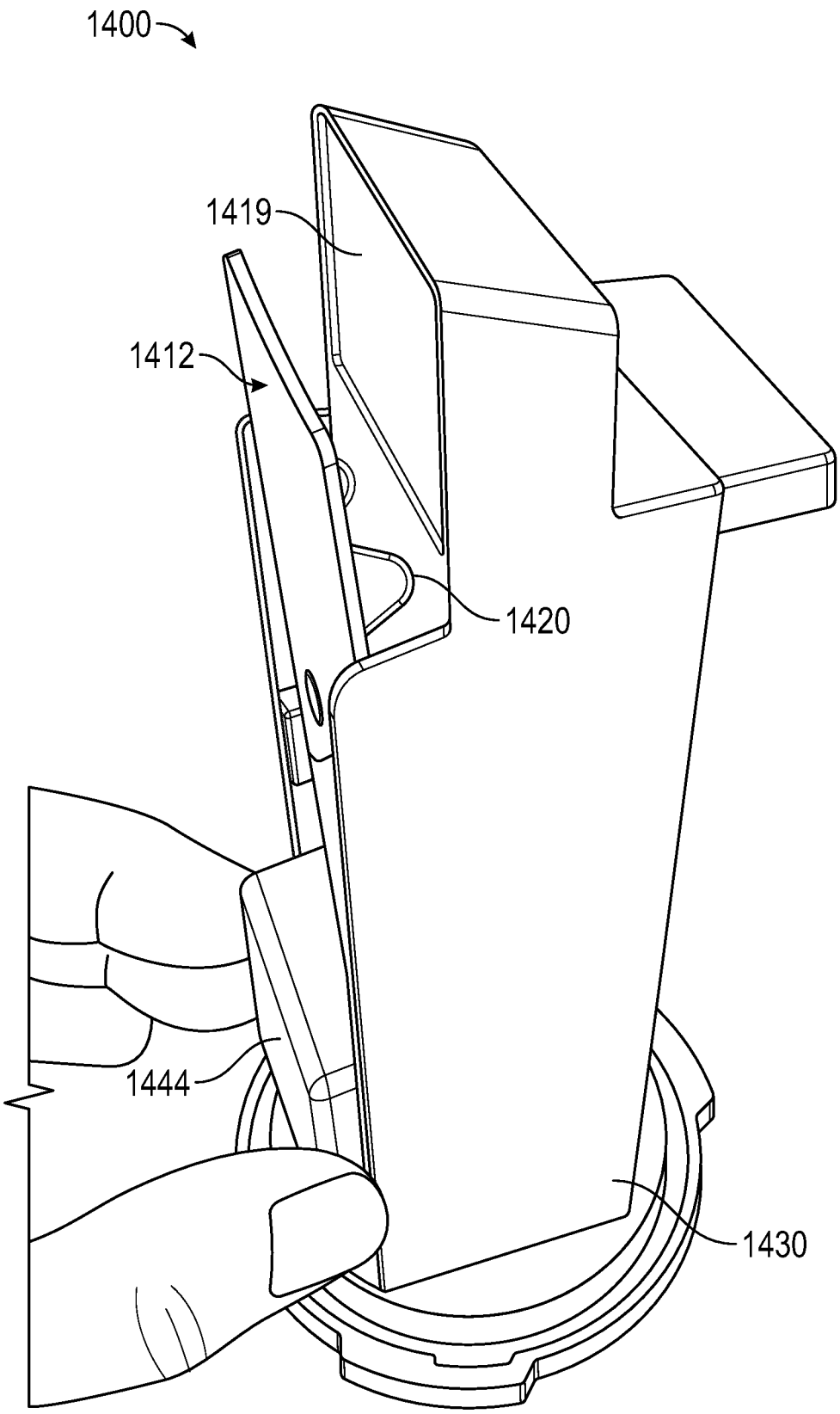
FIG. 14D illustrates a third embodiment of a system for restricting the airflow to air inlet conduit.

FIG. 14B illustrates a third embodiment of a system for restricting the vacuum airflow to the air inlet conduit. FIG. 14C illustrates a detailed view of selected elements of the system illustrated in FIG. 14B. FIG. 14D illustrates a fourth embodiment of a system for regulating the power supply of a vacuum apparatus. These figures will be described in conjunction with one another.

With specific reference to FIG. 14B, float 1444 can be similarly embodied as described in conjunction with FIG. 14A with the addition of baffle 1412. In this embodiment, baffle 1412 can include one or more tabs 1420 that are adapted to engage with ramp 1414 as float 1444 rises along air inlet conduit 1430. FIG. 14C illustrates a detailed view of an example of float 1444 that can be employed by this embodiment.

Specifically returning to FIG. 14B, with the drum 1408 empty, air inlet 1419 remains in an open position 1416. As the liquid level rises in drum 1408, tab 1420 of baffle 1412 rises along an outer edge of air inlet conduit 1430. As tab 1420 contacts ramp 1414, baffle 1412 is forced outwardly and away from air inlet conduit 1430. Once tab 1420 overcomes the top portion of ramp 1414 (such as, for example, when the liquid in drum 1408 rises to a certain level), baffle 1412 is forced back toward air inlet conduit 1430 in closed position 1418. As baffle 1412 returns, it covers the entire portion air inlet 1419, thus sealing baffle 1412 to air inlet 1419. As similarly described in conjunction with FIG. 14A above, once sealed, the airflow through air inlet 1419 is closed, eliminating the airflow path to the blower wheel, thus eliminating suction inside the drum. Once drum 1408 is emptied, float 1444 will return to the lower position (i.e., open position 1416) with respect to air inlet conduit 1430, thus opening air inlet 1419 and permitting vacuum inside the drum.

With reference to FIG. 14D, a similar baffled float 1444 can be employed to seal air inlet 1419. However, the embodiment disclosed in FIG. 14D utilizes a float 1444 along a single side of air inlet conduit 1430. As similarly described with reference to FIGS. 14B and 14C, as the float rises with the liquid level in drum 1408, the baffle 1412 closes over air inlet 1419, thus eliminating suction inside the drum.

Figure 14E:
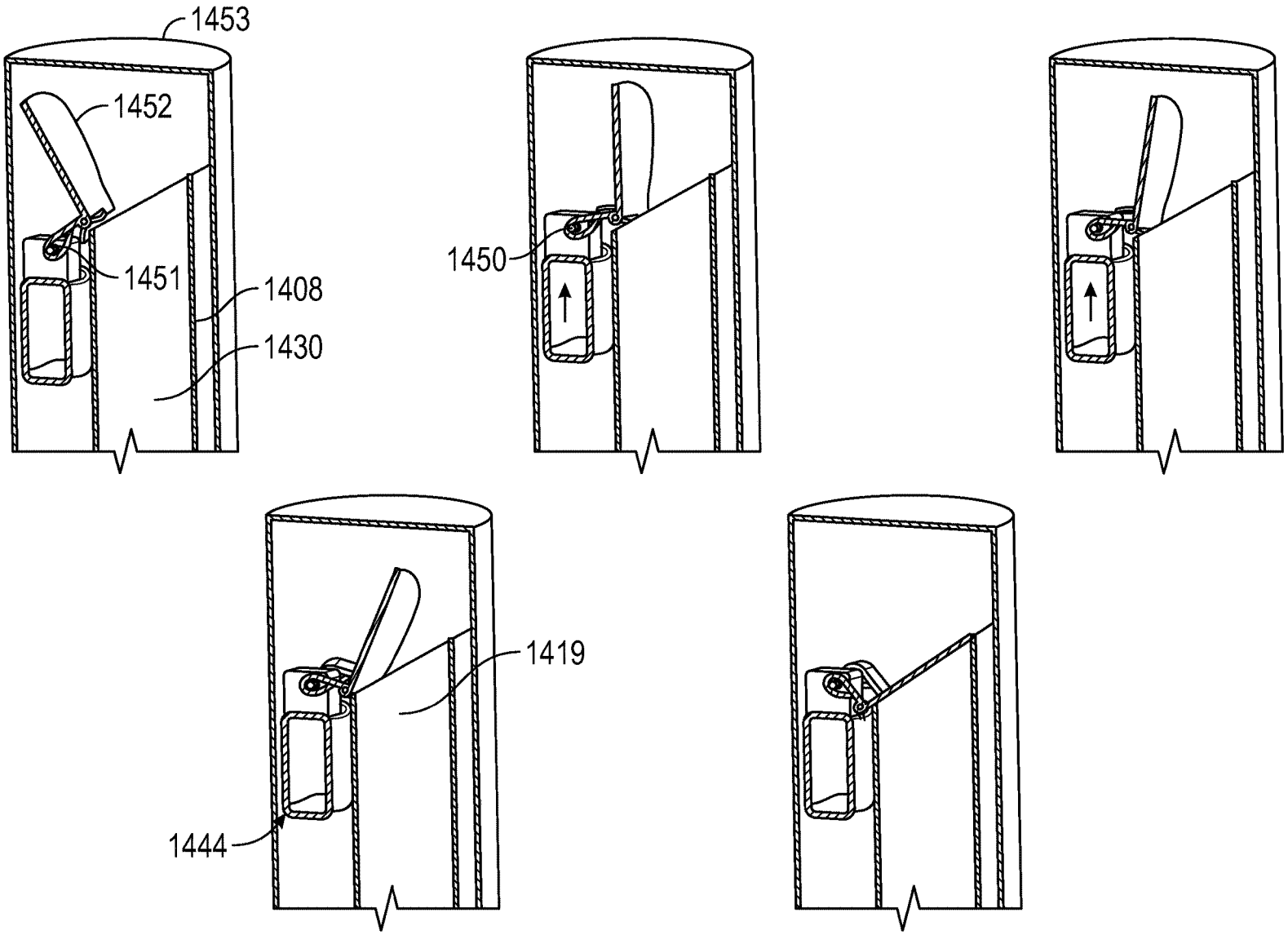
FIG. 14E illustrates a cross sectional view of a fourth embodiment of a system for restricting the airflow to air inlet conduit.

As shown in FIG. 14E, the float 1444 and a flapper 1452 are preferably pivotly mounted to the drum 1408 through a pivot 1451. The float 1444 and flapper 1452 may be alternatively pivotly mounted to the cage 1453 through the pivot 1451. As water enters the drum 1408, the float 1444 rises and forces the flapper 1452 to pivot about pivot 1451. As water continues to rise, the flapper 1452 continues to rotate until vacuum from the motor suck it into sealing engagement with air inlet 1419, closing off air inlet 1419, and eliminating suction inside the drum 1408.

Figure 14F:
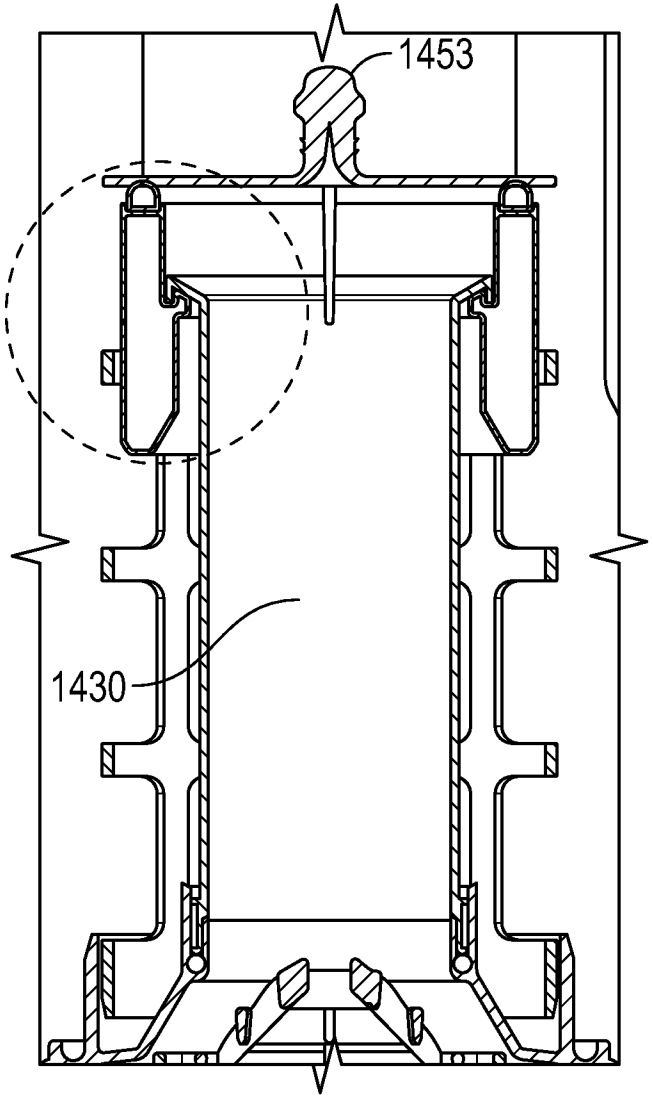
FIG. 14F illustrates a fifth embodiment of a system for restricting the airflow to air inlet conduit.
Figure 14F:
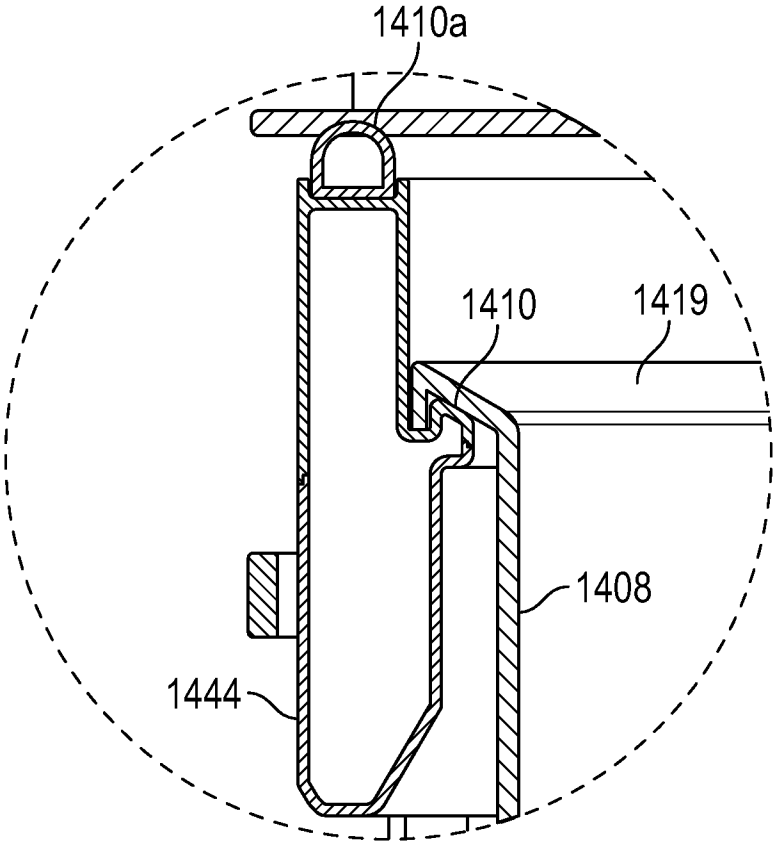
Figure 14H:
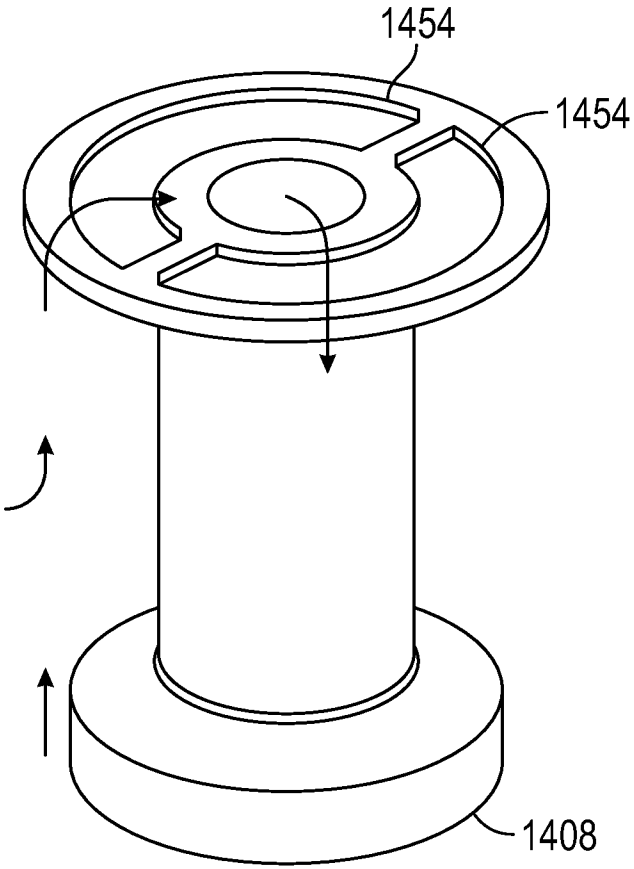
FIGS. 14G & 14H illustrate a sixth embodiment of a system for restricting the airflow to air inlet conduit.
Figure 14G:
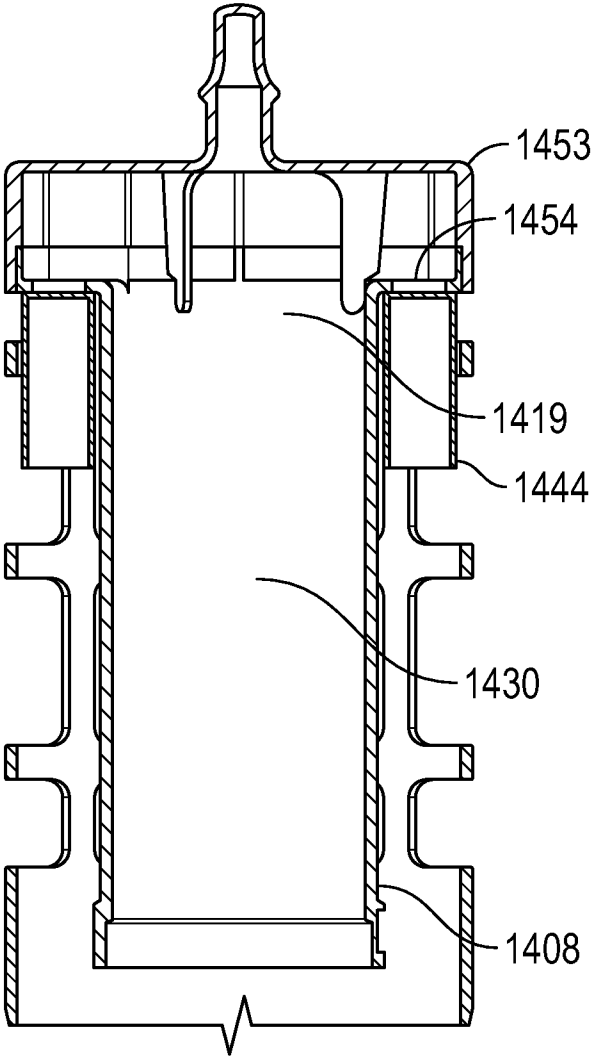
Figure 14I:
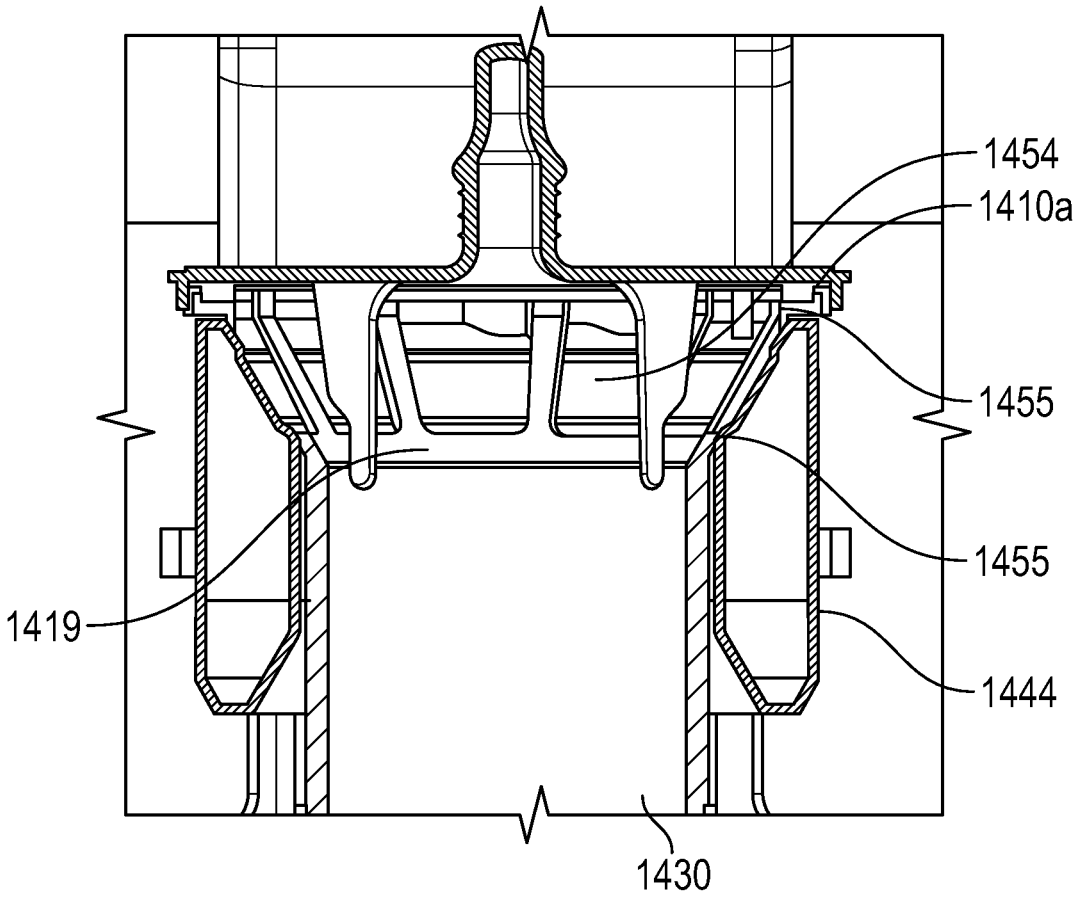
FIGS. 14I & 14J illustrate a seventh embodiment of a system for restricting the airflow to air inlet conduit.
Figure 14J:
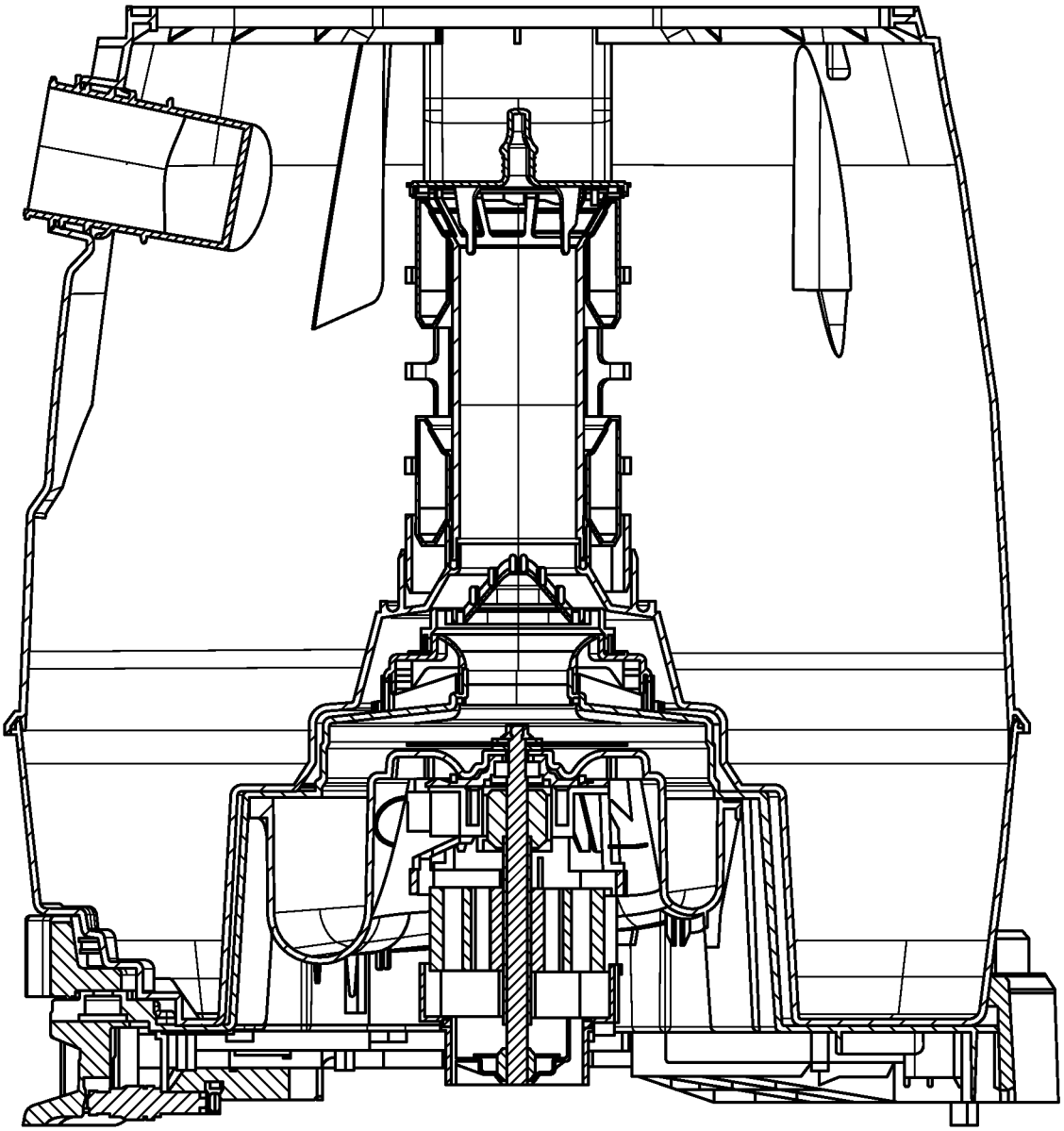

As shown in FIG. 14F, as water enters the drum 1408, the float 1444 starts to rise upward. It continues to rise partially shutting off the air inlet 1419. Once the float 1444 reaches its determined maximum height, the flexible seal 1410A seals to the cage shutting off suction at the top of the float, and labyrinth seal 1410 seals to the inside of the float. Seal 1410A is preferably a flexible seal to allow for manufacturing tolerances of the parts and assembly. At the most vertical portion of the travel of float 1444, the air inlet is sealed, thus eliminating the suction to the drum.

Referring to FIG. G and FIG. H, the drum 1408 has an external horizontal flange 1455 that seals to the cage 1453. This flange may be molded as a separate piece to simply manufacturability of the drum. This drum flange has air openings 1454 that allow air to flow into the air inlet conduit. These openings preferably have an area large enough so that it is not a restriction to the air flow system, reducing overall vacuum performance. As waters enters the drum 1408, the float 1444 starts to rise upward. It continues to rise towards shutting off the openings in drum flange 1455. This in turn eliminates the air to the air inlet 1419, thus eliminating the suction to the drum.

As shown in FIG. 1 and FIG. J, flange 1455 of the drum 1408 may be conical. This conical flange 1455 may be molded as a separate piece to simply manufacturability of the drum. This conical drum flange has air openings 1454 that allow air to flow into the air inlet conduit. These openings need to have an area large enough so that it is not a restriction to the air flow system, reducing overall vacuum performance. As waters enters the drum 1408, the float 1444 starts to rise upward. The float 1444 continues to rise towards, and eventually shutting off the openings 1454 in drum flange 1455, sealing on surfaces of the conical drum flange 1455. This in turn eliminates the air to the air inlet 1419, thus eliminating the suction within the drum 1408.

Figure 15A:
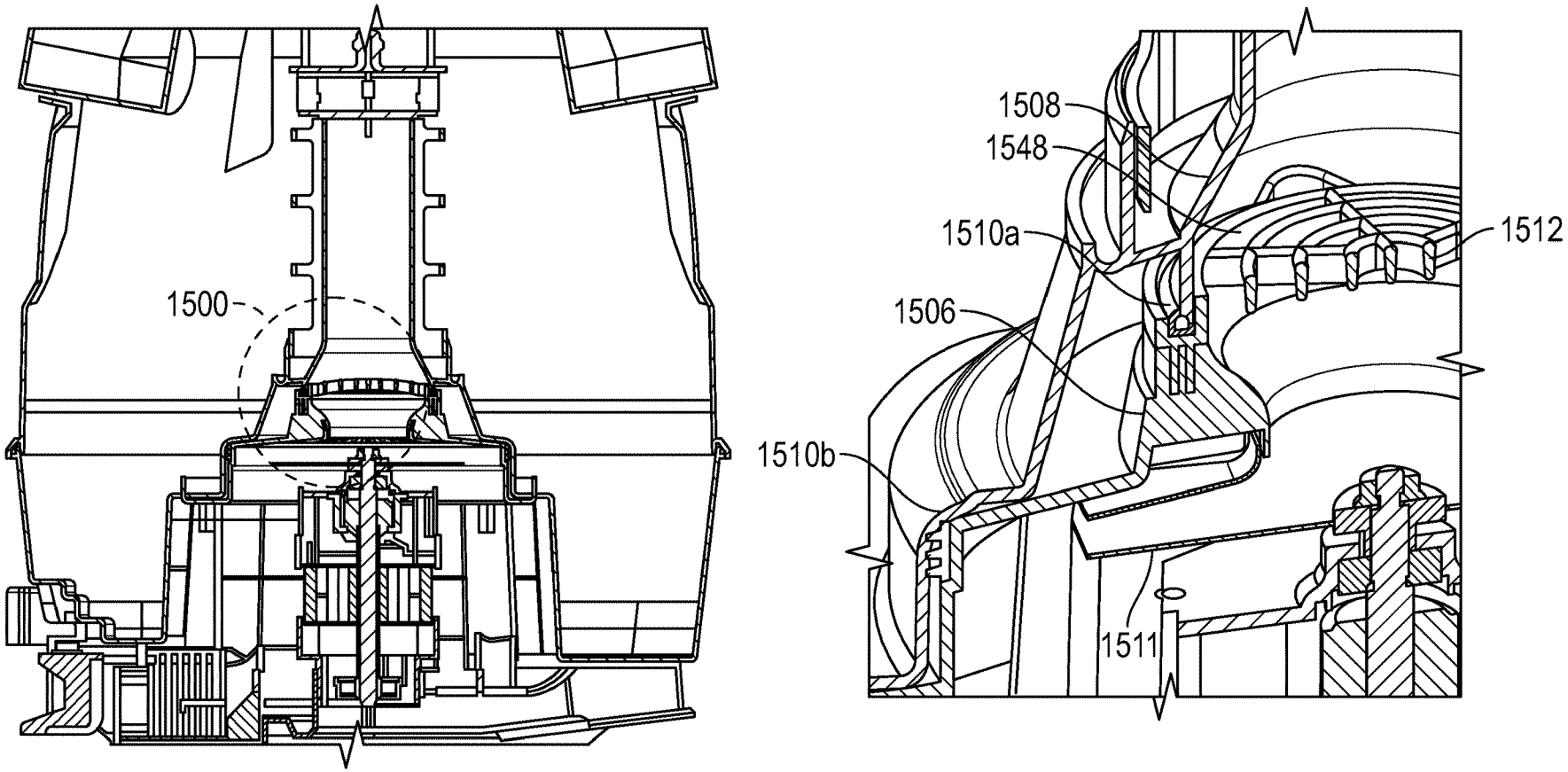
FIG. 15A illustrates a first embodiment of a vacuum apparatus safety system including a detailed view of various elements of the system in accordance with certain aspects of the present disclosure.
Figure 15B:
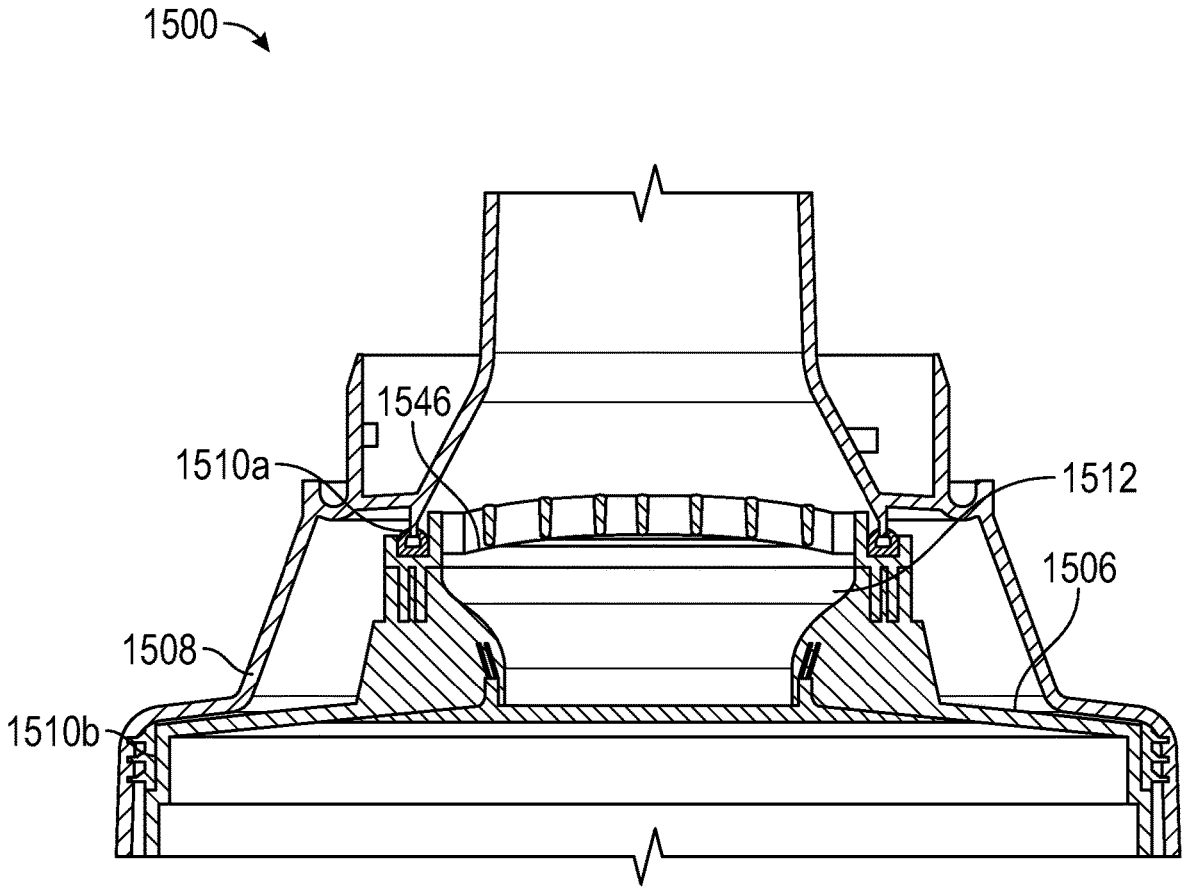
FIG. 15B further illustrates various elements of the detail view of FIG. 15A.
Figure 15C:
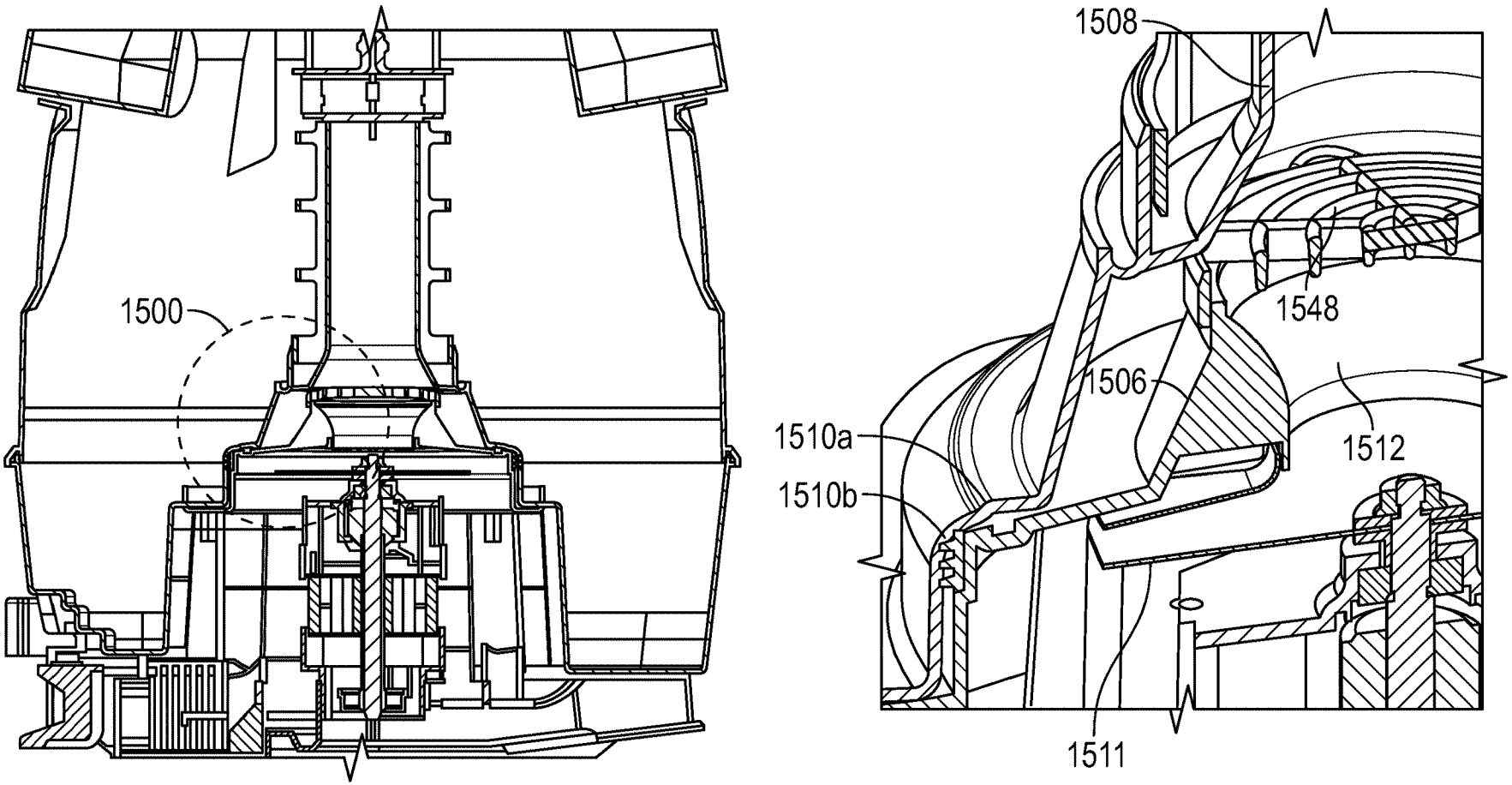
FIG. 15C illustrates a second embodiment of a vacuum apparatus safety system including a detailed view of various elements of the system in accordance with certain aspects of the present disclosure.
Figure 15D:
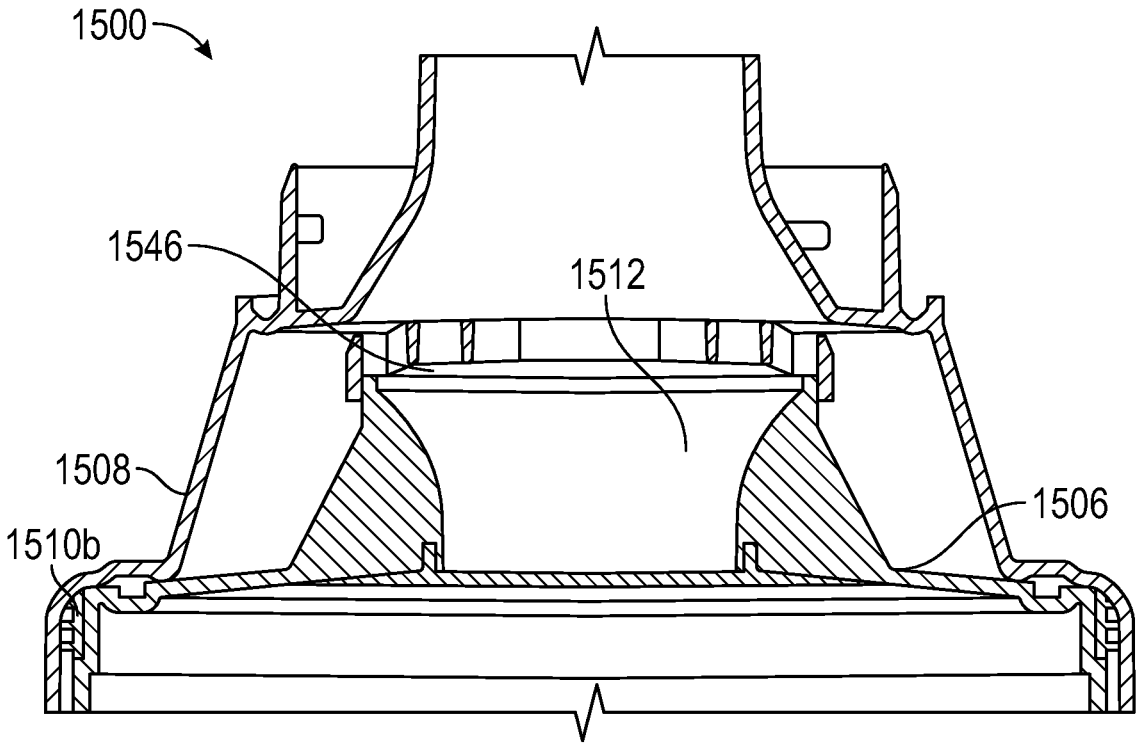
FIG. 15D further illustrates various elements of the detail view of FIG. 15C.

FIG. 15A illustrates a first embodiment of a vacuum apparatus safety system including a detailed view of various elements of the system in accordance with certain aspects of the present disclosure. FIG. 15B further illustrates various elements of the detail view of FIG. 15A. FIG. 15C illustrates a second embodiment of a vacuum apparatus safety system including a detailed view of various elements of the system in accordance with certain aspects of the present disclosure. FIG. 15D further illustrates various elements of the detail view of FIG. 15C. These figures will be described in conjunction with one another.

System 1500 can include a base 1506 and drum 1508 coupled thereto. The coupling of drum 1508 to base 1506 can be facilitated with one or more seals, for example, vertical seal 1510*a* and radial seal 1510*b*. Base 1506 and drum 1508 can include the examples and embodiments described in greater detail above in conjunction with FIGS. 1-12 (e.g., base 106 and drum 108, respectively) and, thus in the interest of clarity and brevity, will not be described in additional detail in conjunction with these figures. Further, system 1500 can include intake shield 1548 and venturi 1512 that can include, for example, a tube or conduit for creating suction.

Once drum 1508 is decoupled and/or removed from base 1506, the blower wheel of the motor 1511 is exposed by virtue of disposing motor within base 1506 and/or below drum 1508. Because such exposure is a safety concerns (e.g., fingers, hands, etc. can get caught in the motor's blower wheel), intake shield 1548 is provided as a guard to prevent harm or injury when the drum 1508 is removed, as described in greater detail below.

Vertical seal 1510*a* and radial seal 1510*b* can include any seal, gasket, flexible material, or the like for providing an airtight, watertight, seal between two or more components. For example, in FIGS. 15A and 15B, vertical seal 1510*a* and radial seals 1510*b* can include suction-type seals formed and/or disposed between a portion of base 1506 and drum 1508. Because relatively large movements can occur between drum 1508 can and base 1506, these two seals provide improved sealing between base 1506 and drum 1508 through either sheering and/or radial movement of the drum 1508 relative to the base 1506. Additionally, though not shown in the figures, an integral dual seal can be disposed between intake shield 1546 and base 1506.

Intake shield 1546 can include any plate, cover, or the like, that can permit the flow of air and/or other fluids through it, while minimizing the areas of contact through which an operator can contact the blower wheel (not shown). For example, intake shield 1546 can include a series of ribs and/or openings for which the air may pass through from one side of shield 1546 to the other. Alternatively, intake shield 1546 can include a series of perforations to allow air to pass therethrough.

In the example of a rib-opening shield, intake shield 1546 and venturi 1512 can be designed to minimize the suction loss and/or power loss created by the cross-sectional areas of the ribs for which air cannot pass. For example, in FIGS. 15C and 15D, the size of the venturi 1512 is increased to improve the overall airflow to blower wheel (not shown). Further, the ribs of intake shield 1546 can be spaced at wider intervals than the shield 1546 depicted in FIGS. 15A and 15B to realize further improvements to the blower's airflow capacity. Additional variations, as described in greater detail below, are contemplated as well.

Figure 15E:
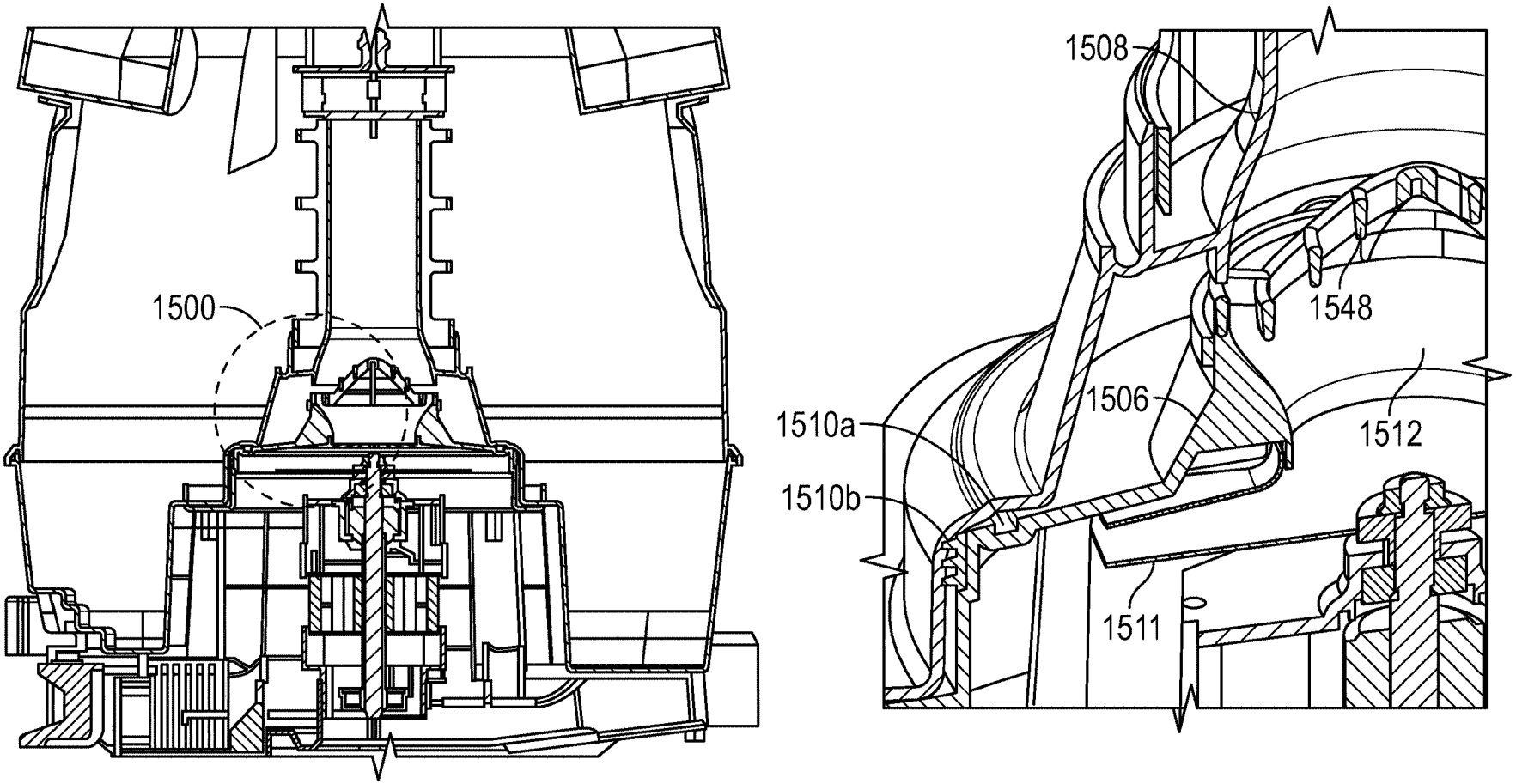
FIG. 15E illustrates a third embodiment of a vacuum apparatus safety system including a detailed view of various elements of the system in accordance with certain aspects of the present disclosure.
Figure 15F:
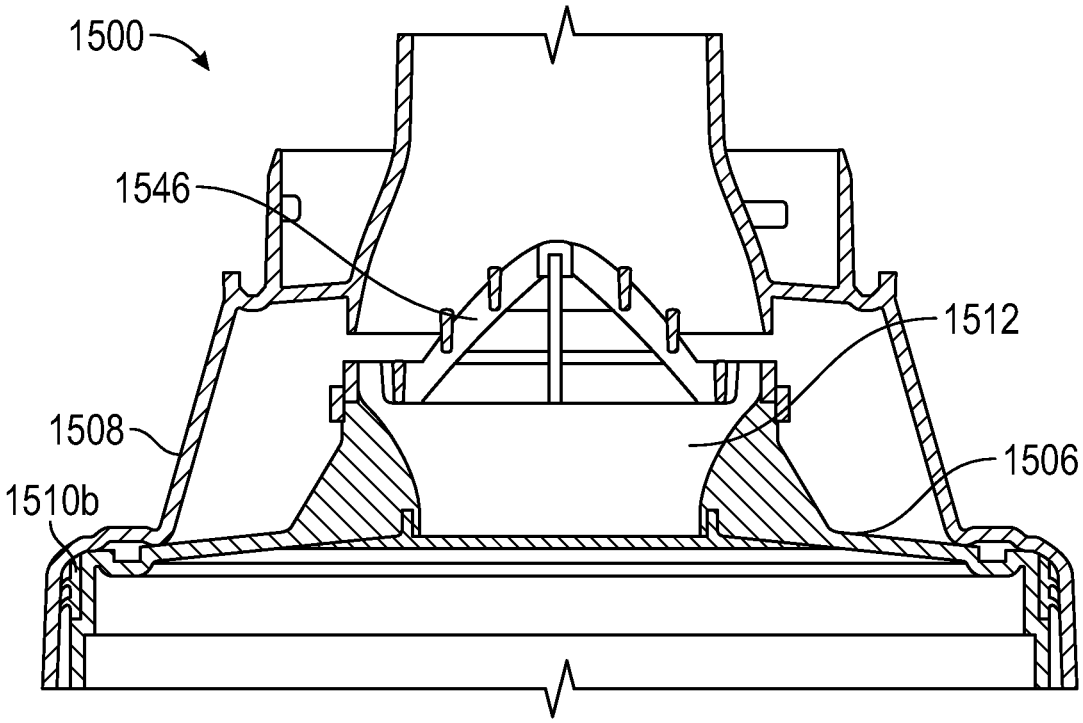
FIG. 15F further illustrates various elements of the detail view of FIG. 15E.
Figure 15G:
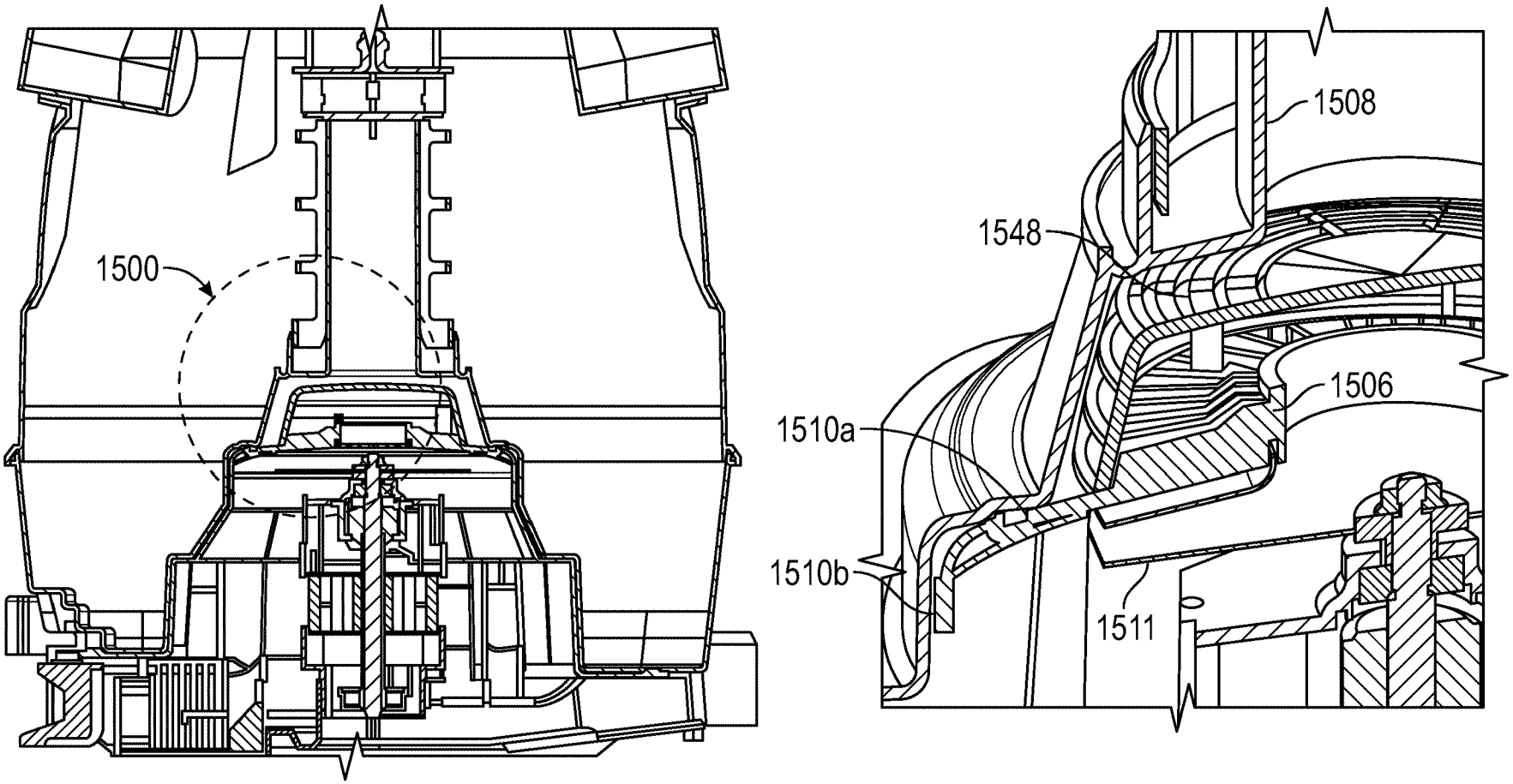
FIG. 15G illustrates a fourth embodiment of a vacuum apparatus safety system including a detailed view of various elements of the system in accordance with certain aspects of the present disclosure.
Figure 15H:
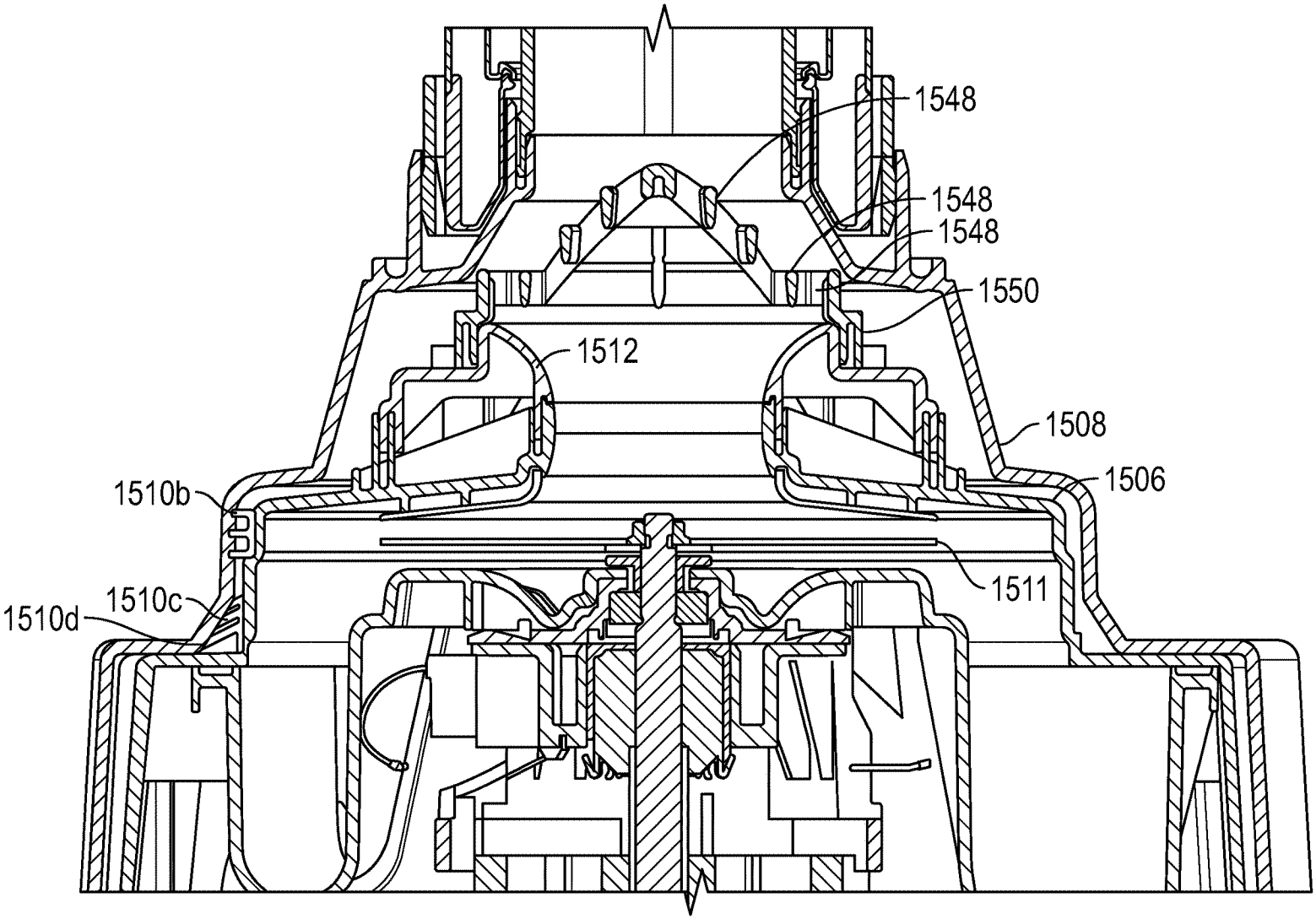
FIG. 15H further illustrates various elements of the detail view of FIG. 15G.

FIG. 15E illustrates a third embodiment of a vacuum apparatus safety system including a detailed view of various elements of the system in accordance with certain aspects of the present disclosure. FIG. 15F further illustrates various elements of the detail view of FIG. 15E. FIG. 15G illustrates a fourth embodiment of a vacuum apparatus safety system including a detailed view of various elements of the system in accordance with certain aspects of the present disclosure. These figures will be described in conjunction with one another. FIG. 15H further illustrates various elements of the detail view of FIG. 15G.

In addition to the examples provided above in the previous figures, venturi 1512 and the rib placement of intake shield 1546 can take additional, modified forms. For example, with specific reference to FIGS. 15E and 15F, ribs of intake shield 1546 can be varied in height so that only one set of rings effect a reduction in cross-sectional area to blower wheel (not shown) at any given time. This configuration, paired with a venturi 1512 with increased diameter as illustrated in FIGS. 15E and 15F, for example, increases the airflow and, thus, minimizes the suction and/or power loss as a result of coupling intake shield 1546 to safety system 1500. Finally, in another example with specific reference to FIG. 15G, intake shield 1546 can be disposed directly above the blower wheel (not shown) and may include the filter (not shown) opening between base 1506 and intake shield 1546.

Figure 15I:
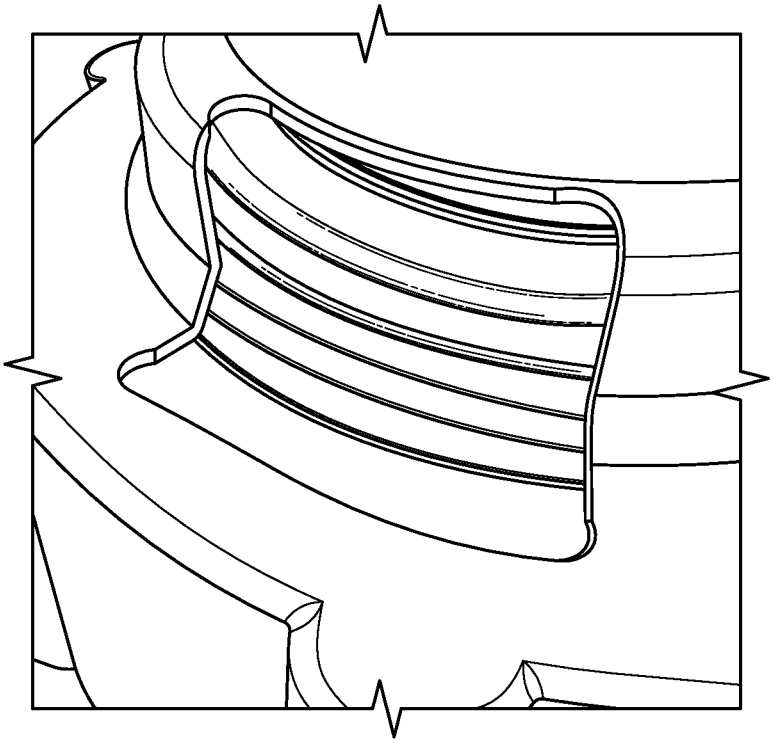
FIG. 15I illustrates a radial seal with multiple seal rings being deformed downwardly by the surrounding structure, such that a vacuum will pull the rings upwards, thereby sealing thereto.

FIG. 15H shows a cross section of another preferred embodiment of intake shield with 2 types of drum 1508 to base 1506 seals. Seal 1510*b* utilizes an elastomeric profile with horizontal extending ribs. These extending ribs deflect from natural position as the drum 1508 is placed onto the drum. These ribs then form an airtight seal between the drum 1508 and base 1506 in the operating position. This type of seal increases the force to remove the drum 1508 from the base 1506. Seal 1510C is an alternate design where the seal is created on a tapered surface 1510D. The extending ribs of the seal 1510C are created longer as they travel outwardly along the taper. These ribs then form an airtight seal between the drum 1508 and base 1506 as the drum are lowered into position on base. An advantage of this design is that as you remove the drum 1508, there is no circumferential interference of the seal ribs to the drum, and the drum removes easily from the base. FIG. 15I is a broken cross section showing the seal ribs 1510C in position, sealing the drum 1508 and base 1506.

Particular embodiments of the invention may be described below with reference to block diagrams and/or operational illustrations of methods. It will be understood that each block of the block diagrams and/or operational illustrations, and combinations of blocks in the block diagrams and/or operational illustrations, can be implemented by analog and/or digital hardware, and/or computer program instructions. Such computer program instructions may be provided to a processor of a general-purpose computer, special purpose computer, ASIC, and/or other programmable data processing system. The executed instructions may create structures and functions for implementing the actions specified in the block diagrams and/or operational illustrations.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions. Discussion of singular elements can include plural elements and vice-versa.

Figure 16:
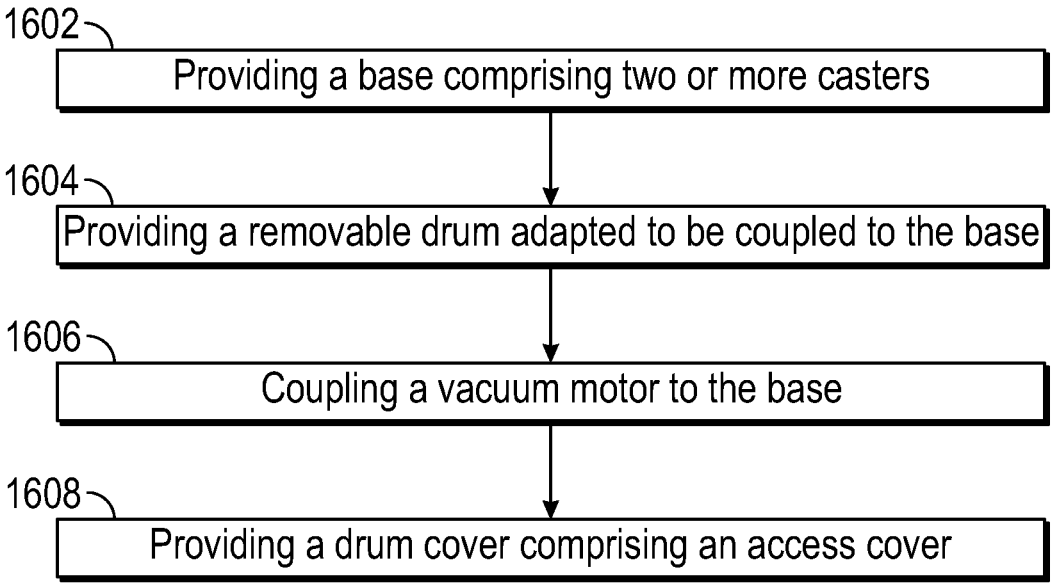
FIG. 16 is a flow chart depicting a process in accordance with certain aspects of the present disclosure.

FIG. 16 illustrates a flow diagram depicting an exemplary method for increasing the stability of a wet/dry vacuum. The method 1600 can include the step 1602 of providing a base that can include two or more casters and the step 1604 of providing a removable drum that can be adapted to be coupled to the base. Further, the method can include the step 1606 of coupling a vacuum motor to the base and the step 1608 of providing a drum cover that can include an access cover for the removable drum. The vacuum motor can be adapted to be disposed beneath the removable drum when the drum is coupled to the base. Moreover, the drum cover and access cover can each be adapted to engage in an open and a closed position and the drum can be adapted to receive debris through the access cover when the access cover is in an open position and the drum cover is in a closed position.

In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved. For example, FIG. 16 illustrates one possible embodiment of a method. More specifically, as presently disclosed in FIG. 16, the step 1606 of providing coupling a vacuum motor to the base occurs after the step 1604 of providing a removable drum adapted to be coupled to the base. Other embodiments can include performing step 1606 before step 1604. In other embodiments, some steps can be omitted altogether. Therefore, though not explicitly illustrated in the figures, any and all combinations or sub-combinations of the steps illustrated in FIG. 16, or additional steps described in the figures or the detailed description provided herein, can be performed in any order, with or without regard for performing the other recited steps.

While the drum described above is removable from the base, that need not be the case. The drum may be integral to the base, with the motor also integrated into the base, as shown and described above. Further, the drum may be a single molded piece, or may be molded as two or more separate pieces and then joined together.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicant, but rather, in conformity with the patent laws, Applicant intends to fully protect all such modifications and improvements that come within the scope or range or equivalent of the following claims.

It should also be noted that the various embodiments of the different components described above may be mixed and matched. For example, any of the lock mechanisms discussed with respect to FIG. 8A-FIG. 8L may be used on a vacuum appliance having any of the scrolls of FIG. 9A-FIG. 12C, and/or any of the systems for restricting airflow of FIG. 14A-FIG. 14J.

What is claimed is:

1. A vacuum apparatus with improved stability, the vacuum apparatus comprising:

a vacuum motor;

a removable drum adapted to store debris collected by the vacuum apparatus, the removable drum including an interior surface elevated from a bottom of the removable drum, an air inlet conduit extending upward from the elevated surface, and a filter cage circumscribing the air inlet conduit, wherein the air inlet conduit includes a first end portion at the elevated surface and an opposing second end portion having an inlet, and wherein the filter cage extends from the first end portion along the air inlet conduit to a distal end portion adjacent the second end portion of the air inlet conduit, wherein the filter cage is sized and shaped to removably receive an elongate, cylindrical filter thereon such that the filter is spaced from the bottom of the removable drum;

an air intake shield positioned at or near the first end portion of the air inlet conduit between the air inlet conduit and the motor; and a base, wherein the base is adapted to receive the removable drum;

wherein the vacuum motor is disposed underneath the removable drum when the removable drum is coupled to the base, and wherein, in operation, air flows through the filter cage, through the inlet to the air inlet conduit, and downwardly to the air intake shield.

2. The vacuum apparatus of claim 1 further comprising at least two casters, wherein the casters are adapted to be coupled to a first edge of the base.

3. The vacuum apparatus of claim 2 further comprising two additional casters, wherein the two additional casters are adapted to be coupled to a second edge of the base, and further wherein the second edge is disposed on a side of the base opposite the first edge.

4. The vacuum apparatus of claim 1 further comprising an accessory coupler adapted to couple one or more accessories to the drum.

5. The vacuum apparatus of claim 4, wherein the accessory coupler is adapted to expand and contract to store the one or more accessories.

6. The vacuum apparatus of claim 1, wherein the removable drum is adapted to attenuate the sound produced by the motor.

7. The vacuum apparatus of claim 1 further comprising a power switch disposed below the removable drum, wherein the power switch is adapted to be toggled between an on and off position by an operator's foot.

8. The vacuum apparatus of claim 1, wherein the removable drum has a first maximum storage capacity, further wherein the removable drum is adapted to be interchanged with a replacement removable drum having a second maximum storage capacity that is either less than or greater than the first maximum storage capacity.

9. The vacuum apparatus of claim 1 further comprising a biased actuator, wherein the actuator is adapted to facilitate the coupling and decoupling of the drum to the base.

10. The vacuum apparatus of claim 1 further comprising a lock mechanism, wherein the lock mechanism is adapted to be received by a receiving plate in the base to secure the drum to the base.

11. The vacuum apparatus of claim 1, wherein the motor is disposed in a vertical orientation relative to the drum and the base.

12. The vacuum apparatus of claim 11, wherein the motor and the filter cage are axially aligned with the drum's central axis.

13. The vacuum apparatus of claim 1 further comprising an auto-shutoff switch, wherein the auto-shutoff switch is actuated when the removable drum is filled to at least a predetermined capacity.

14. The vacuum apparatus of claim 1, wherein the removable drum comprises a drum inlet adapted to pass air between an inside and outside portion of the removable drum.

15. The vacuum apparatus of claim 14 further comprising a scroll apparatus, wherein the scroll apparatus is adapted to direct the flow of motor exhaust perpendicularly with respect to air flowing through the drum inlet.

16. The vacuum apparatus of claim 1 further comprising a float configured to rise with a liquid level within the removable drum to obstruct an air inlet to the vacuum motor.

17. The vacuum apparatus of claim 1, wherein the vacuum motor is either interposed between the removable drum and the base or disposed underneath a portion of the base.

18. A method for improving the stability of a wet/dry vacuum, the method comprising:

providing a base comprising two or more casters;

providing a removable drum adapted to store debris collected by the wet/dry vacuum, wherein the removable drum is adapted to be coupled to the base, the removable drum including an interior surface elevated from a bottom of the removable drum, an air inlet conduit extending upward from the elevated surface, and a filter cage circumscribing the air inlet conduit, wherein the air inlet conduit includes a first end portion at the elevated surface and an opposing second end portion having an inlet, and wherein the filter cage extends from the first end portion along the air inlet conduit to a distal end portion adjacent the second end portion of the air inlet conduit, wherein the filter cage is sized and shaped to removably receive an elongate, cylindrical filter thereon such that the filter is spaced from the bottom of the removable drum;

coupling a vacuum motor to the base; and positioning an air intake shield at or near the first end portion of the air inlet conduit between the air inlet conduit and the vacuum motor;

wherein the vacuum motor is disposed underneath the removable drum when the removable drum is coupled to the base when the drum is coupled to the base, and wherein, in operation, air flows through the filter cage, through an inlet to the air inlet conduit, and downwardly to the air intake shield.

19. The method of claim 18 further comprising providing a drum cover comprising an access cover for the removable drum.

20. The method of claim 19, wherein the drum cover and access cover are each adapted to engage in an open and a closed position.

21. A vacuum apparatus with improved stability, the vacuum apparatus comprising:

a vacuum motor;

a removable drum adapted to store debris collected by the vacuum apparatus, the removable drum including an interior surface elevated from a bottom of the removable drum, an air inlet conduit extending upward from the elevated surface, and a filter cage circumscribing the air inlet conduit and extending at least a majority of the length of the air inlet conduit wherein the air inlet conduit extends at least a majority of the length of the filter cage, wherein the air inlet conduit includes a first end portion at the elevated surface and an opposing second end portion having an inlet, and wherein the filter cage is sized and shaped to removably receive an elongate, cylindrical filter thereon such that the filter is spaced from the bottom of the removable drum;

an air intake shield positioned at or near the first end portion of the air inlet conduit between the air inlet conduit and the motor; and a base, wherein the base is adapted to receive the removable drum;

wherein the vacuum motor is adapted to be disposed underneath the removable drum when the removable drum is coupled to the base, and wherein, in operation, air flows through the filter cage, through the inlet to the air inlet conduit, and downwardly to the air intake shield.

* * * * *